US012495942B2

(12) United States Patent
De Wit et al.

(10) Patent No.: US 12,495,942 B2
(45) Date of Patent: Dec. 16, 2025

(54) WET CLEANING APPARATUS

(71) Applicant: VERSUNI HOLDING B.V., Eindhoven (NL)

(72) Inventors: Bastiaan Johannes De Wit, Eindhoven (NL); Willem Wiersema, Eindhoven (NL); Fokke Roelof Voorhorst, Eindhoven (NL)

(73) Assignee: VERSUNI HOLDING B.V., Eindhoven (NL)

( * ) Notice: Subject to any disclaimer, the term of this patent is extended or adjusted under 35 U.S.C. 154(b) by 0 days.

(21) Appl. No.: 18/728,409

(22) PCT Filed: Jan. 9, 2023

(86) PCT No.: PCT/EP2023/050357
§ 371 (c)(1),
(2) Date: Jul. 11, 2024

(87) PCT Pub. No.: WO2023/135093
PCT Pub. Date: Jul. 20, 2023

(65) Prior Publication Data

US 2025/0000325 A1 Jan. 2, 2025

(30) Foreign Application Priority Data

Jan. 11, 2022 (EP) ..... 22150862
Jan. 11, 2022 (EP) ..... 22150879
(Continued)

(51) Int. Cl.
*A47L 11/30* (2006.01)
*A47L 11/40* (2006.01)
*A47L 13/22* (2006.01)

(52) U.S. Cl.
CPC ..... *A47L 11/30* (2013.01); *A47L 11/4005* (2013.01); *A47L 11/4016* (2013.01);
(Continued)

(58) Field of Classification Search
CPC .. A47L 11/4088; A47L 11/30; A47L 11/4044; A47L 11/4016; A47L 11/34; A47L 13/225; A47L 13/16; A47L 9/2805
See application file for complete search history.

(56) References Cited

U.S. PATENT DOCUMENTS 1,066,201 A * 7/1913 Fulper ..... A47L 11/4044 15/50.1
2,506,077 A 5/1950 Goldsmith
(Continued)

FOREIGN PATENT DOCUMENTS

CN 107205600 A 9/2017
CN 110325090 A 10/2019
(Continued)

OTHER PUBLICATIONS

Extended European Search Report issued in connection with corresponding EP Application No. 22150879.9 dated Jul. 5, 2022.
(Continued)

*Primary Examiner* — Joel D Crandall
(74) *Attorney, Agent, or Firm* — Maschoff Brennan

(57) ABSTRACT

A wet cleaning apparatus including a cleaner head and an underpressure generator arrangement, is described. The cleaner head has at least one dirt inlet, and a porous material covering the at least one dirt inlet. The underpressure generator arrangement includes an underpressure generator to provide a flow inside the wet cleaning apparatus for drawing fluid into the at least one dirt inlet through the porous material. The underpressure generator arrangement controls the flow based on a pressure on the inside of the wet cleaning apparatus between the porous material and the underpressure generator.

15 Claims, 27 Drawing Sheets

(30) Foreign Application Priority Data

| | | |
|---|---|---|
| Jan. 11, 2022 | (EP) | 22150883 |
| Jan. 11, 2022 | (EP) | 22150888 |
| Jan. 11, 2022 | (EP) | 22150898 |
| Jan. 11, 2022 | (EP) | 22150901 |
| Jan. 11, 2022 | (EP) | 22150906 |
| Jan. 11, 2022 | (EP) | 22150912 |

(52) U.S. Cl.
CPC ..... *A47L 11/4036* (2013.01); *A47L 11/4044* (2013.01); *A47L 11/4083* (2013.01); *A47L 11/4088* (2013.01); *A47L 13/22* (2013.01)

(56) References Cited

U.S. PATENT DOCUMENTS

| | | | | | |
|---|---|---|---|---|---|
| 4,103,519 | A | * | 8/1978 | Davidson | A47L 11/4027 134/1 |
| 4,490,882 | A | * | 1/1985 | Wells | A47L 5/30 15/337 |
| 5,074,008 | A | | 12/1991 | Palomino, Jr. | |
| 5,084,938 | A | * | 2/1992 | Knestele | A47L 13/22 15/98 |
| 5,301,387 | A | * | 4/1994 | Thomas | A47L 11/30 15/364 |
| 5,720,078 | A | | 2/1998 | Heintz | |
| 6,260,232 | B1 | | 7/2001 | Nelson et al. | |
| 2004/0031119 | A1 | | 2/2004 | McKay | |
| 2007/0033767 | A1 | | 2/2007 | Dodson et al. | |
| 2010/0236018 | A1 | | 9/2010 | Vrdoljak et al. | |
| 2013/0019901 | A1 | | 1/2013 | Gerhards | |
| 2016/0073845 | A1 | | 3/2016 | Walz et al. | |
| 2016/0213214 | A1 | | 7/2016 | Lubbers et al. | |
| 2019/0082925 | A1 | | 3/2019 | Conrad et al. | |
| 2019/0380553 | A1 | | 12/2019 | De Wit et al. | |
| 2020/0187737 | A1 | | 6/2020 | Croggon et al. | |
| 2021/0127917 | A1 | | 5/2021 | James et al. | |
| 2021/0153705 | A1 | | 5/2021 | Croggon et al. | |

FOREIGN PATENT DOCUMENTS

| | | | | | |
|---|---|---|---|---|---|
| CN | 113645888 | A | | 11/2021 | |
| DE | 3143355 | A1 | | 5/1983 | |
| DE | 102007059930 | B3 | | 2/2009 | |
| DE | 102008010068 | A1 | | 8/2009 | |
| DE | 102011078388 | A1 | | 1/2013 | |
| DE | 102013223864 | A1 | | 5/2015 | |
| EP | 3335611 | A1 | | 6/2018 | |
| EP | 3366182 | A1 | | 8/2018 | |
| JP | 2017-505151 | A | | 2/2017 | |
| KR | 940001037 | Y1 | | 2/1994 | |
| KR | 20070010775 | A | * | 7/2005 | A47L 11/4088 |
| RU | 2312580 | C2 | | 12/2007 | |
| WO | 9401035 | A1 | | 1/1994 | |
| WO | 9625872 | A1 | | 8/1996 | |
| WO | 2016008773 | A1 | | 1/2016 | |
| WO | 2017071942 | A1 | | 5/2017 | |
| WO | 2020198211 | A1 | | 10/2020 | |

OTHER PUBLICATIONS

Extended European Search Report issued in connection with corresponding EP Application No. 22150883.1 dated Jul. 5, 2022.
Extended European Search Report issued in connection with corresponding EP Application No. 22150888.0 dated Jul. 5, 2022.
Extended European Search Report issued in connection with corresponding EP Application No. 22150906.0 dated Jul. 5, 2022.
Extended European Search Report issued in connection with corresponding EP Application No. 22150912.8 dated Jul. 5, 2022.
Extended European Search Report issued in connection with corresponding EP Application No. 22150901.1 dated Jul. 11, 2022.
Extended European Search Report issued in connection with corresponding EP Application No. 22150862.5 dated Jul. 27, 2022.
Extended European Search Report issued in connection with corresponding EP Application No. 22150898.9 dated Jul. 27, 2022.

* cited by examiner

WET CLEANING APPARATUS

CROSS-REFERENCE TO RELATED APPLICATIONS

The present application is a U.S. National Phase application under 35 U.S.C. § 371 of International Application No. PCT/EP2023/050357, filed on Jan. 9, 2023, which claims the benefit of European Patent Application No. 22150862.5, filed on Jan. 11, 2022, European Patent Application No. 22150879.9, filed on Jan. 11, 2022, European Patent Application No. 22150883.1, filed on Jan. 11, 2022, European Patent Application No. 22150888.0, filed on Jan. 11, 2022, European Patent Application No. 22150898.9, filed on Jan. 11, 2022, European Patent Application No. 22150901.1, filed on Jan. 11, 2022, European Patent Application No. 22150906.0, filed on Jan. 11, 2022, and European Patent Application No. 22150912.8, filed on Jan. 11, 2022. These applications are hereby incorporated by reference herein.

FIELD OF THE INVENTION

This invention relates to a wet cleaning apparatus, such as a wet mopping device, comprising a cleaner head. The wet cleaning apparatus can be used, for example, for cleaning a floor, an indoor surface or a window.

BACKGROUND OF THE INVENTION

Wet cleaning apparatuses, for example wet mopping devices, are known which remove water from a surface to be cleaned. Such wet cleaning apparatuses can also apply cleaning liquid, e.g. water, to the surface to be cleaned, and then remove the liquid, e.g. with a suitable cloth.

Some wet cleaning apparatuses have powered pick-up functionality for removing the water from the surface to be cleaned. Wet vacuum cleaners, for instance, may pick up liquid by generating sufficient airspeed (e.g. at least 10 m/s) and/or brushpower to exert enough shear force on liquid droplets to cause them to enter the device. Typical power consumption values for such vacuum cleaners are relatively high, for example in the order of several hundred watts.

A further challenge can arise when the wet cleaning apparatus is arranged to deliver cleaning liquid as well as pick up the liquid using suction. Providing both functionalities can, in at least some designs, risk that the cleaning liquid is used inefficiently.

There can also be a risk that poorly controlled delivery of the cleaning liquid, during or even after use, results in soaking of the environment with the cleaning liquid. Such soaking of the surface to be cleaned may not, in at least some circumstances, be easily addressed by the pick-up functionality of the apparatus, particularly when a relatively low power pick-up system is employed.

In some designs, the pick-up functionality can also risk hindering movement of a cleaner head of such a wet cleaning apparatus over a wet surface to be cleaned.

US 2019/380553 A1 discloses a cleaning device comprising a surface interaction layer, a cleaning fluid supply provided with a cleaning fluid channel at the surface interaction layer for supplying a cleaning fluid to a surface through the surface interaction layer being in contact with the surface. The cleaning device further comprises a dirty fluid drain having a dirty fluid channel at the surface interaction layer for draining, by means of underpressure, dirty water from the surface through the surface interaction layer being in contact with the surface.

KR 940 001 037 Y1 discloses a vacuum cleaner with a wet duster.

WO 2016/008773 A1 discloses a surface cleaning device comprising a cloth placed on a porous material, a reservoir for collecting liquid absorbed by the cloth, and an arrangement for applying underpressure in the reservoir so as to transfer liquid from the cloth into the reservoir. A pore size of the porous material is between 1 μm and 50 μm.

DE 10 2013 223864 A1 discloses a method for operating a vacuum cleaner, with a fan having a fan motor, which generates an air flow through a suction nozzle of the vacuum cleaner. A control device of the vacuum cleaner controls the fan depending on a floor covering category to be treated.

DE 10 2007 059930 B3 discloses a device for controlling or regulating a motor power of a vacuum cleaner having at least one motor, a dust separating device and a suction nozzle. The device employs a first sensor for detecting a negative pressure in the area of the suction nozzle.

DE 10 2011 078388 A1 discloses a secondary air valve for a vacuum cleaner, with a housing, an inlet opening for a secondary air flow, an outlet opening for the secondary air flow and a pressure dependent closing means for blocking the flow connection between the inlet opening and the outlet opening. Further disclosed is a vacuum cleaner with a suction nozzle, a suction fan connected to the suction nozzle, a dust separation device arranged in the flow channel, a pressure sensor having an electrical or electronic query means, and the secondary air valve for selectively feeding a secondary air flow into the suction channel.

SUMMARY OF THE INVENTION

The invention is defined by the claims.

According to examples in accordance with an aspect of the invention there is provided a wet cleaning apparatus comprising: a cleaner head having at least one dirt inlet, and a porous material covering the at least one dirt inlet; and an underpressure generator arrangement comprising an underpressure generator configured to provide a flow inside the wet cleaning apparatus for drawing fluid into the at least one dirt inlet through the porous material, wherein the underpressure generator arrangement is configured to control the flow based on a pressure on the inside of the wet cleaning apparatus between the porous material and the underpressure generator.

The porous material may be arranged to contact liquid on the surface to be cleaned.

The porous material may, for example, comprise a porous fabric and/or a porous foam. The porous fabric may, for instance, be a microfiber fabric.

The surface tension of the liquid retained in the pores of the porous material can assist to maintain the underpressure. This surface tension can be overcome, meaning that the air-liquid surface is removed, at a point (or points) on the exterior of the porous material which come into contact with liquid on the surface to be cleaned, causing liquid to be transported through the porous material in the direction of the dirt inlet(s).

By the underpressure generator arrangement controlling the flow based on the pressure on the inside of the wet cleaning apparatus between the porous material and the underpressure generator, fluid transport through the porous material can be advantageously controlled. In some non-limiting examples, such control can minimise foam build-up in, and downstream of, the porous material.

In some embodiments, the underpressure generator arrangement is configured to control the flow such that the pressure is maintained at or above a predetermined pressure threshold.

By controlling the flow such as to maintain the pressure at or above the predetermined threshold, stable and efficient operation of the wet cleaning apparatus may be facilitated. In particular, maintaining the pressure at or above the predetermined threshold may mean that the underpressure generator can be operated more efficiently, for example by being intermittently deactivated/switched-off, thus taking advantage of the above-described capability of the porous material to assist in maintaining the underpressure in the covered dirt inlet(s).

Each pore of the porous material may have a certain breaking pressure, at which the surface tension of the (residual) liquid residing in the pore can no longer withstand the internal underpressure, and gives way. When this happens, the pore may no longer be effectively closed off by liquid contained therein, but may instead start transporting air into the dirt inlet(s). An issue may correspondingly arise when a foaming detergent is included in the cleaning liquid. Broken pores may start transporting air at the rate of the underpressure generator, e.g. pump, which can risk creating relatively large amounts of foam in the dirt inlet(s) and downstream thereof.

Accordingly, the above-mentioned predetermined pressure threshold may, for example, be set to avoid the breaking pressure of at least some of the pores, e.g. the majority or all of the pores, of the porous material being reached. This may assist to avoid foam-related operating issues when detergent is being used.

The predetermined pressure threshold may accordingly be set to limit the underpressure, in other words a pressure difference between the inside of the wet cleaning apparatus between the porous material and the underpressure generator and the exterior of the cleaner head, e.g. atmospheric pressure, to being (e.g. at most) a value in the range of 2000 Pa to 13500 Pa, preferably 2000 Pa to 12500 Pa, more preferably 5000 Pa to 9000 Pa, most preferably 7000 Pa to 9000 Pa.

The breaking pressure of the porous material can be regarded as being negative (with reference to atmospheric pressure). The pressure inside the wet cleaning apparatus between the porous material and the underpressure generator may accordingly be maintained above this negative pressure. On the other hand, should the breaking pressure of the porous material be an absolute pressure (with reference to vacuum, 0 Pa), then still the pressure inside the wet cleaning apparatus between the porous material and the underpressure generator may be maintained above such an absolute pressure, in particular via the flow being controlled such as to maintain the pressure at or above the predetermined threshold.

In some embodiments, the underpressure generator arrangement comprises: a sensor arranged to sense a measure of the pressure in the at least one covered dirt inlet, and a controller configured to control the underpressure generator to provide the flow based on the measure of the pressure.

The controller, e.g. microcontroller, may receive a sensor signal from the sensor and, based on the sensor signal, send a control signal to the underpressure generator. The control signal may, for instance, trigger the underpressure generator to activate to provide the flow or deactivate to cease the flow. Alternatively or additionally, the control signal may, depending on the sensor signal, increase or decrease the flow.

Deactivation or decreasing of the flow provided by the underpressure generator in this manner may assist to reduce power consumption of the wet cleaning apparatus. This may assist to preserve battery power in examples in which the wet cleaning device is battery powered/powerable, and thereby increase runtime.

In embodiments in which the underpressure generator comprises the controller and the sensor, the controller may be configured to control the flow provided by the underpressure generator such that the pressure in the at least one covered dirt inlet is maintained at or above the above-mentioned predetermined pressure threshold.

In a non-limiting example, the controller, e.g. comprising or in the form of a proportional integral controller, is configured to compare the sensed measure of the pressure to a desired operating pressure and control the underpressure generator based on the comparison.

In some embodiments, the sensor is arranged to sense the measure of the pressure in at least one of: a cavity between the porous material and the at least one dirt inlet, and a tube connecting the at least one dirt inlet with the underpressure generator.

Sensing the measure of the pressure in the cavity may be particularly advantageous since the flow can be tuned more directly to the properties of the porous material during use.

Arranging the sensor such that the measure of the pressure is sensed in the tube may provide a relatively straightforward way of incorporating the sensor in the wet cleaning apparatus.

The sensor can be any suitable type of sensor provided that the sensor is capable of sensing the measure of the pressure on the inside of the wet cleaning apparatus between the porous material and the underpressure generator. For example, the sensor comprises a pressure sensor, e.g. a microelectromechanical system (MEMS) pressure sensor.

In some embodiments, the underpressure generator arrangement comprises a mechanical regulator configured to control the flow based on the pressure on the inside of the wet cleaning apparatus between the porous material and the underpressure generator. Such a mechanical regulator may provide relatively simple, robust and inexpensive control over the flow based on the pressure in the covered dirt inlet(s).

In a non-limiting example, the mechanical regulator comprises a switch whose actuation controls the underpressure generator, and a deflectable member, e.g. a membrane, configured to actuate the switch in response to the pressure.

Such a mechanical regulator, in this case an electromechanical regulator, can be configured such that the actuation of the switch, e.g. to deactivate the underpressure generator, by the membrane takes place when, for instance, the pressure is at or above the predetermined pressure threshold.

This switch-membrane arrangement may provide a simple and inexpensive way of controlling the flow based on the pressure without the requirement for an additional controller, e.g. microcontroller.

In some embodiments, the mechanical regulator comprises a valve arranged to control fluid communication between the underpressure generator and the at least one dirt inlet.

In such embodiments, the valve may comprise a valve seat, and a valve member configured to adopt an initial position in which the valve member is separated from the valve seat such as to permit fluid communication between the underpressure generator and the at least one dirt inlet, and a closed position in which the valve member is against the valve seat to restrict, and in some examples block, fluid communication between the underpressure generator and the at least one dirt inlet.

The valve member may, for example, be in the form of a flexible rubber membrane which adopts an undeflected profile in the initial position, and is accordingly spatially removed from the valve seat, when there is no underpressure in the covered dirt inlet(s). After the underpressure generator, e.g. pump, is activated, an underpressure may be generated in the covered dirt inlet(s) and the mechanical regulator. The underpressure may act on an exposed surface of the rubber membrane in the mechanical regulator, which may therefore start to deflect inwards in the direction of the valve seat, such that the valve transitions towards the closed position.

In some embodiments, the valve is configured such that the valve member is caused by the pressure in the at least one covered dirt inlet to be moved against the valve seat when the pressure is below the predetermined pressure threshold.

In the above-described non-limiting example in which the valve member is in the form of the flexible rubber membrane, the threshold pressure can be set/predetermined at least partly by the distance between the flexible rubber membrane and the valve seat. The larger the distance, the higher the underpressure (or equivalently the lower the pressure) in the covered dirt inlet(s) needed to deform the rubber membrane to contact the valve seat.

In some embodiments, a limiting pore diameter of the porous material as measured using ASTM F316—03, 2019, Test A is equal to or greater than 15 μm.

It has been found empirically (as further described herein below) that a limiting pore diameter equal to or greater than 15 μm may assist to maintain a relatively large underpressure whilst ensuring that pores are sufficiently large for efficient liquid transport therethrough. Regarding the latter, it is noted that this observation is supported by theory, noting that, when approximated using a Poiseuille equation, with smaller pores the flow resistance may increase to the power of four.

Equivalently, a bubble point pressure of the porous material as measured using ASTM F316—03, 2019, Test A may be equal to or less than 13500 Pa.

In some embodiments, a limiting pore diameter of the porous material as measured using ASTM F316—03, 2019, Test A is equal to or less than 105 μm. This upper limit for the limiting pore diameter assists to ensure that sufficient underpressure is maintainable by the porous material.

Equivalently, a bubble point pressure of the porous material as measured using ASTM F316—03, 2019, Test A may be equal to or greater than 2000 Pa.

In some embodiments, a limiting pore diameter of the porous material as measured using ASTM F316—03, 2019, Test A is equal to or greater than 15 μm and equal to or less than 105 μm.

Constraining the flow rate to an upper limit may assist to minimise the risk of the pores not being able to withstand the underpressure and hence "breaking", with the consequence that significant amounts of air enters the inside of the wet cleaning apparatus, which, in turn, may necessitate a larger pump consuming more power.

In some embodiments, the underpressure generator is configured to provide a flow rate through the porous material which is less than or equal to 2000 $cm^3$/minute.

Such a flow rate may be significantly lower than for the conventional wet vacuum cleaners mentioned above. Since power is equal to flow rate multiplied by the pressure difference, by combining this maximum 2000 $cm^3$/minute flow rate (0.03 l/s) with the above-described maximum 13500 Pa pressure difference as a maximum power consumption scenario, the power consumption of the wet cleaning apparatus may be minimised. This may enable the wet cleaning apparatus to made relatively compact, e.g. using a smaller battery, and/or have a relatively long runtime.

Alternatively or additionally, the underpressure generator may be configured to provide a flow rate through the porous material which is equal to or greater than 15 $cm^3$/minute.

This may contribute to the pick-up of liquid from the surface to be cleaned being sufficiently rapid. The 15 $cm^3$/minute lower limit may, in some embodiments, be set to equal or exceed a flow rate of a cleaning liquid from cleaning liquid outlet(s) also included in the cleaner head.

More generally, the underpressure generator may be configured such that the flow, when the flow is being provided, is in the range of 15 to 2000 $cm^3$/minute, preferably 40 to 2000 $cm^3$/minute, more preferably 80 to 750 $cm^3$/minute, and most preferably 100 to 300 $cm^3$/minute.

Such a flow, i.e. flow rate, may capitalise on the underpressure-maintaining capability of the porous material, and may ensure sufficient liquid pick-up whilst limiting energy consumption.

In some embodiments, the underpressure generator comprises a pump configured to, responsive to the pressure in the covered dirt inlet arrangement, control the flow for drawing fluid into the at least one dirt inlet through the porous material.

In such embodiments, it may be the underpressure generator/pump itself which, responsive to the pressure in the covered dirt inlet arrangement, controls the flow.

Such a pump can be regarded as a pressure-limited pump. A pressure limited pump is capable of generating a certain pressure difference over the tube to which it is connected. In principle, this pump pressure can be tuned to the pressure needed for the porous material covering the dirt inlet(s).

The pump, e.g. pressure-limited pump, can comprise or be, for example, a centrifugal pump.

Alternatively or additionally, the pump may comprise a liquid pump arranged in the cleaner head.

By arranging the liquid pump in the cleaner head, e.g. as opposed to, for example, in or on a handle coupled to the cleaner head, the height of the pump, and thus the (static) pressure, may not depend on the orientation of the handle with respect to the floor.

In alternative examples, the liquid pump may be arranged in the handle coupled to the cleaner head. This may facilitate manufacture of the wet cleaning apparatus since there may be more available space in the handle for the liquid pump than in the cleaner head.

In some embodiments, the wet cleaning apparatus comprises a dirty liquid collection tank for collecting liquid, with the underpressure generator arrangement being arranged such that said flow draws liquid from the at least one dirt inlet to the dirty liquid collection tank.

The above-described liquid pump may, for instance, be arranged between the dirt inlet(s) and such a dirty liquid collection tank.

Alternatively or additionally, the pump may comprise an air pump arranged downstream of the dirty liquid collection tank.

In at least some embodiments, the porous material comprises a porous material layer sealingly attached to the at least one dirt inlet. This may assist to maintain an underpressure in the dirt inlet(s) with or without the flow being applied by the underpressure generator included in the wet cleaning apparatus.

A liquid pick-up region of the porous material layer may, for example, be delimited by sealing attachment of the porous material layer around the, e.g. each of the, at least one dirt inlet.

The sealing attachment can be implemented in any suitable manner, such as by gluing or welding the porous material layer around each of the at least one dirt inlet, for example gluing and/or welding the porous material layer around one or more tubes whose opening(s) define the dirt inlet(s). In some non-limiting examples, an impermeable portion, such as a polymer film, is sealed onto a surface of the porous material layer, which surface is exposed to the dirt inlet(s), and around the dirt inlet(s).

In some embodiments, the porous material comprises one or more further porous material layers.

The inclusion of one or more further porous material layers, in addition to the porous material layer sealingly attached to the dirt inlet(s), may assist to increase the underpressure which can be maintained in the dirt inlet(s). This, in turn, can assist the above-described underpressure generator to be operated more efficiently.

Such further porous material layer(s) can, for instance, be arranged on an external surface of the porous material layer, such that an external surface of the further porous material layer which is furthest from the at least one dirt inlet in a thickness direction of the porous material contacts the surface to be cleaned.

In some embodiments, the porous material has a thickness of less than or equal to 10 mm, more preferably less than or equal to 5 mm, and most preferably less than or equal to 3 mm. Such a maximum thickness may contribute to minimising of flow resistance through the porous material.

In some embodiments, a fluid transport pressure at 200 $cm^3$/minute flow through the porous material is less than 0.25 multiplied by the bubble point pressure as determined by ASTM F316—03, 2019, Test A.

This may mean that the flow resistance through the porous material is maintained at a relatively low level.

In some embodiments, the porous material comprises one or more of a porous fabric, a porous plastic, and a foam.

Such a porous plastic may, for example, take the form of a sintered mesh of plastic granules.

In embodiments in which the porous material includes such a porous plastic, one or more further porous material layers, e.g. comprising a porous fabric, such as a woven porous fabric, may be arranged on an external surface of the porous plastic. Such further porous material layer(s) may be more wettable by water than the porous plastic and thus more appropriate for contacting the surface to be cleaned when wetted by water.

Particular mention is made of the porous material comprising a porous woven fabric, and most preferably a woven microfiber fabric. Such a woven microfiber fabric may facilitate attainment of the requisite underpressure in the wet cleaning apparatus.

Such a porous woven fabric, and in particular such a woven microfiber fabric, can be configured, in particular via the tightness of its weave, to satisfy the above ranges for the limiting diameter.

In some embodiments, the cleaner head comprises at least one cleaning liquid outlet through which cleaning liquid is deliverable.

The wet cleaning apparatus may comprise a cleaning liquid supply comprising a cleaning liquid reservoir for containing the cleaning liquid, the cleaning liquid reservoir being fluidly communicable or in fluid communication with the at least one cleaning liquid outlet.

Such a cleaning liquid supply may, for example, comprise a cleaning liquid reservoir and a delivery arrangement, e.g. a delivery arrangement comprising a pump, for transporting the cleaning liquid to and through the at least one cleaning liquid outlet.

The cleaning liquid supply and the at least one cleaning liquid outlet may, for example, be configured to provide a continuous delivery of the cleaning liquid towards the surface to be cleaned. Such continuous delivery may, for instance, be provided at the same time as underpressure generator is providing the flow.

In some embodiments, the cleaning liquid supply comprises a pump arranged to pump the cleaning liquid from the cleaning liquid reservoir to and through the at least one cleaning liquid outlet.

In some embodiments, the cleaning liquid supply and the underpressure generator are configured such that the flow of the cleaning liquid delivered through the at least one cleaning liquid outlet is lower than the flow provided to the at least one dirt inlet by the underpressure generator.

This may assist to ensure that the surface to be cleaned does not become excessively wet with the cleaning liquid. For example, the flow of cleaning liquid may be in the range of 20 to 60 $cm^3$/minute, and the flow provided by the underpressure generator may be in the range of 40 to 2000 $cm^3$/minute, more preferably 80 to 750 $cm^3$/minute, and most preferably 100 to 300 $cm^3$/minute.

In at least some embodiments, the wet cleaning apparatus is a wet mopping device.

In other examples, the wet cleaning apparatus may be or comprise, for example, a window cleaner, a sweeper, or a wet vacuum cleaner, such as canister-type, stick type, or upright type wet vacuum cleaner.

The wet cleaning apparatus may in some examples be or comprise a robotic wet vacuum cleaner or a robotic wet mopping device configured to autonomously move, e.g. in one cleaning direction, the cleaner head on the surface to be cleaned, such as the surface of a floor.

The wet cleaning apparatus may be a battery-powered wet cleaning apparatus in which the underpressure generator is powerable by a battery electrically connected to the underpressure generator.

The power consumption-reducing effect which can be provided by the porous material covering the dirt inlet(s) to which the suction of the underpressure generator is provided can make the wet cleaning apparatus particularly suitable for battery powered operation.

Embodiments described herein in relation to the cleaner head may be applicable to the wet cleaning apparatus, and embodiments described herein in relation to the wet cleaning apparatus may be applicable to the cleaner head.

BRIEF DESCRIPTION OF THE DRAWINGS

Examples of the invention will now be described in detail with reference to the accompanying drawings, in which.

DETAILED DESCRIPTION OF THE EMBODIMENTS

Figure 1:
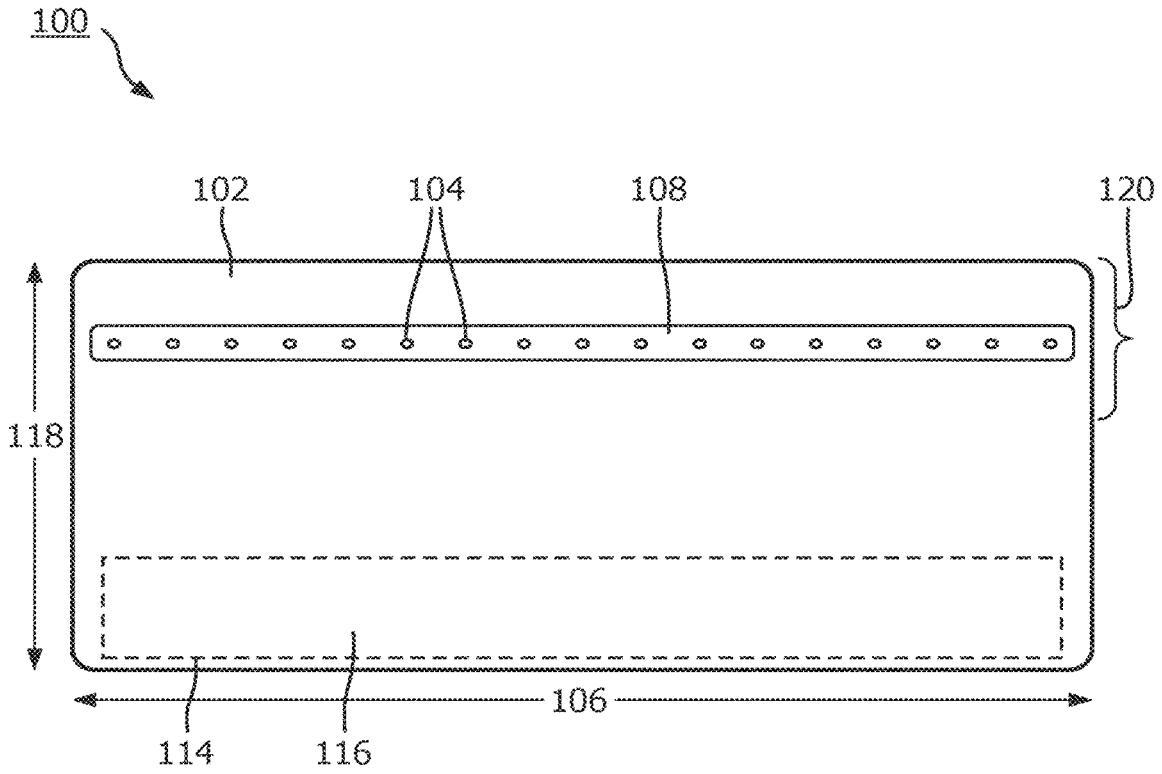
FIG. 1 schematically depicts the underside of a cleaner head according to an example.

The invention will be described with reference to the Figures.

It should be understood that the detailed description and specific examples, while indicating exemplary embodiments of the apparatus, systems and methods, are intended for purposes of illustration only and are not intended to limit the scope of the invention. These and other features, aspects, and advantages of the apparatus, systems and methods of the present invention will become better understood from the following description, appended claims, and accompanying drawings. It should be understood that the Figures are merely schematic and are not drawn to scale. It should also be understood that the same reference numerals are used throughout the Figures to indicate the same or similar parts.

Provided is a wet cleaning apparatus comprising a cleaner head and an underpressure generator arrangement. The cleaner head has at least one dirt inlet, and a porous material covering the at least one dirt inlet. The underpressure generator arrangement comprises an underpressure generator configured to provide a flow inside the wet cleaning apparatus for drawing fluid into the at least one dirt inlet through the porous material. The underpressure generator arrangement is configured to control the flow based on a pressure on the inside of the wet cleaning apparatus between the porous material and the underpressure generator.

FIG. 1 shows a cleaner head 100 according to a non-limiting example. In particular, an underside 102 of the cleaner head 100 is shown in FIG. 1. The underside 102 faces a surface to be cleaned (not visible in FIG. 1) using the cleaner head 100.

Evident from the view provided in FIG. 1 is at least one cleaning liquid outlet 104 included in the cleaner head 100. Cleaning liquid is deliverable through the, e.g. each of, the at least one cleaning liquid outlet 104. It is noted that the at least one cleaning liquid outlet need not to be provided on the underside 102 of the cleaner head 100, and may alternatively be provided elsewhere in the cleaner head 100 provided that the cleaning liquid can be delivered via the cleaning liquid outlet(s) to reach the surface to be cleaned.

The cleaning liquid can comprise, or consist of, water. Hence, the cleaning liquid can be an aqueous cleaning liquid. In some non-limiting examples, which will be discussed in more detail herein below, the cleaning liquid is an aqueous detergent solution.

In the non-limiting example shown in FIG. 1, the cleaning liquid outlets 104 are arranged in a row along a length 106 of the cleaner head 100. This may assist the cleaner head 100 to wet the surface to be cleaned with the cleaning liquid along the length 106 of the cleaner head 100. It should nonetheless be noted that any suitable configuration or pattern of cleaning liquid outlets 104 can be contemplated, provided that other parts of the cleaner head 100 can be accommodated.

In the particular example shown in FIG. 1, sixteen cleaning liquid outlets 104 are included in the cleaner head 100, noting that more cleaning liquid outlets 104 may assist to increase the uniformity of wetting of the surface to be cleaned. However, any suitable number of cleaning liquid outlets 104 may be provided in the cleaner head 100, for example one, two, three, four, five, six, seven, eight, nine, ten, eleven, twelve, thirteen, fourteen, fifteen, sixteen, seventeen, eighteen, nineteen, twenty, or more.

In some embodiments, such as that shown in FIG. 1, the cleaner head 100 comprises a cleaning liquid distribution strip 108. At least some, or in this example all, of the cleaning liquid outlets 104 may be included in the cleaning liquid distribution strip 108, as shown.

Figure 2:
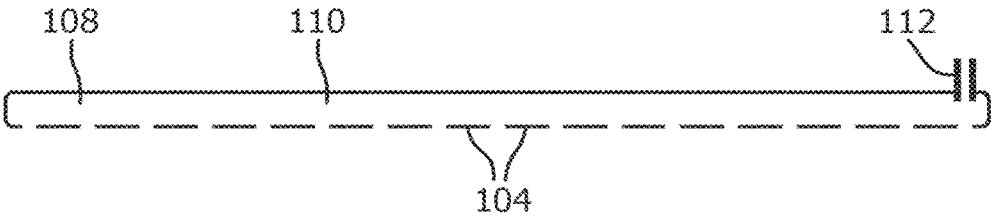
FIG. 2 provides a schematic cross-sectional view of a cleaning liquid distribution strip included in the cleaner head shown in FIG. 1.

FIG. 2 provides a cross-sectional view of the cleaning liquid distribution strip 108 included in the exemplary cleaner head 100 shown in FIG. 1. In this non-limiting example, the cleaning liquid distribution strip 108 comprises a channel 110 which can be supplied with the cleaning liquid, e.g. from a suitable cleaning liquid reservoir (not visible in FIG. 2) via an inlet 112.

The inlet 112 is provided at or proximal to an end of the cleaning liquid distribution strip 108 in the example shown in FIG. 2, however it is also conceivable that the inlet 112 is provided in a central position along the length of the cleaning liquid distribution strip 108. Alternatively or additionally, the cleaning liquid distribution strip 108 comprises a plurality of inlets 112, for example a pair of inlets 112 arranged at opposite ends of the cleaning liquid distribution strip 108.

The cleaning liquid may exit the cleaning liquid distribution strip 108 via apertures in the cleaning liquid distribution strip 108 which define the cleaning liquid outlets 104. Such apertures may be dimensioned such that passage of the cleaning liquid, e.g. aqueous cleaning liquid, through the apertures is restricted, due to the surface tension of the cleaning liquid, while the channel 110 is being filled, but with passage of the cleaning liquid through all of the apertures of the cleaning liquid distribution strip 108 at the same time being permitted once the channel 110 has been filled. This may enable relatively uniform wetting of the surface to be cleaned across the length 106 of the cleaner head 100.

To this end, each cleaning liquid outlet 104 may have, for example, a diameter less than 1 mm, for example a diameter in the range of 0.1 to 1 mm, preferably 0.1 to 0.8 mm, most preferably 0.1 to 0.5 mm, such as about 0.3 mm.

The cleaning liquid distribution strip 108 can be formed of any suitable material, such as a metal, a metal alloy, e.g. stainless steel, and/or a polymer. Forming the cleaning liquid distribution strip 108 from a polymer can make the cleaning liquid distribution strip 108 more lightweight and/or cheaper to manufacture.

Returning to FIG. 1, the cleaner head 100 also comprises a porous material including, or in some examples consisting of, a porous material layer 114. Whilst not visible in FIG. 1, the cleaner head 100 has at least one dirt inlet. Each of the dirt inlet(s) is covered by the porous material layer 114.

The porous material layer 114 may be arranged between the dirt inlet(s) and the surface to be cleaned such that dirty liquid on the surface to be cleaned is first transported into the pores of the porous material layer 114, and then passes from the porous material layer 114 into the dirt inlet(s).

The view provided in FIG. 1 shows an external surface 116 of the porous material layer 114, which external surface 116 faces the surface to be cleaned.

The porous material layer 114 is arranged at or proximal to the underside 102 of the cleaner head 100. More generally, the porous material, albeit not necessarily specifically the porous material layer 114 included in the porous material, can contact the surface to be cleaned and/or liquid on the surface to be cleaned.

In non-limiting examples in which the porous material comprises one or more further porous material layers (not visible in FIG. 1) arranged on the external surface 116 of the porous material layer 114, an external surface of the further porous material layer furthest from the at least one dirt inlet in a thickness direction of the porous material may contact the surface to be cleaned.

The porous material layer 114 covering each of the at least one dirt inlet may assist to maintain an underpressure in the dirt inlet(s) with or without constant flow being applied thereto, for instance by an underpressure generator, e.g. pump, fluidly connected to the dirt inlet(s).

The porous material layer 114 may, for example, comprise or consist of a porous fabric and/or a porous foam. The porous fabric may, for example, be a microfiber fabric.

Similarly, each of the above-mentioned one or more further porous material layers may comprise or consist of a porous fabric, such as a microfiber fabric, and/or a porous foam.

The term "microfiber fabric" as used herein may refer to a fabric formed of synthetic fibers, with the fabric being formed of threads whose titre is less than 1 decitex.

Such microfiber fabrics can comprise, for example, polyester fibers, polyamide fibers, and combinations of polyester and polyamide fibers.

The microfiber fabric may, for example, be a microfiber chamois.

In other examples, the porous fabric is a natural chamois, e.g. made from a chamois, deer, goat or sheep hide.

The surface tension of the liquid retained in the pores of the porous material layer 114 can assist to maintain the underpressure. This surface tension can be overcome at a point (or points) on the external surface 116 of the porous material layer 114 which come into contact with liquid, thereby causing the liquid to be transported through the porous material layer 114 in the direction of the dirt inlet(s).

The porous material, e.g. comprising a microfiber fabric, may be particularly susceptible to wear, and such wear can risk compromising the underpressure-maintaining/liquid pick-up performance of the porous material. Accordingly, the porous material can comprise a plurality of differently coloured layers which layers are progressively worn by use of the cleaner head 100 such that the colour of the porous material serves as a wear indicator.

In some embodiments, such as that shown in FIG. 1, the porous material and/or the porous material layer 114 included in the porous material is or are elongated such as to have a largest dimension extending parallel with the length 106 of the cleaner head 100.

In the non-limiting example depicted in FIG. 1, the porous material layer 114 is positioned at a different location along the width 118 of the cleaner head 100 with respect to the cleaning liquid outlets 104.

In some embodiments, such as that depicted in FIG. 1, the cleaner head 100 comprises a portion 120 for facing the surface to be cleaned. One or more of the cleaning liquid outlets 104 may be arranged to deliver the cleaning liquid to the portion 120 of the cleaner head 100.

Whilst not visible in the view provided by FIG. 1, a protruding element may be mounted adjacent the portion 120, with the protruding element protruding from the cleaner head 100 in the direction of the surface to be cleaned. The protruding element can be regarded as an element mounted separately in the cleaner head 100 with respect to the portion 120.

Due to the protruding nature of the protruding element, the protruding element may have limited contact with the surface to be cleaned. The protruding element may, for example, have a smaller area of contact with the surface to be cleaned than the portion 120.

In at least some embodiments, the protruding element comprises the porous material. Resistance to motion of the cleaner head 100 across the surface to be cleaned may therefore be lessened due to the limited area of contact between the porous material and the surface to be cleaned. This will be described in further detail herein below with reference to FIG. 31.

In some embodiments, the cleaner head 100 can be rocked on the protruding element in a first direction to cause the portion 120 to contact the surface to be cleaned, and rocked on the protruding element in a second direction opposite to the first direction to cause the portion 120 to be separated from the surface to be cleaned.

In such embodiments, the protruding element can be regarded as a rocker which permits the cleaner head 100 to be rocked onto the portion 120. In order to achieve this rocking function, the protruding element has limited contact with the surface to be cleaned.

Figure 3:
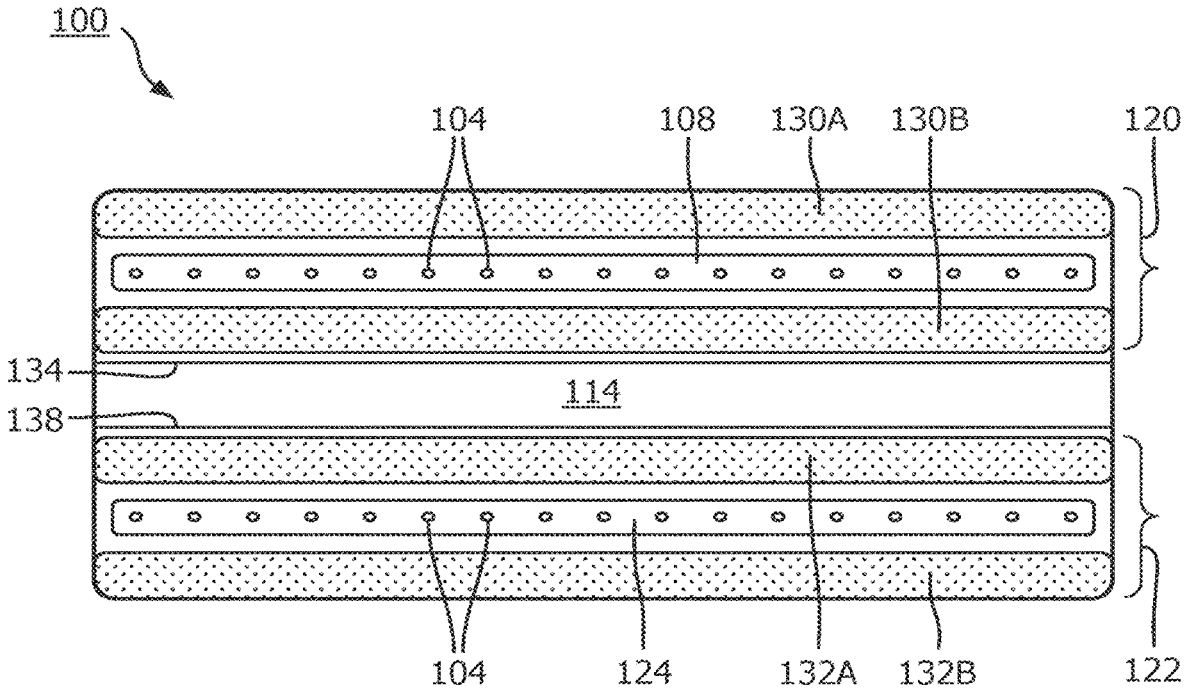
FIG. 3 schematically depicts the underside of a cleaner head according to a second example in which a cleaning liquid applicator material is detached from the cleaner head.

In some embodiments, such as in the non-limiting example shown in FIG. 3, the cleaner head 100 comprises the portion 120 and a further portion 122 for facing the surface to be cleaned. In such embodiments, the porous material layer 114 may be arranged between the portion 120 and the further portion 122.

Whilst not visible in the view provided in FIG. 3, when the cleaner head 100 comprises the above-described protruding element, the protruding element may be mounted between the portion 120 and the further portion 122. The protruding element may thus be an element mounted separately with respect to both the portion 120 and the further portion 122. In this way, the cleaner head 100 can be rocked forwards on the protruding element to cause the portion 120 to contact the surface to be cleaned, and backwards to cause the further portion 122 to contact the surface to be cleaned.

Irrespective of whether or not the cleaner head 100 comprises the protruding element, the cleaning liquid outlet(s) 104 may be arranged to deliver the cleaning liquid to the portion 120 and the further portion 122 of the cleaner head 100.

In the non-limiting example shown in FIG. 3, the cleaner head 100 comprises a cleaning liquid distribution strip 108 whose apertures define cleaning liquid outlets 104 which deliver the cleaning liquid to the portion 120, as described above in relation to FIGS. 1 and 2, and a further cleaning liquid distribution strip 124 whose further apertures define cleaning liquid outlets 104 which deliver the cleaning liquid to the further portion 122.

Both the cleaning liquid distribution strip 108 and the further cleaning liquid distribution strip 124 may extend parallel with the length 106 of the cleaner head 100, as shown in FIG. 3.

Figure 4:
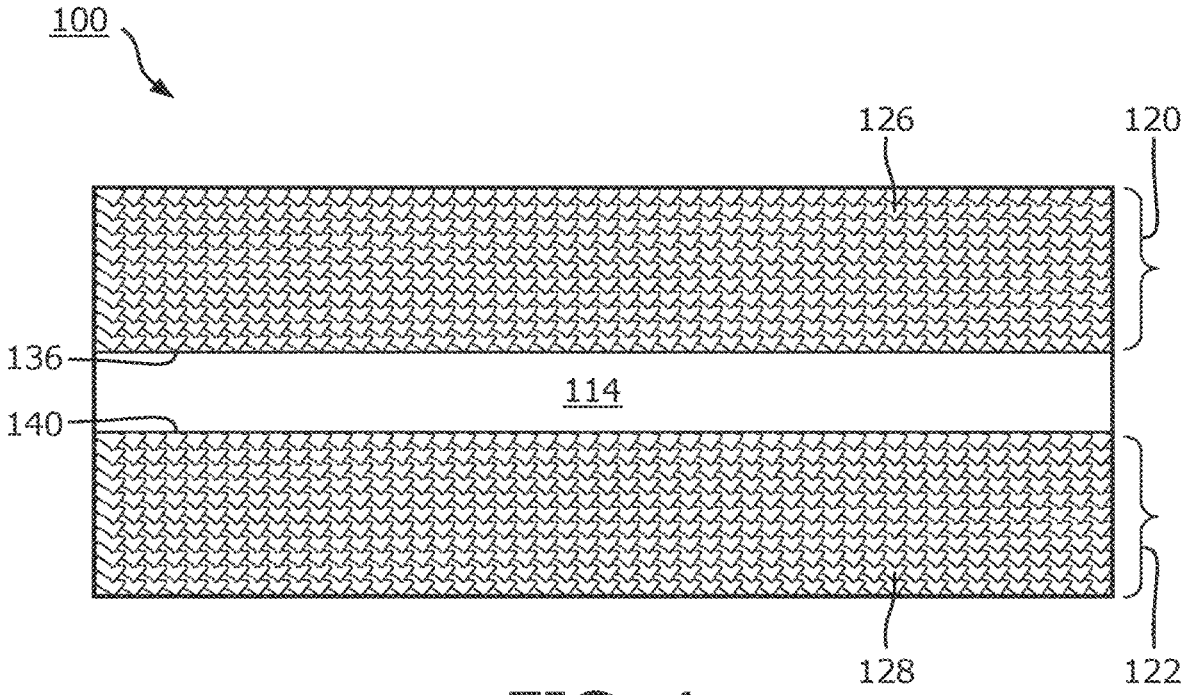
FIG. 4 schematically depicts the underside of the cleaner head shown in FIG. 3 with the cleaning liquid applicator fabric attached.

In some embodiments, such as that depicted in FIG. 4, the cleaner head 100 comprises a cleaning liquid applicator material 126, 128 adjacent each of the at least one cleaning liquid outlet 104, with the cleaning liquid applicator material 126, 128 being arranged to apply the cleaning liquid to the surface to be cleaned. In other words, the cleaning liquid applicator material 126, 128 may receive the cleaning liquid delivered from the cleaning liquid outlet(s) 104, and transfer the cleaning liquid to the surface to be cleaned.

The cleaning liquid applicator material 126, 128 can, for example, comprise polyamide and/or polyester fibers.

Alternatively or additionally, the cleaning liquid applicator material 126, 128 comprises a combination of thinner fibers and thicker fibers.

The thinner fibers can, for example, be less than or equal to 1 decitex, and the thicker fibers can have a thickness greater than 0.01 mm, for example the thickness of the thicker fibers can be about 0.05 mm.

The thicker fibers, which can be made from polyamide or polyester, may assist to reduce friction between the cleaning liquid applicator material 126, 128 and the surface to be cleaned, while the thinner fibers, e.g. made from polyamide or polyester, may assist to enhance dirt retention.

The thicker fibers may also provide resilience to the cleaning liquid applicator material 126, 128, thereby minimising compaction of the cleaning liquid applicator material 126, 128.

The compaction-reducing capability of the thicker fibers may be of particular utility in embodiments in which cleaning liquid applicator material 126, 128 is included in the portion 120 and/or the further portion 122 adjacent the protruding element rocker. This is because minimised compaction may assist to ensure that, over continued use of the cleaner head 100, a consistent degree of rocking on the protruding element causes the cleaning liquid applicator material 126, 128 to contact the surface to be cleaned.

The thickness of the cleaning liquid applicator material 126, 128 may alternatively or additionally be selected or limited, e.g. in view of the degree of protrusion of the protruding element relative to the portion 120 and/or the further portion 122, such as to minimise compaction of the cleaning liquid applicator material 126, 128 during use of the cleaner head 100.

In embodiments in which the cleaning liquid applicator material 126, 128 comprises the combination of thinner fibers and thicker fibers, these fibers can be arranged relative to each other in any suitable manner. For example, the cleaning liquid applicator material 126, 128 may comprise a strip of thicker fibers adjacent a strip of thinner fibers. Such strips may each extend along the length 106 of the cleaner head 100, such that the fiber thickness alternates in the width 118 direction. Such a configuration may assist to reduce friction when the cleaner head 100 is moved in directions parallel to the width 118 direction.

In embodiments in which the cleaning liquid applicator material 126, 128 comprises both polyamide and polyester fibers, these fibers can be arranged relative to each other in any suitable manner. For example, the cleaning liquid applicator material 126, 128 may comprise a strip of polyamide fibers adjacent a strip of polyester fibers. Such strips may each extend along the length 106 of the cleaner head 100, such that the fiber type alternates in the width 118 direction.

The cleaning liquid applicator material 126, 128 can, for instance, comprise a backing layer which supports the material, e.g. polyamide and/or polyester fiber-comprising material, which contacts the surface to be cleaned. The backing layer can be formed of any suitable backing fabric material, such as polyester.

Such a backing layer can be supplied with tufts, e.g. formed from polyamide and/or polyester fibers. Such tufts can assist the cleaning liquid applicator material 126, 128 to follow the contours of the surface to be cleaned and/or may assist the cleaning liquid applicator material 126, 128 to retain dirt particles whilst also minimising the risk of scratching the surface to be cleaned.

The cleaning liquid applicator material 126, 128 may, in some embodiments, be distinguished from the porous material (at least) by the backing layer, e.g. the above-described backing layer supporting the tufts, being included in the cleaning liquid applicator material 126, 128 but not being included in the porous material.

In some non-limiting examples, the fibers constituting the cleaning liquid applicator material 126, 128 are identical to the fibers constituting the porous material.

In alternative examples, one of the ways that the cleaning liquid applicator material 126, 128 can be distinguished from the porous material is the fineness, e.g. titre, of the threads and/or fibers of the respective materials, e.g. the surface to be cleaned-contacting threads and/or fibers of the respective materials. For example, the fibers of the porous material layer(s) constituting the porous material may be finer than the fibers of the cleaning liquid applicator material 126, 128. Alternatively or additionally, the threads the porous material layer(s) constituting the porous material may be finer than the threads of the cleaning liquid applicator material 126, 128.

The porous material may generally be more dense, e.g. due to the tighter weaving of the microfiber fabric, than the cleaning liquid applicator material 126, 128.

In some embodiments, the cleaning liquid applicator material 126, 128 comprises a plurality of differently coloured layers, which layers are progressively worn by use of the cleaner head 100 such that the colour of the cleaning liquid applicator material 126, 128 serves as a wear indicator.

In some embodiments, the cleaning liquid applicator material 126, 128 is detachable from each of the at least one cleaning liquid outlet 104. This may enable replacement of the cleaning liquid applicator material 126, 128, for example once the cleaning liquid applicator material 126, 128 has become overly worn, and/or enable the cleaning liquid applicator material 126, 128 to be washed between uses. Wear can, for instance, be indicated via the above-described coloured layers-comprising cleaning liquid applicator material 126, 128.

The cleaning liquid applicator material 126, 128 can be attached to the cleaner head 100, in particular to the underside 102 of the cleaner head 100 in the non-limiting examples shown in FIGS. 1 to 4, in any suitable manner.

Returning to FIG. 3, the depicted cleaner head 100 comprises at least one fastening member 130A, 130B, 132A, 132B, in this example in the form of Velcro strips, which engage with further fastening member(s) (not visible), on the cleaning liquid applicator material 126, 128. The further fastening member(s) can, for example, be included in, or affixed to, the above-described backing layer of the cleaning liquid applicator material 126, 128.

Alternative ways of attaching, e.g. detachably coupling, the cleaning liquid applicator material 126, 128 to the cleaner head 100, and in particular to the at least one cleaning liquid outlet 104, can be contemplated, such as using poppers, a button(s)-button hole(s) arrangement, a zip, and so on.

In some embodiments, such as that depicted in FIG. 4, the cleaning liquid applicator material 126, 128 comprises a first applicator portion 126 and a second applicator portion 128, with the porous material layer 114 being arranged between the first applicator portion 126 and the second applicator portion 128.

When the first applicator portion 126 is included in the cleaner head 100, the first applicator portion 126 may be included in the above-described portion 120 of the cleaner head 100.

In embodiments in which the cleaning liquid applicator material, e.g. the first applicator portion 126, is included in the portion 120, the portion may be suitable for both contacting the surface to be cleaned and assisting to clean the surface to be cleaned, e.g. by assisting in the application of cleaning liquid to the surface to be cleaned.

However, it is also conceivable that no cleaning liquid applicator material is included in the portion 120, e.g. should the cleaner head 100 be supplied without such a cleaning liquid applicator material. In such a scenario, the portion 120 may nonetheless be suitable for contacting the surface to be cleaned (in the sense that it is possible for the portion 120 to be brought into contact with the surface to be cleaned without the portion 120 being required to include the cleaning liquid applicator material), albeit with potentially less cleaning capability than the scenario in which the cleaning liquid applicator material, e.g. the first applicator portion 126, is included in the portion 120.

The first applicator portion 126 can include the above-described further fastening member(s) which engage(s) with the fastening member(s) 130A, 130B provided on the cleaner head 100 for incorporating the first applicator portion 126 in the portion 120.

Similarly, when the second applicator portion 128 is included in the cleaner head 100, the second applicator portion 128 may be included in the above-described further portion 122 of the cleaner head 100.

In such embodiments, the second applicator portion 128 can include the above-described further fastening member(s) which engage(s) with the fastening member(s) 132A, 132B provided on the cleaner head 100 for incorporating the second applicator portion 128 in the further portion 122.

In some embodiments, the at least one cleaning liquid outlet 104 comprises at least one pair of cleaning liquid outlets 104, with the porous material layer 114 being arranged between the cleaning liquid outlets 104 of each pair.

In embodiments in which the cleaning liquid applicator material 126, 128 comprises the first applicator portion 126 and the second applicator portion 128, the first applicator portion 126 may be adjacent one of the cleaning liquid outlets 104 of said pair, with the second applicator portion 128 being adjacent the other of the cleaning liquid outlets 104 of said pair. An example of this is shown in FIGS. 3 and 4.

In at least some embodiments, the porous material, albeit not necessarily specifically the porous material layer 114 included in the porous material, contacts the cleaning liquid applicator fabric 126, 128.

By the porous material contacting the cleaning liquid applicator material 126, 128, some of the cleaning liquid can be transferred from the cleaning liquid applicator material 126, 128 to the porous material and into the dirt inlet(s). This configuration may assist to prevent an excess of cleaning liquid building up in the cleaning liquid applicator material 126, 128, and thus may assist to minimise excessive wetting of the surface to be cleaned, for instance by dripping of the cleaning liquid from the cleaning liquid applicator material onto the surface to be cleaned. Alternatively or additionally, by the porous material contacting the cleaning liquid applicator material 126, 128, the cleaning liquid in the latter may be used to efficiently rinse the porous material covering the dirt inlet(s).

In a non-limiting example, the porous material layer 114 contacts the cleaning liquid applicator material 126, 128. In examples in which the porous material comprises one or more further porous material layers (not visible in FIGS. 3 and 4) arranged on the external surface 116 of the porous material layer 114, the porous material layer 114 and/or the further porous material layer(s) may contact the cleaning liquid applicator material 126, 128.

In spite of the porous material contacting the cleaning liquid applicator material 126, 128, both of these materials may also be arranged to contact the surface to be cleaned. This may be achieved in any suitable manner. In some embodiments, such as that shown in FIGS. 3 and 4, an edge portion 134 of the porous material abuts an opposing edge portion 136 of the cleaning liquid applicator material 126, 128. Thus, the cleaning liquid may first be transported into the cleaning liquid applicator material 126, 128, and only subsequently transported from the cleaning liquid applicator material 126, 128 into the porous material via the abutting edge portions 134, 136 of the respective materials. This may provide enhanced control over the wetness of the cleaning liquid applicator material 126, 128.

Alternatively or additionally, the cleaning liquid applicator material 126, 128 may be deformable to bring at least part of the cleaning liquid applicator material 126, 128 into contact with the porous material.

By the cleaning liquid applicator material 126, 128 being deformable to bring at least part of the cleaning liquid applicator material 126, 128 into contact with the porous material, some of the cleaning liquid can be transferred from the cleaning liquid applicator material 126, 128 to the porous material in a particularly controlled manner. In this way, excessive wetting of the surface to be cleaned, for instance by dripping of the cleaning liquid from the cleaning liquid applicator material 126, 128 onto the surface to be cleaned, may be minimised. Alternatively or additionally, by the cleaning liquid applicator material 126, 128 deforming such that at least part of the cleaning liquid applicator material 126, 128 contacts the porous material, the cleaning liquid in the latter may be used to efficiently rinse the porous material.

In at least some embodiments, the cleaning liquid applicator material 126, 128 is configured to deform upon contact with the surface to be cleaned and/or upon being wetted by liquid, e.g. water.

Such wetting can be as a result of the cleaning liquid delivered to the cleaning liquid applicator material 126, 128 from the cleaning liquid outlet(s) and/or due to liquid being present on the surface to be cleaned.

In a non-limiting example, the cleaning liquid applicator material 126, 128 comprises tufts formed from fibers, and a backing layer supporting the tufts. Such tufts may be deformable to contact the porous material, e.g. upon contact with the surface to be cleaned and/or upon being wetted by liquid, e.g. water.

While the tufts maintain contact with the porous material, the cleaning liquid can be transferred via the tufts from the cleaning liquid applicator material 126, 128 to the porous material.

In some embodiments, the cleaning liquid applicator material is deformable to bring the edge portion 136 of the cleaning liquid applicator material 126, 128 into contact with the porous material, e.g. into contact with the edge portion 134 of the porous material.

The edge portion 136 of the cleaning liquid applicator material 126, 128 may, for example, abut the (opposing) edge portion 134 of the porous material when the cleaning liquid applicator material 126, 128 is deformed to bring the edge portion 136 of the cleaning liquid applicator material 126, 128 into contact with the porous material.

In some embodiments, the edge portion 136 of the cleaning liquid applicator material 126, 128 is arranged to contact the surface to be cleaned at least when the cleaning liquid applicator material 126, 128 is deformed to bring the edge portion 136 of the cleaning liquid applicator material 126, 128 into contact with the porous material. Thus, the wetness of the cleaning liquid applicator material 126, 128 may be controlled where the cleaning liquid applicator material 126, 128 contacts the surface to be cleaned, thereby minimising the risk of excessive wetting of the surface to be cleaned.

In a non-limiting example, the cleaning liquid applicator material 126, 128 is deformable to bring at least part of the cleaning liquid applicator material 126, 128 into contact with the porous material layer 114 of the porous material. In examples in which the porous material comprises one or more further porous material layers, deformation of the cleaning liquid applicator material 126, 128 causes at least part, e.g. the edge portion 136, of the cleaning liquid applicator material 126, 128 to contact the porous material layer 114 and/or the further porous material layer(s).

In embodiments in which the cleaner head 100 comprises the above-described protruding element, the abutting opposing edge portions 134, 136 of the porous material and the cleaning liquid applicator material 126, 128 are preferably positioned between the protruding element and the portion 120. In this manner, excess cleaning liquid caused to be squeezed from the cleaning liquid applicator material 126, 128 between the protruding element and the cleaning liquid applicator material 126, 128, e.g. by rocking of the cleaner head 100 via the protruding element, may be efficiently transported into the dirt inlet(s) via the porous material.

It is noted that the contact between the porous material and the cleaning liquid applicator material 126, 128 may be provided at the surface to be cleaned-contacting side of the materials. This may assist to avoid that the cleaning liquid is passed directly into the porous material without properly wetting the cleaning liquid applicator material 126, 128 or rinsing the porous material.

In some embodiments, the cleaning liquid applicator material 126, 128 is deformable to bring the at least part of the cleaning liquid applicator material 126, 128 into contact with the porous material between the protruding element and the portion 120.

Thus, excess cleaning liquid caused to be squeezed from the cleaning liquid applicator material 126, 128 between the protruding element and the cleaning liquid applicator material, e.g. by rocking of the cleaner head 100 on the protruding element, may be efficiently transported into the dirt inlet(s) via the porous material.

In embodiments in which the cleaning liquid applicator material 126, 128 comprises the above-described first applicator portion 126 and second applicator portion 128, the opposing edge portion 136 of the cleaning liquid applicator material 126, 128 may be included in the first applicator portion 126, as shown in FIG. 4. Moreover, a further edge portion 138 of the porous material can abut a further opposing edge portion 140 of the second applicator portion 128. An example of this is depicted in FIGS. 3 and 4.

When the above-described protruding element is arranged between the portion 120 and the further portion 122, the abutting opposing edge portions 134, 136 of the porous material and the first applicator portion 126 are preferably positioned between the protruding element and the portion 120, and the abutting opposing further edge portions 138, 140 of the porous material and the second applicator portion 128 are preferably positioned between the protruding element and the further portion 122.

In this manner, excess cleaning liquid caused to be squeezed from the cleaning liquid applicator material 126, 128 between the protruding element and the first and second cleaning liquid applicator portions 126, 128, e.g. by rocking of the cleaner head 100 forwards and backwards respectively, may be efficiently transported into the dirt inlet(s) via the porous material.

The opposing edge portion 136 and/or the further opposing edge portion 140 (when present) of the cleaning liquid applicator material 126, 128 may, for example, be arranged to contact the surface to be cleaned. Thus, the wetness of the cleaning liquid applicator material 126, 128 may be controlled where the cleaning liquid applicator material 126, 128 contacts the surface to be cleaned, thereby minimising the risk of excessive wetting of the surface to be cleaned.

In some embodiments, the first applicator portion 126 is deformable to bring at least part of the first applicator portion 126 into contact with the porous material between the portion 120 and the protruding element, and/or the second applicator portion 128 may be deformable to bring at least part of the second applicator portion 128 into contact with the porous material between the further portion 122 and the protruding element.

Figure 5A:
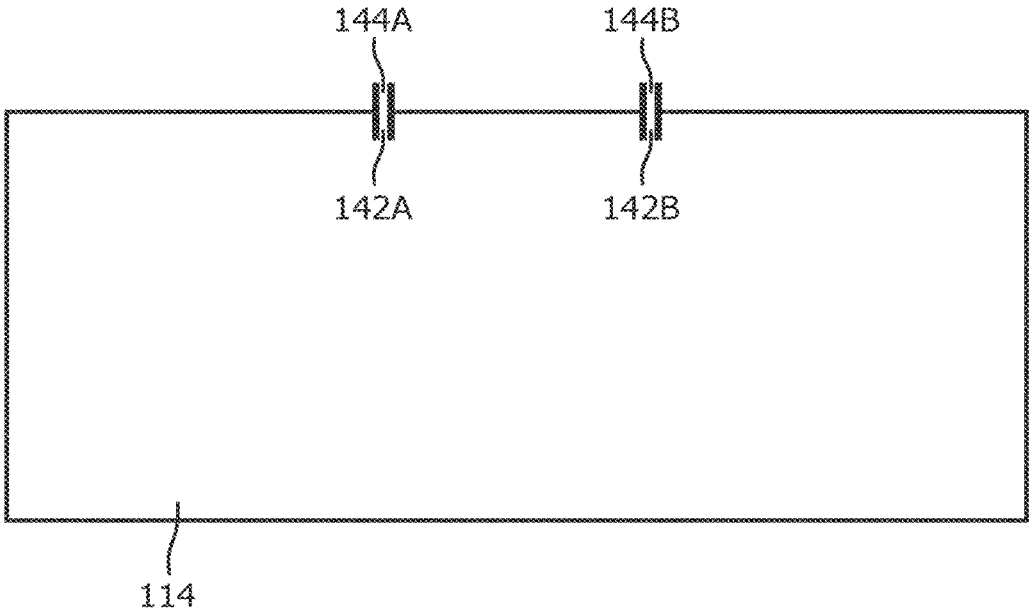
FIG. 5A schematically depicts a porous material layer and dirt inlets of an exemplary cleaner head.
Figure 5B:
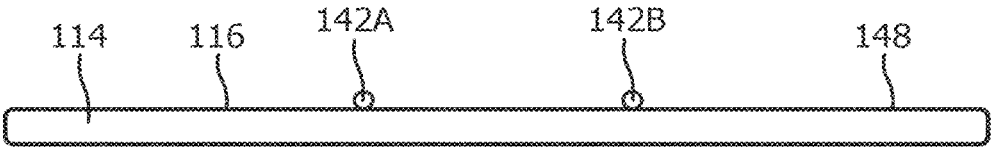
FIG. 5B provides a schematic cross-sectional view of the porous material layer and dirt inlets shown in FIG. 5A.

FIG. 5A provides a plan view showing the porous material layer 114 and the at least one dirt inlet 142A, 142B of an exemplary cleaner head 100. FIG. 5B provides a schematic cross-sectional view of the porous material layer 114 and the at least one dirt inlet 142A, 142B shown in FIG. 5A.

In some embodiments, such as that shown in FIGS. 5A and 5B, each of the at least one dirt inlet 142A, 142B is defined by an opening of a tube or tubes 144A, 144B fluidly connected or connectable to an underpressure generator (not visible in FIGS. 5A and 5B).

In the non-limiting example shown in FIGS. 5A and 5B, the cleaner head 100 comprises a pair of dirt inlets 142A, 142B, although any suitable number of dirt inlets 142A, 142B can be contemplated, such as one, two, three, four, five, six, or more.

When a plurality of dirt inlets 142A, 142B are included in the cleaner head 100, these may, for instance, have the same dimensions as each other.

Alternatively or additionally, when a plurality, e.g. a pair, of dirt inlets 142A, 142B is employed, the dirt inlets 142A, 142B may be spaced along the length 106 direction of the cleaner head 100 such as to provide relatively uniform suction along the length 106 of the cleaner head 100. For example, the distance along the length 106 between a centre position of the cleaner head 100 and a centre of the dirt inlet 142A may be the same, or substantially the same, as the distance along the length 106 between the centre position and a centre of the dirt inlet 142B.

Should a single dirt inlet be employed, this may be provided in the central position of the cleaner head 100 to provide a relatively symmetrical suction profile along the length 106 of the cleaner head 100.

More generally, a liquid pick-up region PR of the porous material layer 114 is delimited by sealing attachment of the porous material layer 114 around the, e.g. each of the, at least one dirt inlet 142A, 142B.

Such sealing attachment can assist to maintain an underpressure in the covered dirt inlet(s) 142A, 142B because loss of the underpressure via leakage between the dirt inlet(s) 142A, 142B and the porous material layer 114 is minimised or prevented.

The sealing attachment can be implemented in any suitable manner, such as by gluing or welding the porous material layer 114 around each of the at least one dirt inlet 142A, 142B, for example gluing and/or welding the porous material layer 114 to the above-mentioned tube(s) 144A, 144B around the opening(s) defining the dirt inlet(s) 142A, 142B.

Particular mention is made of sealingly attaching the porous material layer 114 to the dirt inlet(s) 142A, 142B by heat sealing, for example ultrasonic welding. This has been found to provide a particularly airtight seal in a straightforward manner which assists to maintain the underpressure in the dirt inlet(s) 142A, 142B.

Figure 6A:
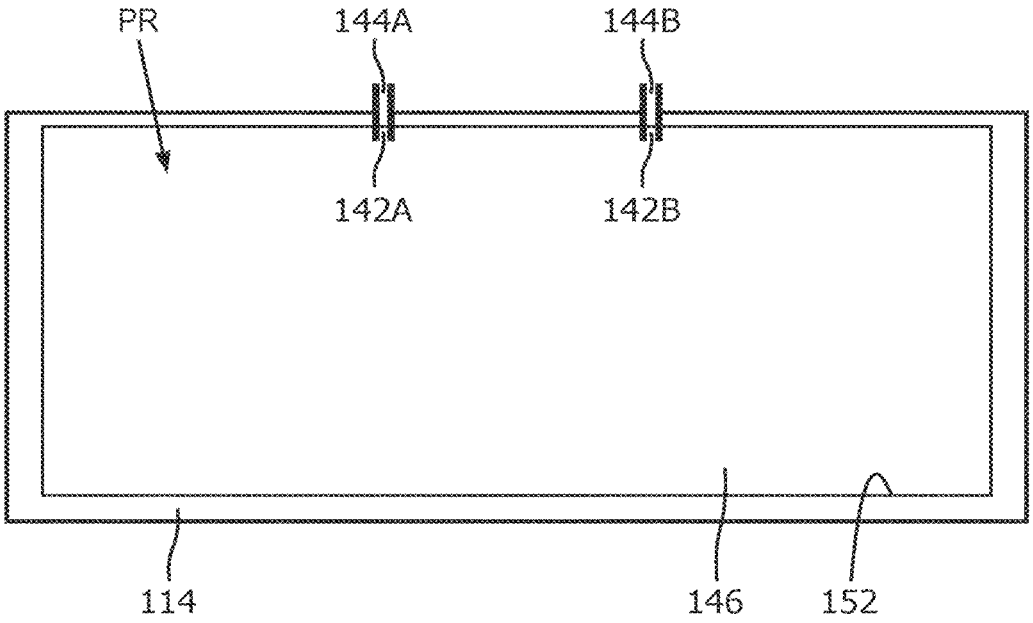
FIG. 6A schematically depicts an example of sealing attachment of the porous material layer around the dirt inlets.
Figure 6B:
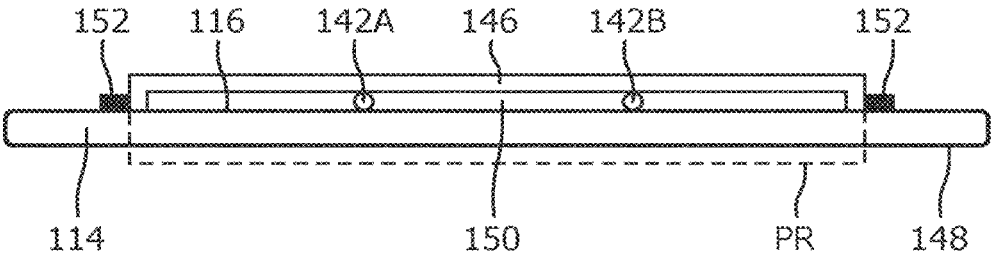
FIG. 6B provides a schematic cross-sectional view of the exemplary sealing attachment shown in FIG. 6A.

Referring to FIGS. 5B, 6A and 6B, a non-limiting example of the sealing attachment of the porous material layer 114 to the dirt inlets 142A, 142B is implemented by the cleaner head 100 comprising an impermeable portion 146 sealed onto the porous material layer 114, for example onto an internal surface 148 of the porous material layer 114, and around the dirt inlets 142A, 142B, with the dirt inlets 142A, 142B being thereby exposed to a sealed cavity 150 between the porous material layer 114 and the impermeable portion 146.

The impermeable portion 146 may, for instance, comprise, or consist of, a polymer film, such as a thermoplastic film. Various alternative sealing arrangements, some of which do not include such a polymer film, are described herein below.

In the non-limiting example shown in FIGS. 6A and 6B, a seal 152, e.g. formed via adhesive and/or welding of the impermeable portion 146, e.g. polymer film, extends around the periphery of the porous material layer 114 and around the dirt inlets 142A, 142B.

Figure 7A:
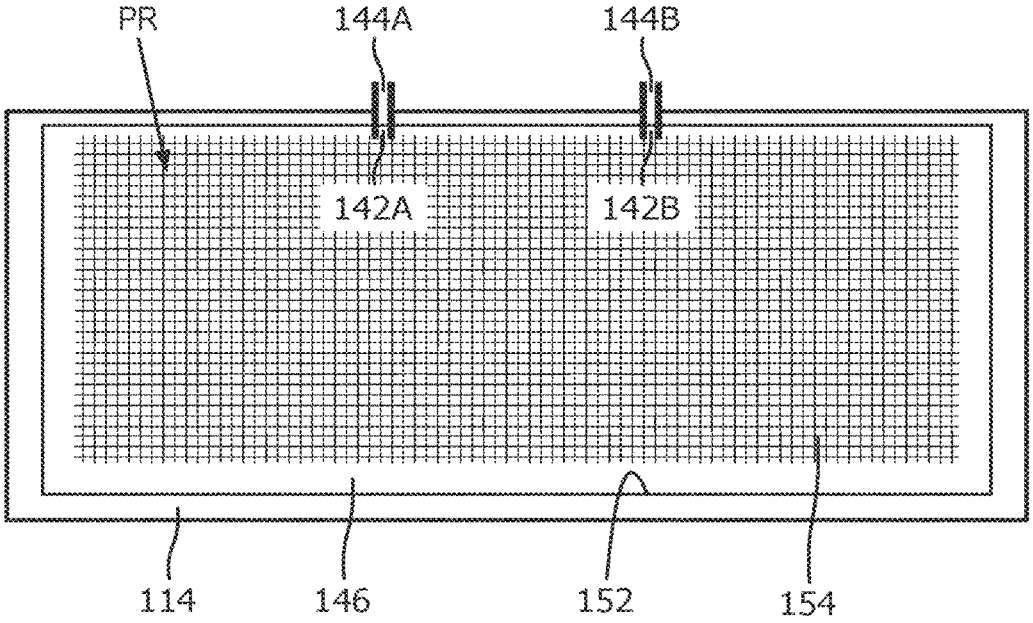
FIG. 7A schematically depicts a variation of the sealing attachment shown in FIGS. 6A and 6B.
Figure 7B:
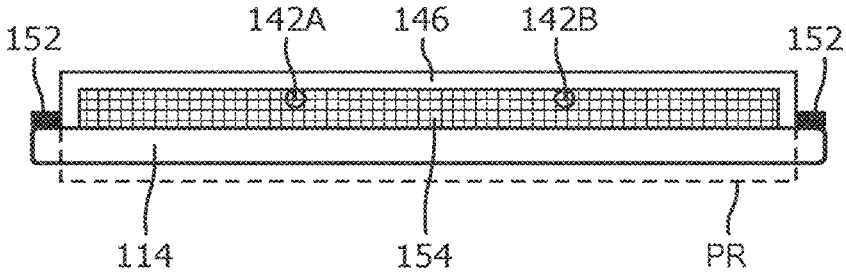
FIG. 7B provides a schematic cross-sectional view of the exemplary sealing attachment shown in FIG. 7A.

In at least some embodiments, such as that shown in FIGS. 7A and 7B, the liquid pick-up region PR is arranged relative to the at least one cleaning liquid outlet 104 such as to allow the cleaning liquid to bypass, e.g. pass around a periphery of, the liquid pick-up region PR to reach, or at least be directed towards, the surface to be cleaned.

This may enable the cleaning liquid to be used more efficiently. This is because the cleaning liquid has a greater chance of reaching the surface to be cleaned, e.g. via the above-described cleaning liquid applicator material 126, 128 (when included in the cleaner head 100).

In other examples, the porous material can be attached, e.g. against the cleaner head 100 or a component of the cleaner head 100, around the dirt inlet(s) 142A, 142B at least partly by being sucked thereagainst by the flow provided by an underpressure generator.

In some embodiments, the cleaner head 100 comprises a liquid transporting support structure 154 in the cavity 150, with the liquid transporting support structure 154 being arranged to provide one or more flow paths in the liquid pick-up region PR between the porous material layer 114, and in particular pores of the porous material layer 114, and the at least one dirt inlet 142A, 142B.

The porous material layer 114, e.g. a microfiber fabric, and/or the impermeable portion 146, e.g. a polymer film, may be pliable such that an underpressure may cause the porous material layer 114 and the impermeable portion 146 to be drawn towards each other. This may risk restriction of passage of liquid from the porous material layer 114 to the at least one dirt inlet 142A, 142B. The liquid transporting support structure 154 may assist to ensure that, in spite of such drawing of the porous material layer 114 and the impermeable portion 146 towards each other, liquid can still be transported from the porous material layer 114, and in particular pores of the porous material layer 114, to the at least one dirt inlet 142A, 142B.

The liquid transporting support structure 154 may be implemented in any suitable manner. In the non-limiting example shown in FIGS. 7A and 7B, the liquid transporting support structure 154 comprises, or is defined by, one or more mesh layers. In such an example, the above-described one or more flow paths can be provided by the spaces between the elements constituting the mesh layer(s). Alternative examples of the liquid transporting support structure 154 will be described herein below.

Figure 8:
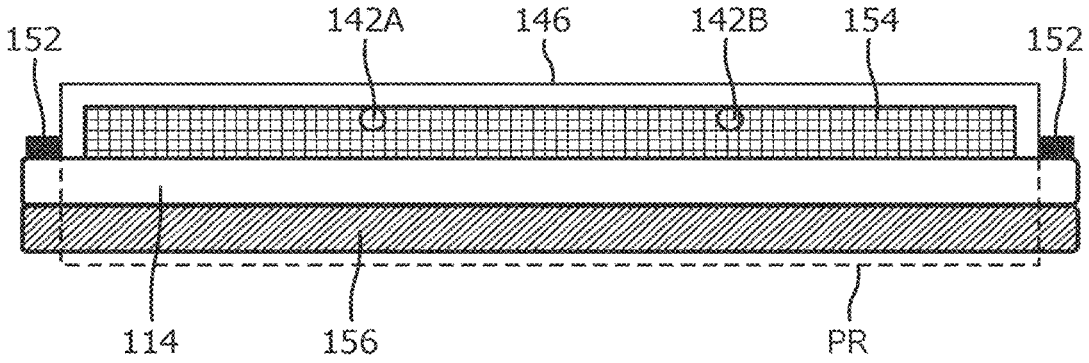
FIG. 8 provides a schematic cross-sectional view of a variation of the sealing attachment shown in FIGS. 7A and 7B.
Figure 9:
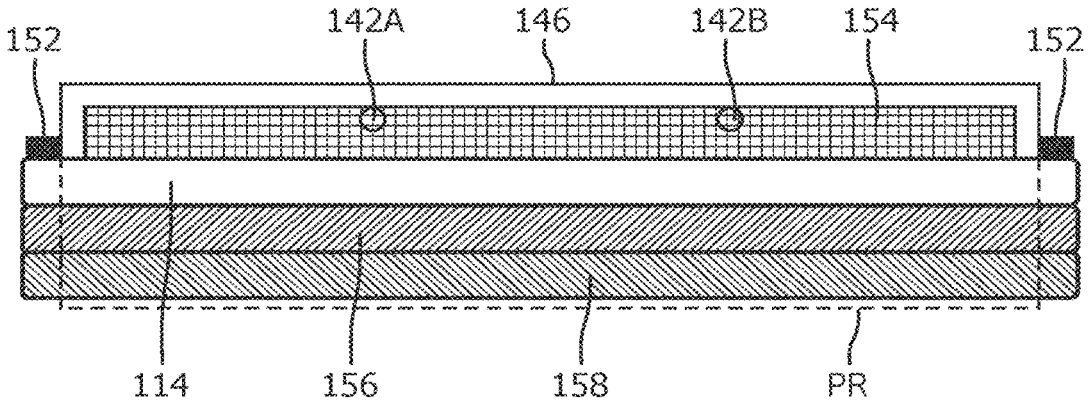
FIG. 9 provides a schematic cross-sectional view of a variation of the sealing attachment shown in FIG. 8.

As described above, the porous material can, in some embodiments, comprise one or more further porous material layers 156, 158 in addition to the porous material layer 114. Examples of this are depicted in FIGS. 8 and 9.

At this point, it is noted that when the porous material is dry, the porous material may be regarded as being in an "air transport state" in which air is transported through each of the dry pores of the porous material. A "liquid transport state" corresponds to liquid, e.g. water, being transported through the (wetted) pores of the porous material. When there is no longer a feed of liquid to the pore(s), a "fluid block state" may be adopted. The "fluid block state" corresponds to the state at which the surface tension of the (residual) liquid retained in the wetted pore(s) of the porous material prevents fluid transport through the pore(s). In the latter state, a surface or barrier is created at the boundary between air and liquid, e.g. water. This barrier can assist to maintain the above-described underpressure in the dirt inlet(s) 142A, 142B. The pressure needed to "break" this barrier can be termed a "breaking pressure".

It is noted that a woven porous fabric with a finer weave may have smaller pores, e.g. micropores, creating a higher breaking pressure. However, there may be a limit to how small pores can be made with weaving techniques. At the same time, it is possible that certain fibers, e.g. fibers selected due to their favourable cleaning and/or wear performance, can only be woven so as to provide a more open structure which is unsuitable for maintaining sufficient underpressure in the dirt inlet(s) 142A, 142B.

The "breaking pressure" can nonetheless be tuned in various ways. In the non-limiting example shown in FIG. 8, the porous material comprises, or is defined by, the porous material layer 114 and a first further porous material layer 156.

For instance, the porous material layer 114 is a microfiber fabric and the first further porous material layer 156 is a microfiber fabric.

By the porous material comprising a stack of porous material layers 114, 156 in this manner, the breaking pressure may be increased, e.g. relative to the scenario in which the porous material consists only of the porous material layer 114.

Without wishing to be bound by any particular theory, this effect is thought to stem from variation, e.g. statistical variation, of pore size and shape. For example, a microfiber fabric can be made from many fibers and yarns, which are woven together into a sheet of fabric. Pores, e.g. micropores, may thus be created between the fibers and yarns, so the pore sizes present in the fabric are not fixed to exactly one size and shape, but vary statistically.

A single porous material layer 114 may comprise a minority of relatively large pores for which the surface tension of the residual liquid is smaller, such that these relatively large pores contribute to a lower breaking pressure of the single porous material layer 114. By stacking a further porous material layer 156 on the porous material layer 114, the probability of the above-described minority of relatively large pores of the porous material layer 114 aligning/communicating with relatively large pores included in the further porous material layer 156 may be relatively small. Accordingly, stacking of the porous material layers 114, 156 may assist to increase the breaking pressure of the porous material.

Whilst the porous material is formed from the porous material layer 114 and the first further porous material layer 156 in the non-limiting example shown in FIG. 8, more than one further porous material layer 156 can be included in the porous material, e.g. to further increase the breaking pressure. In the non-limiting example shown in FIG. 9, the porous material comprises, or is defined by, the porous material layer 114, the first further porous material layer 156, and a second further porous material layer 158.

For instance, the porous material layer 114 is a microfiber fabric, the first further porous material layer 156 is a microfiber fabric, and the second further porous material layer 158 is a microfiber fabric.

The porous material layers 114, 156, 158 of the porous material may or may not be adhered to each other. In non-limiting examples in which the porous material layers 114, 156, 158 are adhered to each other, for example via a suitable adhesive being applied between the porous material layers, this may assist to further increase the breaking pressure of the porous material.

Figure 10:
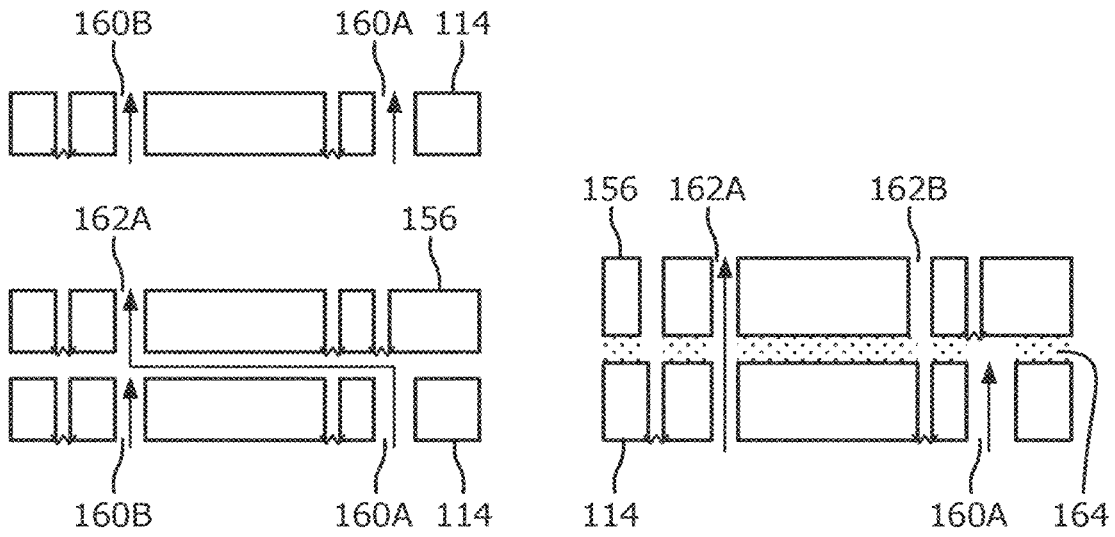
FIG. 10 provides schematic depictions of fluid transport through three exemplary porous materials.

Without wishing to be bound by any particular theory, this is thought to be due to the adhesive hindering horizontal fluid transport between the adhered porous material layers. Turning to FIG. 10, fluid transport through pores 160A, 160B of the porous material layer 114 is schematically depicted in the upper left pane, while horizontal fluid transport between the non-adhered porous material layer 114 and a pore 162A of the first further porous material layer 156 is schematically depicted in the lower left pane. Comparing the latter with the right pane of FIG. 10, it is evident that the adhesive 164 between the porous material layer 114 and the first further porous material layer 156 restricts or prevents horizontal fluid transport between the pores 160A of the porous material layer and the pores 162A, 162B of the first further porous material layer 156.

Any suitable adhesive 164 can be used for adhering the porous material layers 114, 156, 158 to each other, such as a heat-activated fabric glue. A commercially available example of a heat-activated fabric glue is Vliesofix®.

An advantage of the porous material layers 114, 156, 158 of the porous material not being adhered to each other may be that the resistance to liquid transport through the porous material may be lessened, e.g. due to horizontal transport of the liquid between the porous material layers 114, 156, 158 being permitted, or at least less restricted in comparison to the scenario in which adhesive 164 is present between the porous material layers 114, 156, 158.

As an alternative or in addition to the porous material comprising one or more further porous material layers 156, 158 in addition to the porous material layer 114, the porous material layer 114, e.g. microfiber fabric, may be subjected to a densification treatment, e.g. by ultrasonic welding. This may assist to increase the breaking pressure of the porous material layer 114.

In an exemplary densification process, the porous material layer 114, e.g. porous fabric, such as a microfiber fabric, is placed, e.g. compressed, in between two elements (e.g. rollers), emitting a relatively high frequency (e.g. around 40 kHz) vibration into the porous material layer 114.

This vibration may cause the fibers of the porous fabric, e.g. microfiber fabric, to move and rub against each other, creating heat, which may result in the individual fibers becoming welded together. Such welding may be controlled such as to afford a denser porous structure, rather than a compacted solid block. Since this process may take place while the porous fabric is in a compressed state, the fabric's density may increase, thereby increasing the breaking pressure.

Such a densification process may alternatively or additionally be used to densify the one or more further porous material layer(s) 156, 158 when such further porous material layer(s) 156, 158 is or are included in the porous material.

Figure 11:
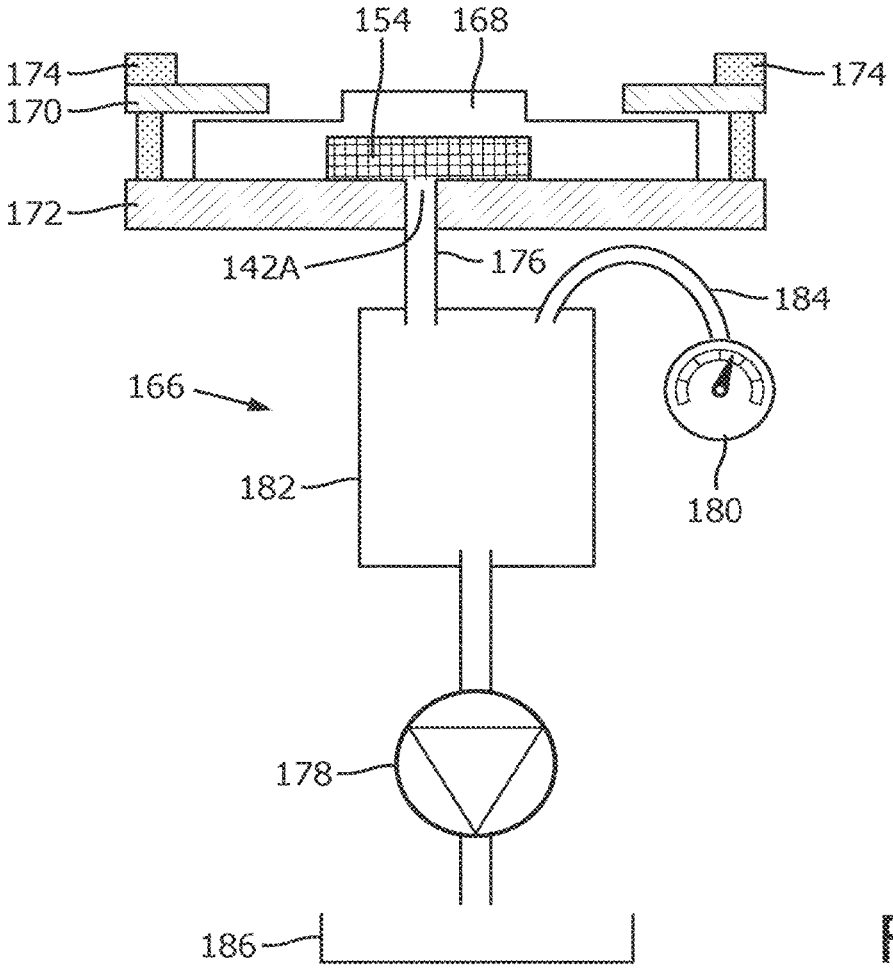
FIG. 11 schematically depicts a test arrangement for testing the behaviour of the porous material when liquid and suction are applied thereto.

FIG. 11 schematically depicts an exemplary test arrangement 166 for testing the breaking pressure characteristics of the porous material 168. The porous material 168 is clamped between a clamping member 170 and base plate 172. The clamping member 170 delimits holes for bolts 174, which bolts 174 are received in threaded holes in the base plate 172. Turning of the bolts 174 in the appropriate direction enables clamping/releasing of the porous material 168.

In this specific example, the clamping member 170 is an aluminium ring having a thickness of 10 mm, and the base plate 172 is made of poly (methyl methacrylate) having a thickness of 10 mm. The sample of the porous material is a circular disk having a diameter of 140 mm. The sample is secured using eight bolts 174.

The dirt inlet 142A in this test arrangement 166 is defined by an opening of a transport duct 176 provided in the base plate 172. In the cavity between the porous material 168 and the dirt inlet 142A, the above-described liquid transporting support structure 154 is provided, in this case in the form of a mesh with a diameter of 80 mm.

The test arrangement 166 comprises an underpressure generator 178 for generating an underpressure in the dirt inlet 142A, and a pressure sensor 180, e.g. a pressure gauge, arranged to measure the pressure in the dirt inlet 142A.

The pressure sensor 180 in this specific example comprises a pressure gauge in combination with a data acquisition unit (LabQuest® 2) to enable monitoring of the pressure as a function of time.

The underpressure generator 178 in this specific example is in the form of a peristaltic pump or a syringe pump, e.g. a 250 ml syringe pump. The peristaltic pump can provide a pulsed water flow. The syringe pump was found to permit more precise measurements than the peristaltic pump.

The test arrangement 166 also comprises a pressure line filter 182 in the form of a chamber arranged to prevent liquid from entering the pressure sensor line 184 connecting the pressure line filter 182 with the pressure sensor 180. Downstream of the pressure line filter 182 and the pump 178 is a collection reservoir 186 for collecting the liquid pumped through the porous material 168.

The testing procedure comprises clamping the sample of the porous material 168 between the clamping member 170 and the base plate 172, and then setting the pump 178 to deliver a flow rate of 100 $cm^3$/minute. The pressure line filter 182 is checked to ensure that it is empty, the pressure gauge of the pressure sensor 180 is zeroed and reconnected before each measurement. 25 $cm^3$ of water is then poured onto the sample of the porous material 168, leaving a layer of water on the porous material having a depth of approximately 4 mm. A flushing run is then implemented by starting the pump 178 such that the water is pulled through the sample of the porous material 168. Following the flushing run, the pump 178 is stopped and 25 $cm^3$ of water is poured onto the sample of the porous material 168, and a measurement run is implemented by triggering the data acquisition unit to start the data acquisition and starting the pump 178.

Figure 12:
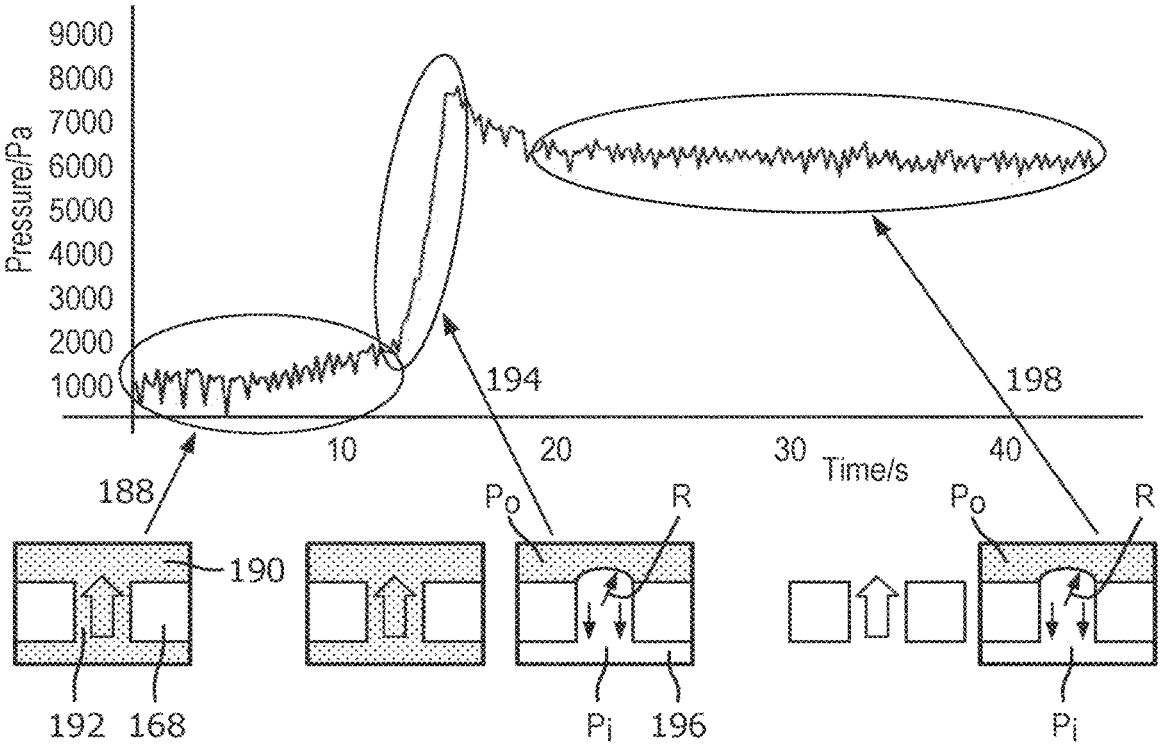
FIG. 12 provides a graph of underpressure vs time from data acquired using the test arrangement shown in FIG. 11.

A typical graph of underpressure vs time from the data acquisition is provided in FIG. 12, together with schematic diagrams of the porous material 168. Initially, the above-described "liquid transport state" 188 is adopted in which the liquid 190, in this example water, is transported through the (pre-wetted) pore 192. The recorded "transport pressure" in this case corresponds to the pressure difference required to transport the liquid 190 through the porous material 168 and the mesh liquid transporting support structure 154.

The governing equation describing the "liquid transport state" 188 may be the following Poiseuille equation:

$$\Delta P = \frac{8\eta L\phi}{\pi r^4}$$

where $\Delta P$ is the pressure difference across the pore 192; $\eta$ is the dynamic viscosity of the liquid; L is the length of the pore 192; $\phi$ is the volumetric flow rate; and r is the radius of the pore 192.

Assuming, for instance, a pore diameter of 20 μm, with the pore extending across a porous material 168 having a thickness of 0.8 mm, with an estimated volumetric flow rate of about $4.96*10^{-14}$ $m^3$/s per pore 192 (from a typical fluid flow of 100 $cm^3$/minute), and with $\eta_{water}$ being $1*10^{-3}$ Pa·s, $\Delta P$=10.1 Pa.

Subsequently to the "liquid transport state" 188, an intermediate regime 194 is adopted in which almost all of the liquid 190 has been removed from the surface of the sample of the porous material 168, such that most of the pores are in the above-described "fluid block state" in which the surface tension of the (residual) liquid 190 retained in the wetted pore(s) of the porous material 168 prevents air 196 from being transported through the pore 192. An ever decreasing number of pores 192 may be in the "liquid transport state" in the intermediate regime 194. The "fluid block state" allows a significantly higher underpressure, so during the intermediate regime 194 the underpressure increases relatively rapidly, as shown.

The governing equation describing the "fluid block state" may be the following Droplet dP equation:

$$P_i - P_O = \frac{2T}{R}$$

where $P_i$ and $P_O$ are the inside and outside pressures, and R is the fluid drop radius, as schematically depicted in FIG. 12. T is the surface tension.

Assuming, for instance, that R is 10 μm for a typical 20 μm diameter pore 192, and $T_{water}$ is 0.073 N/m, $P_i - P_O = \Delta P = 14600$ Pa.

This ΔP may be increased to 18000 Pa when detergent is added to the water. Whilst water surface tension decreases when detergent is added ($T_{soapy\ water}$ is 0.045 N/m.), two surfaces in the bubble over the pore 192 are now be created: the inside and the outside of the bubble. Thus, the breaking pressure in the case of detergent being added to the water may be approximately double that of a single-layer surface:

$$P_i - P_O = \frac{4T}{R}$$

Following the intermediate regime 194, an end regime 198 is adopted in which all free water has been removed from the surface of the porous material 168, and all the pores 192 are initially in the "fluid block state". Since the pump 178 continues drawing water through the porous material 168, hence increasing the underpressure, this may cause some of the fluid blocks to break such that air 196 is transported through the respective pores 192 in an "air transport state". The associated ingress of air may come to an equilibrium in the end regime 198 in which the applied flow results in an underpressure which causes no more fluid blocks to break. The latter corresponds to the "breaking pressure" of the porous material 168 being investigated.

The governing equation describing the "air transport state" may be the Poiseuille equation provided above for the "liquid transport state". Assuming, for instance, a pore diameter of 20 μm, with the pore extending across a porous material 168 having a thickness of 0.8 mm, with an estimated volumetric flow rate of about $4.96*10^{-14}$ $m^3/s$ per pore 192 (from a typical fluid flow of 100 $cm^3$/minute), and with $\eta_{air}$ being $18.1*10^{-6}$ Pa·s, ΔP=0.18 Pa.

Overall, the air transport pressure (e.g. 0.18 Pa) and the water transport pressure (e.g. 10.1 Pa) may both be significantly smaller, e.g. negligible, in comparison to the surface tension-derived pressure difference (e.g. 14600 Pa).

Figure 13:
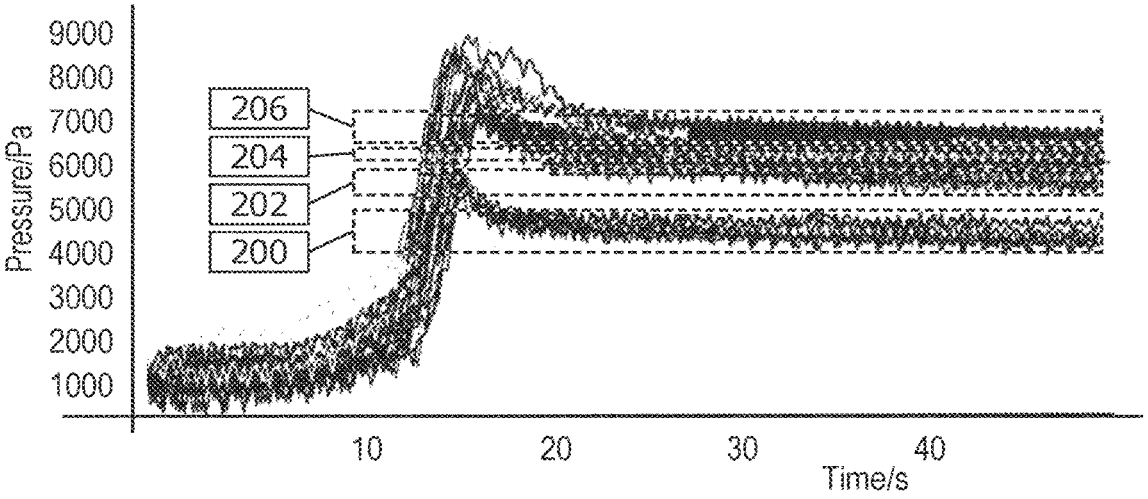
FIG. 13 provides several pressure vs time graphs for porous materials comprising different numbers of porous material layers.

FIG. 13 provides several pressure vs time graphs for porous materials 168 tested using the above-described test arrangement 166 and test procedure. Plots 200 are for a porous material 168 having only the porous material layer 114; plots 202 are for a porous material 168 having the porous material layer 114 and the first further porous material layer 156; plots 204 are for a porous material 168 having the porous material layer 114, the first further porous material layer 156, and the second further porous material layer 158; and plots 206 are for a porous material 168 having the porous material layer 114 and three further porous material layers. These data indicate that including more stacked porous material layers in the porous material 168 increases the breaking pressure, as previously described.

Moreover, within each of the sets of plots 202, 204 and 206, are plots for porous materials 168 in which the porous material layers are and are not adhered to each other. It was observed that use of an adhesive to adhere the porous material layers to each other further increased the breaking pressure, as described above.

Figure 14:
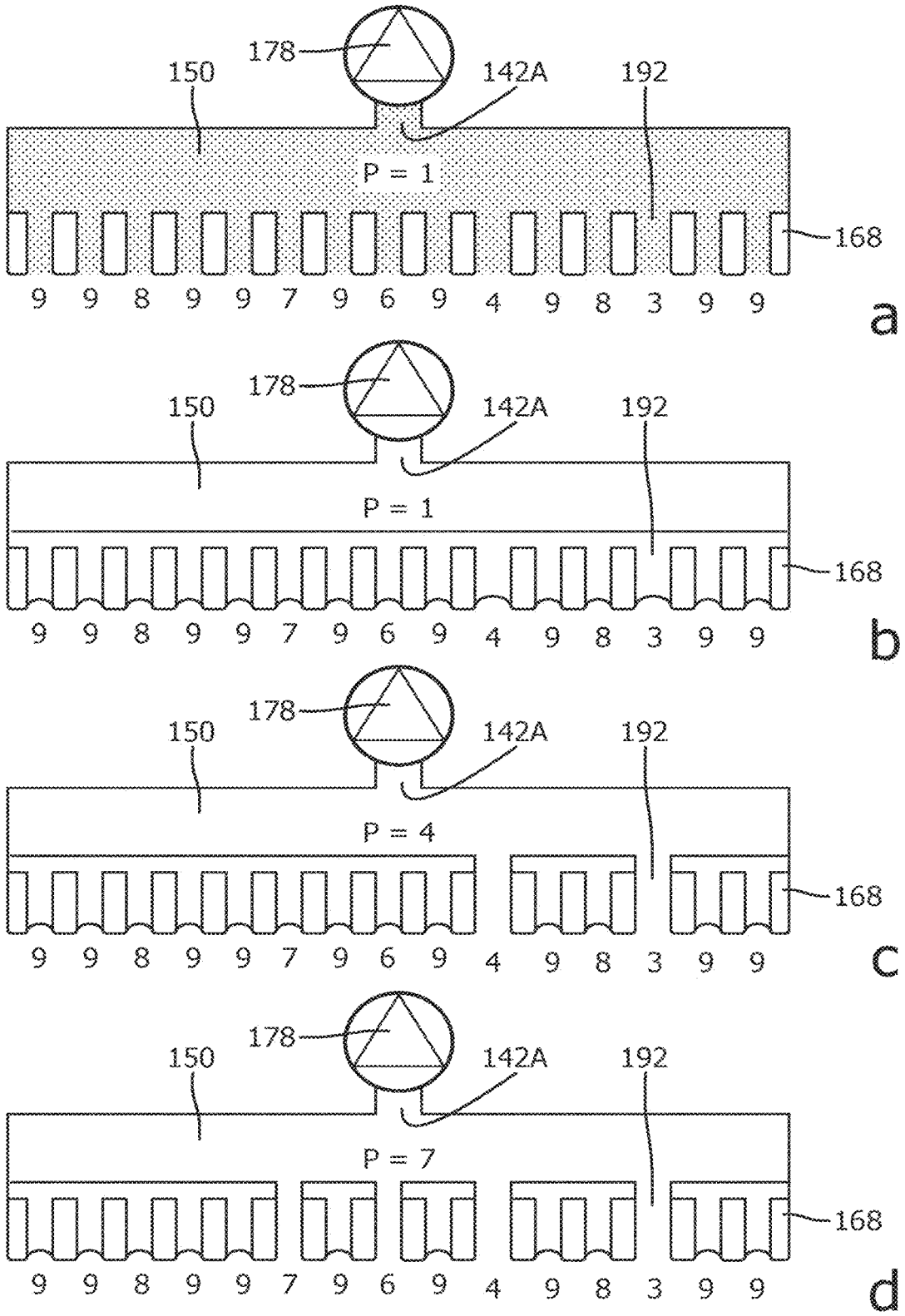
FIG. 14 schematically depicts a liquid transport state, intermediate regime and end regime sequence of a porous material when suction is applied thereto.

FIG. 14 schematically depicts the above-described "liquid transport state" 188 in which liquid is being drawn through all of the pores 192 in a), the end of the "liquid transport state" 188 in b), the intermediate regime 194 in c), and the end regime 198 in d). The porous material 168 is shown in FIG. 14 covering the dirt inlet(s) 142A, 142B connected to the underpressure generator 178, e.g. pump.

The porous material 168 has pores 192, e.g. micropores, each having a different breaking pressure. The latter is represented in FIG. 14 by the number provided underneath each pore 192. For the sake of simplicity, each number is rounded to a single digit.

At start-up of the underpressure generator 178, e.g. pump, all liquid, e.g. water, is drawn from the floor, and the required pressure is the water transport pressure, in this example set at "1". The underpressure in the dirt inlet 142A, and in this example in the cavity 150 behind the porous material 168 is correspondingly "1". Thus, a) in FIG. 14 schematically represents the "liquid transport state" 188, and b) shows the end of the "liquid transport state" 188. In b), the point at which the underpressure starts to rise is reached.

When all the liquid, e.g. water, has been removed from the floor, all pores 192 may be blocked via the surface tension of the residual liquid therein. In the depicted non-limiting example, the underpressure generator 178 is a fixed flow-pump, and hence continued operation of the pump may increase the underpressure. At a certain point, the underpressure in the dirt inlet 142A behind the porous material 168 may rise to the level, such as "4", of the breaking pressure of the weakest pores 192, the pores' breaking pressure will be exceeded and air may start to be transported therethrough. Since the pressure in the dirt inlet 142A behind the porous material 168 may already be significant when these first pores 192 "break", the air transported by these pores 192 at this point may be significant. Step c) in FIG. 14 can thus be regarded as schematically representing the intermediate regime 194.

In the intermediate regime 194, pores 192 may be getting blocked while other pores 192 are still transporting liquid from further regions (further away from the dirt inlet(s) 142A), hence creating more underpressure close to the dirt inlet(s) 142A. This can make the underpressure rise relatively slowly until all free liquid is gone. This may all be influenced by the pump rate and, in at least some examples, the properties of the liquid transporting support structure 154, together with the flexibility of all elements, deforming when underpressure is applied.

By way of a simplified illustration, if the flow rate were to be set at 100 $cm^3$/minute, flow resistance between the porous material and the pump were to be neglected, and all elements were to be infinitely stiff, then the intermediate regime 194 may be a vertical line in FIG. 12, digitally moving from the "liquid transport state" 188 to the end regime 198.

This process may continue until the air transported is equal to the pump rate in this example, and the underpressure in the dirt inlet 142A behind the porous material 168 is lower than the breaking pressure of the remaining "unbroken" pores 192 having the lowest breaking pressure. Step d) in FIG. 14 can thus be regarded as schematically representing the above-described end regime 198.

It is noted that the pressure measured in the test arrangement 166 may define the breaking pressure of the porous material 168. Different flow rates, such as 150 $cm^3$/minute, have been tested but showing the same breaking pressure, noting that more pores 192 may "break" to compensate for the increased flow.

The pore size, in other words pore diameter, of the pores 192 of the porous material 168 may be selected in order to balance a relatively high underpressure with a relatively low resistance to transport of liquid through/liquid transport pressure of the porous material 168.

Smaller pores 192 can increase the underpressure that can be generated in the dirt inlet 142A, e.g. with a relatively low power underpressure generator 178, e.g. pump. A denser porous material 168 having smaller pores 192 may create higher breaking pressures. Also with the aim of investigating the lower limit of pore size, an investigation was carried out using the above-described test arrangement 166 and test procedure using, as the porous material 168, beer filters specified according the size of particles which they can retain: 0.25 μm, 3 μm, 10 μm and 25 μm filters were tested. For this experiment, the latter beer filter specification was assumed to be the same as the "pore size/diameter".

Figure 15:
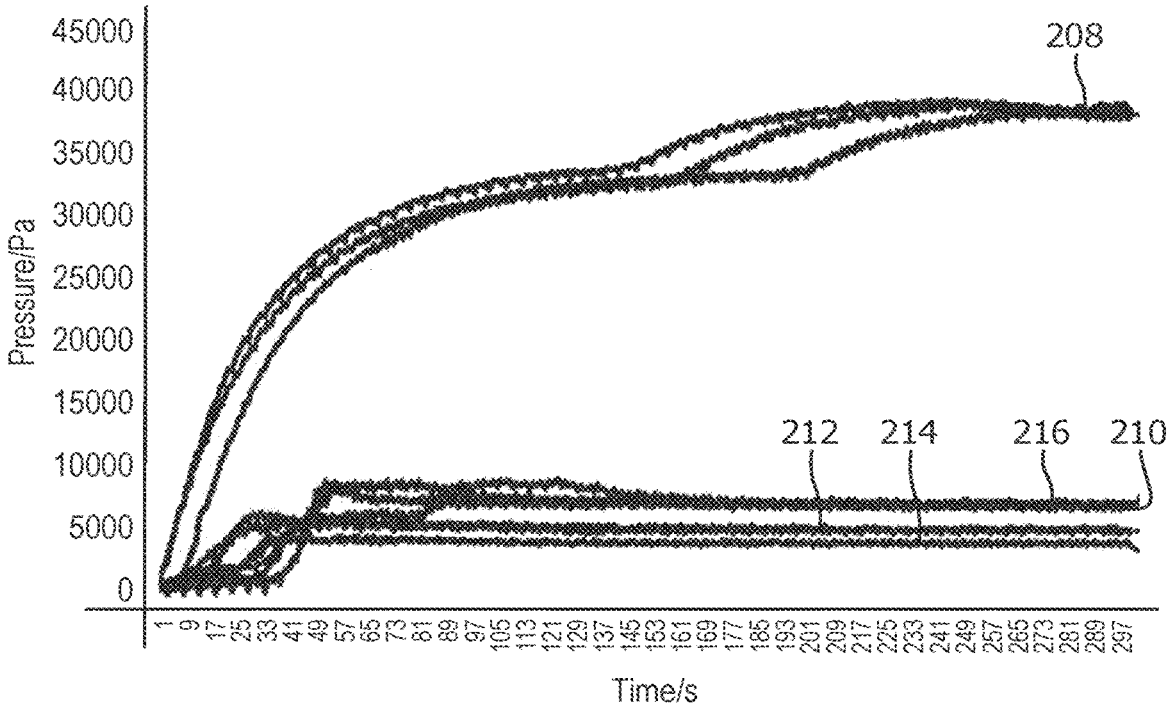
FIG. 15 provides several pressure vs time graphs for porous materials of differing pore size.

Referring to FIG. 15, plots 208 are for the 0.25 μm filter; plot 210 is for the 3 μm filter; plot 212 is for the 10 μm filter; plot 214 is for the 25 μm filter; and plot 216 is for a reference microfiber fabric.

It can be seen from FIG. 15 the porous size/diameter of the porous material 168 exerts a significant influence on performance. It is estimated from the results that an average 40 μm pore size/diameter (e.g. equivalent to a 40 μm beer filter) of the porous material 168 may correspond to a maximum, based on underpressure considerations.

An average 0.25 μm pore size/diameter (e.g. equivalent to a 0.25 μm beer filter) of the porous material 168 may correspond to a minimum, based on liquid transport pressure considerations.

It is evident from FIG. 15 that the 0.25 μm filter may lead to the water transport pressure being significantly higher than in the case of the 3 μm filter. In the case of the 0.25 μm filter, the underpressure may rise to about 23000 Pa during water transport. Also, the time to reach a dry state may be significantly longer for the 0.25 μm filter, meaning that it may take significantly more time to transport liquid/water from the surface to be cleaned.

In a non-limiting example, an average pore size/diameter of about 3 μm (e.g. equivalent to a 3 μm beer filter) of the porous material 168 may provide a favourable balance of properties.

FIG. 15 appears to show that there is a finite difference between the liquid/water transport pressure and the breaking pressure of the porous material 168. Relatively small pores 192 may result in an increase in the breaking pressure, e.g. up to 39000 Pa in the case of the 0.25 μm filter, but also the water/liquid transport pressure, e.g. 33000 Pa in the case of the 0.25 μm filter. It is noted that this difference between the water transport pressure and the breaking pressure is similar to that of the reference microfiber fabric (1000 Pa water transport pressure; 7000 Pa breaking pressure).

Bacteria tends to be characterized by having a relatively small size. For example, an *Escherichia coli* cell, which can be regarded as an "average" sized bacterium, is about 2 μm long and 0.5 μm in diameter.

Thus, porous materials 168 whose pore size is larger than 2 μm may permit such bacteria to pass therethrough. In this way, bacteria can be removed from the surface to be cleaned.

Depending on the porous material 168 selected, up to 99.9% of bacteria can be drawn through the porous material 168, away from the surface to be cleaned.

In some embodiments, the porous material 168 is defined by one or more layers of microfiber fabric whose pores have a pore size/diameter in the range of 0.25 μm to 40 μm (e.g. equivalent to 0.25 μm to 40 μm beer filters).

For example, such a porous material 168 (defined by one or more layers of microfiber fabric) may have a distribution of pore size/diameter in the above-mentioned 0.25 μm to 40 μm range, and an average pore size of 20 to 40 μm, e.g. about 35 μm. Since the pore dimensions are significantly larger than the size of bacteria, the bacteria can be pass through the porous material 168, and thus be removed from the surface to be cleaned.

Figure 16:
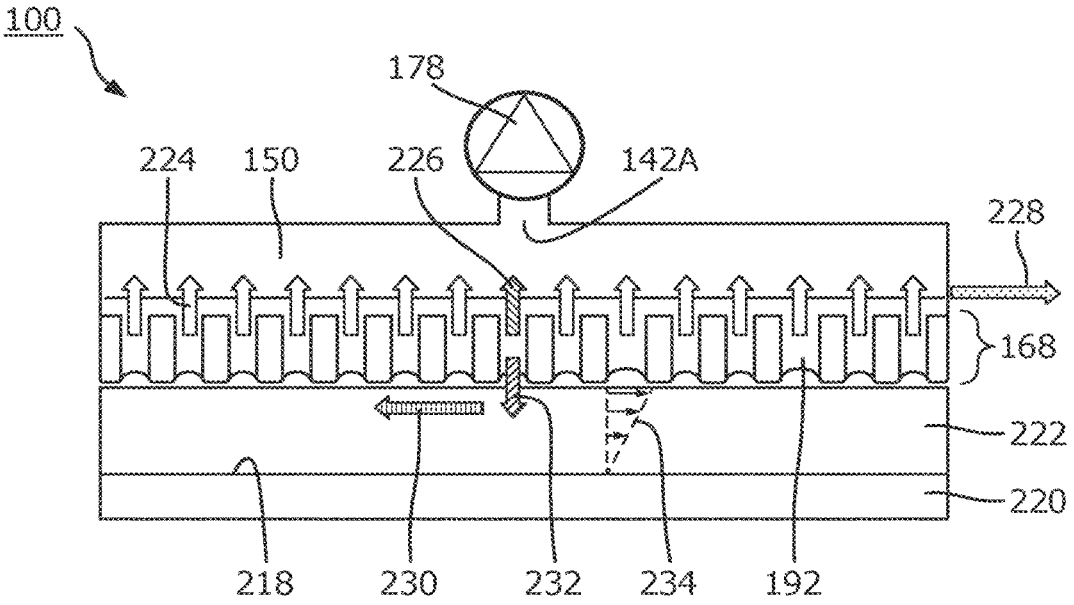
FIG. 16 schematically depicts an exemplary cleaner head being moved across a surface to be cleaned.

Whilst the above explanation has focused on the working principle of the porous material 168 as such, it is noted that porous material 168 may be in contact with the surface to be cleaned, and moved across the surface to be cleaned at a certain speed. This is schematically depicted in FIG. 16, which shows an exemplary cleaner head 100 comprising the dirt inlet 142A covered with the porous material 168 on the surface to be cleaned 218. In this non-limiting example, the surface to be cleaned 218 is the surface of a floor 220, and a layer of liquid 222, e.g. water, is present between the surface to be cleaned 218 and the porous material 168. The underpressure generator 178, e.g. pump, is intended to draw fluid through the pores 192 of the porous material 168 in the direction of the arrows 224. The arrow 226 represents the internal underpressure pulling the liquid towards the dirt inlet 142A. The arrow 228 represents the velocity of the cleaner head 100.

FIG. 16 schematically depicts the velocity distribution 234 in the fluid layer 222. The arrow 230 represents the fluid shear force on the porous material 168, as generated by the velocity distribution 234 in the fluid layer 222. The arrow 232 represents the shear force pulling water towards the floor 220.

This behaviour can be approximated using the following Bernoulli equation:

$$\frac{1}{2} * \rho * v^2 + P + h * \rho * g = \text{Constant}$$

where ρ is the density of the fluid, ν is the fluid flow speed, P is the pressure, h is the elevation above a reference plane, in this case the floor 220, and g is the acceleration due to gravity.

The above Bernoulli equation can be re-written for the pressure underneath the porous material 168:

$$\Delta P = \frac{1}{2} * \rho * v^2$$

For a speed of 1.5 m/s, ΔP=1125 Pa; for a speed of 3.16 m/s, ΔP=5000 Pa.

This indicates that at higher velocities, more liquid will be left on the floor 220, since at higher velocities the floor 220 will be pulling harder at the liquid, and this has been observed with cleaner heads 100 according to the present disclosure.

The movement of the cleaner head 100, e.g. at about 1.5 m/s, may create a shear-flow in the layer of liquid 222, creating the shear force 232 acting on liquid present in the porous material 168 which pulls the liquid towards the surface to be cleaned 218. The water is also being forced via the underpressure 226 in the direction of the dirt inlet 142A. The underpressure may be selected such that the force causing the liquid 222 to move towards the dirt inlet(s) 142A exceeds the shear force 232.

The liquid pick-up performance of an exemplary cleaner head 100 comprising the porous material 168 and the cleaning liquid applicator material 126, 128 for applying liquid, e.g. water, to the surface to be cleaned 218, moved at 1.5 m/s across the surface to be cleaned 218 with different dirt inlet underpressures was evaluated. The results are presented in the Table 1.

TABLE 1

| Underpressure/Pa | Performance |
|---|---|
| <2000 | Really wet floor; No noticeable pick-up performance |
| 3000 | Basic water pick-up, but still a quite wet floor |
| 5000 | Good setting: a fairly dry floor |
| >=7000 | Optimal performance: almost dry floor |

A further advantage of the liquid pick-up principle described herein may be the lower power consumption, particularly in examples in which the underpressure generator 178 is powered.

A conventional vacuum cleaner that is capable of picking up water needs to generate significant airspeed and/or brush-power in order to generate enough shear force on water droplets to cause them to enter the vacuum cleaner. Typical power consumption values for such vacuum cleaners are several hundred watts.

The following calculation illustrates the relatively low mechanical power needed for liquid, e.g. water, pick-up according to the present disclosure.

$$P = \Phi * \Delta P$$

where P is the mechanical power in watts; Φ is the fluid flow in $m^3/s$; and ΔP is the underpressure in the dirt inlet(s) 142A in Pa.

Taking, for instance, an underpressure of 5000 Pa, and a fluid flow of 100 $cm^3$/minute, the power is $8.3*10^{-3}$ watts.

Should the underpressure generator 178 be powered using, for instance, a conventional battery providing a runtime of 28 minutes in a wet cleaning apparatus whose mechanical power consumption is around 50 watts, the runtime in the present case would be 168000 minutes, in other words more than 100 days.

A powered wet cleaning apparatus having the cleaner head 100 according to the present disclosure may therefore only rarely require recharging of its battery (in examples in which such a battery is included to power the wet cleaning apparatus), and/or may be made more lightweight, due to the minimal battery capacity needed for, for example, a 1 hour runtime. Regarding the latter, it is noted that a battery for a conventional handheld wet cleaning apparatus may weigh around 0.5 kg, and may thus contribute significantly to the overall weight of the wet cleaning apparatus.

Table 2 provides a mechanical power comparison between a conventional vacuum cleaner and the various states described above in respect of the wet cleaning apparatus according to the present disclosure.

TABLE 2

| System | ΔP Pa | Flow $m^3/s$ | Mechanical Power W |
|---|---|---|---|
| Conventional vacuum cleaner | 20000 | $30 * 10^{-3}$ | 600 |
| According to the present disclosure; "fluid transport state" | 500 | $3 * 10^{-6}$ | 0.0015 |
| According to the present disclosure; "fluid block state" (only instantaneous, if no pressure sensor is included) | 7500 | $3 * 10^{-6}$ | 0.23 |
| According to the present disclosure; "air transport state" | 7500 | $3 * 10^{-6}$ | 0.23 |

More generally, the present disclosure provides a wet cleaning apparatus comprising a cleaner head 100. The cleaner head 100 has at least one dirt inlet 142A, 142B, and a porous material 168 covering the at least one dirt inlet 142A, 142B. The wet cleaning apparatus further comprises an underpressure generator 178 configured to provide a pressure difference between an inside of the wet cleaning apparatus and atmospheric pressure for drawing fluid through the porous material 168 and into the at least one dirt inlet 142A, 142B.

The underpressure generator 178 is included in an underpressure generator arrangement, with the latter being configured to control flow inside the wet cleaning apparatus for drawing fluid into the at least one dirt inlet 142A, 142B through the porous material 168 based on a pressure on the inside of the wet cleaning apparatus between the porous material 168 and the underpressure generator 178.

In some embodiments, the pressure difference is in a range of 2000 Pa to 13500 Pa.

Both endpoints of the 2000 Pa to 13500 Pa range for the pressure difference are purposively selected.

The 2000 Pa lower limit reflects that the cleaner head 100 will typically be moved over a surface to be cleaned, e.g. a floor, and as the speed of the cleaner head 100 over the floor increases, the concomitant drop in static pressure means that liquid is pulled towards the floor. Such behaviour can be approximated by a Bernoulli equation, as described above.

Referring to Table 1 above, it has been found that below 2000 Pa, too much liquid may remain on the surface to be cleaned when the cleaner head 100 is moved thereon at a typical speed.

The 2000 Pa minimum underpressure is correspondingly set according to a minimum typical speed with which a user moves the cleaner head 100 over the surface to be cleaned, thereby to ensure that the underpressure is sufficient to pull liquid into the inside of the wet cleaning apparatus without requiring that the user has to significantly slow or cease movement of the cleaner head 100 over the surface to be cleaned in order for the liquid to be picked up.

The 13500 Pa upper limit is defined for the purpose of ensuring that liquid transport through the porous material 168 is sufficiently rapid.

There is a trade-off between the magnitude of the underpressure which can be maintained and flow resistance through the porous material 168, with the latter determining the rate at which liquid can pass through the porous material 168. This trade-off is reflected in the selection of the 13500 Pa upper limit of the range.

In some embodiments, the pressure difference is 2000 Pa to 12500 Pa, preferably 5000 Pa to 9000 Pa, and most preferably 7000 Pa to 9000 Pa. These ranges may reflect particularly enhanced liquid pick-up observed during movement of the cleaner head 100, combined with relatively low flow resistance through the porous material 168.

The pressure difference can be directly and positively verified in a given wet cleaning apparatus by, for example, drilling a hole in a tube of the wet cleaning apparatus which is fluidly connected with the dirt inlet(s) 142A, 142B and using the hole to couple to a pneumatic pressure sensor itself having a tube with a membrane covering an end thereof; the sensor being thus connected using an airtight connection. The sensor may be arranged to avoid disturbing the flow, hence the skilled person will arrange the sensor to avoid, for instance, creating a bypass flow. No flow may be towards or from the sensor: only pressure is transmitted. In this way, the flow of the appliance may never be compromised (hence may remain at the set level in spite of the sensor installation).

The pressure sensor is connected between the porous material 168 and the underpressure generator 178 and as close to the porous material 168 as possible, to minimise the influence of other factors, such as flow resistance etc., on the sensed pressure difference.

The sensing element/membrane of the pressure sensor/gauge is ideally arranged/positioned in the pressure sensor so that the sensing element can be placed directly (without the requirement for connecting tubes) in the tube, or in the cavity 150 behind the porous material 168.

By positioning the membrane of the pressure sensor, in other words membrane pressure gauge, with the membrane positioned at, in other words in line with, the wall of the tube (or exposed to the cavity 150), measurement errors may be minimized, as will be appreciated by a person skilled in the art.

It is noted that air bubbles inside narrow tubes may generate resistance (capillary/surface tension effects), and hence may influence the measurement. Hence the skilled person will further appreciate that care is also to be taken that air bubbles (water-air surfaces) do not unduly influence the pressure difference measurement.

It is further noted that a column of water present between the pressure sensor and the porous material 168 should be deducted from the measurement result (if such a column of water is present during the measurement), to compensate for the static pressure generated by the column of water.

Once the pressure sensor is arranged as described above, it may be ascertained that maintenance of the underpressure is due to the porous material 168 and not some other element, such as a valve. Any such element that influences the underpressure that is presented to the porous material 168 should be rendered inoperable for the purpose of performing the measurement.

Component(s) that dispense cleaning liquid (should the wet cleaning apparatus be configured to deliver cleaning liquid) is/are disengaged when performing the pressure difference measurement.

The wet cleaning apparatus is turned on (in the desired setting), so that the pick-up system comprising the underpressure generator 178 is activated. Recording of data from the pressure sensor is started.

The pick-up area of the cleaner head 100 is suspended in a layer of water, at max. 5 mm depth.

The pick-up area is then lifted from the water without tilting it in any way (so that the cleaner head 100 remains in a cleaning position, as if it were positioned to clean the floor), so that the water is no longer touching the porous material 168. At this point, "free water" will be removed from the porous material 168, all pores will go into their "blocked state", and the breaking pressure is determinable. The measurement result will resemble the graph shown in FIG. 12, once again noting that an equilibrium is established in the end regime 198 in which the applied flow results in an underpressure which causes no more fluid blocks to break.

The breaking pressure obtained from this measurement result, referring to the end regime 198, is the "pressure difference between the inside of the wet cleaning apparatus and atmospheric pressure for drawing fluid through the porous material 168 and into the at least one dirt inlet 142A, 142B." It is verified from the measurement result whether or not the 2000 Pa to 13500 Pa range is satisfied.

It is noted that the porous material 168 may be arranged to contact liquid on the surface to be cleaned, as previously described. Thus, the porous material 168 may be defined from an exterior surface of the porous material 168 exposable to liquid on a surface to be cleaned to an interior surface of the porous material 168 exposed to the at least one dirt inlet.

ASTM F316—03, 2019, Test A provides a bubble point pressure measurement. Whilst this standard method was developed for nonfibrous membrane filters, the procedure can be replicated for the porous material 168 according to the present disclosure.

The bubble point test for determining the limiting pore diameter, in other words maximum pore size, is, in summary, performed by prewetting the sample of the porous material 168, increasing the pressure of gas upstream of the porous material 168 at a predetermined rate, and watching for gas bubbles downstream to indicate the passage of gas through the maximum diameter pores of the porous material 168.

In common with the membrane filters described in ASTM F316—03, 2019, Test A, the porous material 168 may (at least to an approximation) have discrete pores extending from one side of the porous material 168 to the other, similarly to capillary tubes. The bubble point test is based on the principle that a wetting liquid is held in these capillary pores by capillary attraction and surface tension, and the minimum pressure required to force liquid from these pores is a function of pore diameter. The pressure at which a steady stream of bubbles appears in this test is termed the "bubble point pressure".

It is noted that ASTM F316—03, 2019, Test A is based on an approximation of the pores as capillary pores having circular cross-sections, and hence the limiting pore diameter should be regarded as merely an empirical estimate of the maximum pore diameter based on this premise.

The testing apparatus mandated in ASTM F316—03, 2019, Test A was replicated, as was the test procedure.

1. The sample of porous material (2 inch (50.8 mm) diameter; held in a circular holder such as to have an open/active area having a diameter of 47 mm) is wetted completely by floating it on a pool of the liquid (noting that a vacuum chamber may be used to assist in wetting the sample, if necessary). For water-wettable samples, the sample is placed in water and soaked fully.

2. The wet sample of porous material was placed in the filter holder of the test apparatus.
3. A fine (100 by 100) mesh is placed onto the sample of porous material; the fine mesh being a first part of the 2-ply construction mandated by the standard.
4. The second part of the 2-ply construction, in the form of a perforated metal component to add rigidity, is placed on the fine mesh.
5. A support ring is placed onto the stack and secured in place using bolts. A slight gas pressure can be applied at this point to eliminate possible liquid backflow.
6. The perforated metal component is covered with 2 to 3 mm of test liquid (Type IV water as mandated by the standard when the sample is wettable with water).
7. The gas pressure is then raised and the lowest pressure at which a steady stream of bubbles rises from the central area of the reservoir is recorded (see FIG. 5 of ASTM F316—03, 2019, Test A; noting that bubbles observed at the edge of the reservoir are neglected for the bubble point determination).

It was found suitable to first raise the pressure relatively quickly, e.g. at about 200 Pa/second, to roughly determine the bubble point. Pressure was then relieved from the sample to allow the water to run back into the sample. The pressure was then raised to roughly 80% of the expected pressure value, maintained at the 80% level for about 15 seconds (to ensure all "free" water is pressed out of the sample), and then raised again at a lower rate of ≤50 Pa/second until the constant flow of bubbles was observed.

The limiting pore diameter, d, is then determined from the recorded bubble point pressure, p, using equation 1 of ASTM F316—03, 2019, Test A: $d=C\gamma/p$, where $\gamma$ is the surface tension in mM/m (72.75 for distilled water at 20° C.), and C is 2860 when p is in Pa.

It was found that the bubble point pressure from ASTM F316—03, 2019, Test A was comparable for samples of the porous material 168 to the above-described breaking pressure, aside from the case of the 0.25 μm beer filter which can be straightforwardly explained by a forced flow being present in the breaking pressure test but not in the bubble point test. Results for various porous material 168 samples are provided in Table A.

TABLE A

| Porous material sample number | Porous material sample description | Breaking pressure/ Pa | Bubble point pressure by ASTM F316 - 03, 2019, Test A/Pa | Limiting pore diameter by ASTM F316 - 03, 2019/μm |
|---|---|---|---|---|
| 1 | Supplier: A Cloth 1 | 3500 | 3145 | 66 |
| 2 | Supplier: B Cloth 1 | 6250 | 6130 | 34 |
| 3 | Supplier: C Cloth 1 | 4796 | 4405 | 47 |
| 4 | Supplier: D Cloth 1 | 6500 | 5975 | 35 |
| 5 | Supplier: D Cloth 2 | 1400 | 2115 | 98 |
| 6 | Supplier: D Cloth 3 | 5000 | 5165 | 40 |
| 7 | Supplier E Cloth 1 | 8000 | 7225 | 29 |
| 8 | b2 | 5500 | 5240 | 40 |
| 9 | 2l | 7500 | 6360 | 33 |
| 10 | 3l | 8000 | 7430 | 28 |
| 11 | 4l | 8500 | 7265 | 29 |
| 12 | WSC | 10500 | 9635 | 22 |
| 13 | Beer filter "25 μm" | 4000 | 3940 | 53 |
| 14 | Beer filter "3 μm" | 7000 | 7760 | 27 |
| 15 | Beer filter "0.9 μm" | 13920 | 12840 | 16 |
| 16 | Beer filter "0.25 μm" | 39500 (almost no flow) | 28755 | 7 |
| 17 | Beer filter "10 μm" | 5000 | 4635 | 45 |

In some embodiments, a limiting pore diameter of the porous material 168 as measured using ASTM F316—03, 2019, Test A is equal to or greater than 15 μm.

Such a limiting pore diameter equal to or greater than 15 μm may assist to maintain a relatively large underpressure whilst ensuring that pores are sufficiently large for efficient liquid transport therethrough. Regarding the latter, it is noted that this observation is supported by theory, noting that, when approximated using the Poiseuille equation provided above, with smaller pores the flow resistance may increase to the power of four.

In some embodiments, a limiting pore diameter of the porous material 168 as measured using ASTM F316—03, 2019, Test A is equal to or less than 105 μm. This upper limit for the limiting pore diameter assists to ensure that sufficient underpressure is maintainable by the porous material 168.

As noted above, ASTM F316—03, 2019, Test A assumes cylindrical pores. Purely for the purposes of explanation/illustration (hence should not be regarded as limiting values provided herein for the limiting pore diameter from ASTM F316—03, 2019, Test A), it is noted that limiting pore diameter can be adjusted with a Tortuoise factor (TF), which is an empirical factor derived for solid wire filters, to compensate for non-roundness of the pores. The 1.3 to 1.65 spread for the TF suggested in ASTM E3278—21 (see section 4.2.1 of that standard) may result in an approximately 27% pore size spread. For illustrative purposes only, Table B shows the above-described limiting pore diameter endpoints when adjusted using the TF. Note that the limiting pore diameter from ASTM F316—03, 2019, Test A provides a measure of the largest pore size for particles to pass through, hence the TF can compensate for the fact that a "triangular" pore can only let a spherical particle through which is significantly smaller than the surface of the triangle.

TABLE B

| Bubble point pressure by ASTM F316 - 03, 2019, Test A/Pa | Limiting pore diameter by ASTM F316 - 03, 2019/μm | Compensated limiting pore diameter (using ASTM E3278 - 21)/μm TF = 1.3 | TF = 1.65 |
|---|---|---|---|
| 2000 | 104 | 80 | 63 |
| 13500 | 15 | 11.5 | 9 |

In some embodiments, the underpressure generator is configured to provide a flow rate through the porous material 168 which is less than or equal to 2000 $cm^3$/minute.

Such a flow rate may be significantly lower than for the conventional wet vacuum cleaners mentioned above. Since power is equal to flow rate multiplied by the pressure difference, by combining this maximum 2000 $cm^3$/minute flow rate with the above-described maximum 13500 Pa pressure difference as a maximum power consumption scenario, the power consumption of the wet cleaning apparatus may be minimised. Referring to Table 2 above, this may enable the wet cleaning apparatus to made relatively compact, e.g. using a smaller battery, and/or to have a relatively long runtime.

Alternatively or additionally, the underpressure generator may be configured to provide a flow rate through the porous material 168 which is equal to or greater than 15 $cm^3$/minute. This may contribute to the pick-up of liquid from the surface to be cleaned being sufficiently rapid. The 15 $cm^3$/minute lower limit may, in some embodiments, be set to equal or exceed a flow rate of a cleaning liquid from cleaning liquid outlet(s) 104 also included in the cleaner head 100.

In some embodiments, the underpressure generator is configured to provide a flow rate through the porous material 168 which is equal to or greater than 40 $cm^3$/minute. As well as contributing to efficient liquid pick-up, this 40 $cm^3$/minute may, in some embodiments, be set to equal or exceed a flow rate of a cleaning liquid from cleaning liquid outlet(s) also included in the cleaner head, with the minimum cleaning liquid flow rate being set to ensure plentiful supply of the cleaning liquid to the surface to be cleaned.

The underpressure generator may be configured to provide a flow rate through the porous material in the range of 80 to 750 $cm^3$/minute, more preferably 100 to 300 $cm^3$/minute, and most preferably 150 to 300 $cm^3$/minute. Such a flow rate may capitalise on the underpressure-maintaining capability of the porous material 168, and may ensure sufficient liquid pick-up whilst limiting energy consumption.

In some embodiments, the porous material 168 has a thickness of less than or equal to 10 mm, more preferably less than or equal to 5 mm, and most preferably less than or equal to 3 mm. Such a maximum thickness may contribute to minimising of flow resistance through the porous material 168.

The thickness of the porous material 168 can be determined by using a 0.01 mm precision gauge and two ground metal plates (with the upper plate by which the normal pressure is applied being 70 mm×30 mm, and the lower plate on which the sample of the porous material is supported having a larger area than the 70 mm×30 mm surface of the upper plate for ease of alignment) for receiving the porous material 168 therebetween. The arrangement is configured to apply a pressure normal to the sample of the porous material (70 mm×30 mm) of 864.2 $N/m^2$. The relevant measurement parameters are provided in Table C:

TABLE C

| | | | | |
|---|---|---|---|---|
| Metal plate parameters | Length | 70 mm | Area of sample | 2100 $mm^2$ |
| | Width | 30 mm | Total mass | 185 g |
| | mass | 85 g | Total force | 1.81N |
| | Fn (gauge force) | 100 g | Pressure | 864.2 $N/m^2$ |

The thickness of several samples was determined using this method, and the data are provided in Table D:

TABLE D

| Porous material sample number | Porous material sample description | Number of layers in porous material sample | Thickness of porous material sample/mm | Thickness of single layer of porous material sample/mm |
|---|---|---|---|---|
| 18 | Supplier F | 1 | 0.6 | 0.6 |
| 19 | | 2 | 1.23 | 0.63 |
| 20 | | 3 | 1.87 | 0.64 |
| 21 | | 4 | 2.42 | 0.55 |
| 22 | Supplier A; | 2 | 1.26 | 0.63 |
| 23 | Cloth 2; two | 4 | 2.55 | 0.645 |
| 24 | layers pre- | 6 | 3.83 | 0.64 |
| 25 | glued to | 8 | 5.08 | 0.625 |
| 26 | each other | 10 | 6.35 | 0.635 |
| 27 | | 12 | 7.62 | 0.635 |

In some embodiments, a fluid transport pressure at 200 $cm^3$/minute flow through the porous material 168 is less than 0.25 multiplied by the bubble point pressure as determined by ASTM F316—03, 2019, Test A.

This may mean that the flow resistance through the porous material 168 is maintained at a relatively low level.

A further set of breaking pressure tests were conducted (similarly to the experiments described above) using the porous materials corresponding to sample number 18 in Table A, sample numbers 22 to 25 in Table D, and a Supplier F fabric having a thickness of 0.8 mm. The flow pressure drop and the breaking pressure were recorded for each sample, and the results (mean values of at least two measurements) are tabulated in Table E. In these experiments, a flow rate of 89 $cm^3$/minute was used, and a diameter of circular mesh below the sample (extending across an "active area" of the sample) was 80 mm.

TABLE E

| Porous material sample number/description | Flow pressure drop/Pa | Breaking pressure/Pa |
|---|---|---|
| 15 | 19000 | 13920 |
| Supplier F fabric; thickness 0.8 mm | 120 | 5539 |
| 22 | 2910 | 11495 |
| 23 | 8921 | 12405 |
| 24 | 12359 | 13000 |
| 25 | 15830 | 13363 |
| 26 | 16617 | 14100 |
| 27 | 18127 | 14173 |

It can be seen that the breaking pressure rises with more layers being stacked on top of each other, as previously described. However, the transport flow pressure may increase more quickly than the breaking pressure as more layers are added, and in the case of sample numbers 22 to 27, the transport flow pressure surpasses the breaking pressure when the porous material has four stacked double layers (at sample number 25).

It may be that the transport flow pressure rises faster with more layers than is evident from samples 22 to 27; air in the system may however mean that the data starts showing compressibility for, in particular, sample numbers 25 to 27.

More generally, these data may indicate that the wet cleaning apparatus may operate when the transport flow pressure (at the desired flow rate) is lower than the breaking pressure.

For the tests whose results are tabulated in Table E, the flow rate was 89 $cm^3$/minute, and the active area of the fabric was 5030 $mm^2$. In the case of the cleaner head 100, the active area may be about 1750 $mm^2$. Hence, when the transport flow pressure is applied to the porous material 168 of the cleaner head 100, the actual flow through the porous material 168 may be a factor of (1750/5030) 0.35 lower than the flow used in these tests.

This may mean that at the point where transport flow pressure is equal to the breaking pressure (e.g. at sample number 24), the maximum flow that the porous material 168 can withstand is approximately (0.35*98) 31 $cm^3$/minute. Even if more layers are added in the porous material 168, the breaking pressure may stay largely the same, while the transport flow pressure increases, thus lowering this value even more.

It is noted that in the above-described breaking pressure tests, the full surface of the test sample is covered with water, so the entire area of the porous material 168 transports water. However, in practice the area of the cleaner head 100 that contacts the floor (e.g. 5 mm wide and 350 mm long) transports water, while the area of porous material 168 adjacent to that area can also transport air. This may mean that when, for instance, four double layers are used (in the case of sample number 25), and the breaking pressure of the porous material is lower than the water transport pressure, the periphery of the porous material 168 may start breaking letting in air, hence causing settling at the breaking pressure. The active/pick-up area may be left with a relatively low pressure, hence may pick up liquid relatively slowly, and thus liquid may be left on the surface to be cleaned. Conversely, in the scenario in which the porous material 168 has a relatively low transport flow pressure and a significantly larger breaking pressure (e.g. in the case of the 0.8 mm thick Supplier F fabric in which the breaking pressure is a factor of 50 higher than the transport flow pressure), the pick-up flow may be very high.

Overall, the wet cleaning apparatus may operate with the breaking pressure being higher than the transport flow pressure, but for the purpose of enabling pick-up at higher speed, the breaking pressure may be at least twice the transport flow pressure.

In some non-limiting examples, the cleaner head 100 may deliver cleaning liquid at a flow rate of 40 $cm^3$/minute. With a flow rate through the porous material 168 of 85% of this cleaning liquid flow rate on a smooth surface to be cleaned, i.e. a pick-up rate of 34 $cm^3$/minute, the pick-up rate is comparable to the 31 $cm^3$/minute estimated above for sample number 24.

In some non-limiting examples, some tolerance may be introduced, for instance to account for a 20 $cm^3$/minute cleaning liquid flow, hence leading to an upper limit of the thickness of the porous material 168 of approximately 5 mm (see sample number 25).

As described above, the porous material 168 can comprise one or more of a porous fabric, a porous plastic, and a foam.

Such a porous plastic may, for example, take the form of a sintered mesh of plastic granules.

In embodiments in which the porous material 168 includes such a porous plastic, one or more further porous material layers, e.g. comprising a porous fabric, such as a woven porous fabric, may be arranged on an external surface of the porous plastic. Such further porous material layer(s) may be more wettable by water than the porous plastic and thus more appropriate for contacting the surface to be cleaned when wetted by water.

Particular mention is made of the porous material comprising a porous woven fabric, and most preferably a woven microfiber fabric. Such a woven microfiber fabric may facilitate attainment of the requisite underpressure in the wet cleaning apparatus.

Such a porous woven fabric, and in particular such a woven microfiber fabric, can be configured, in particular via the tightness of its weave, to satisfy the above ranges for the limiting pore diameter.

Specifications of a particularly suitable woven fabric are provided in Table F as an illustrative non-limiting example.

TABLE F

| Characteristic | Specification |
|---|---|
| Fabric set | plain weave |
| Density | >60 yarns/cm in warp<br>>60 yarns/cm in weft |
| Basis weight | ~200 g/m2 |
| Composition | Polyester 80%, Polyamide 20% |
| Warp yarn | Low twist yarn of Polyester filamentary fibres of ~18 μm diameter, preferred of edged cross-section.<br>Yarn count: of 60-70 filamentary fibres in cross-section, low twist. |
| Weft yarn | Low twists yarn of Polyester/Polyamide microfibers (pie cross-section). Fibre cross-section of up to 16 μm<br>Yarn count: of ~100 microfibres in cross-section, low twisted. |
| Permeability | 15 L/h/$cm^2$ |

FIGS. 17 to 23 schematically depict examples of how the porous material 168 may be mounted in the cleaner head 100.

The porous material 168 can be mounted in any suitable manner. In some embodiments, such as that shown in FIG. 17, the cleaner head 100 comprises a support member 236, for example a rigid support member 236, for supporting the porous material 168. The support member 236 can be formed of any suitable material, such as an engineering thermoplastic.

In some embodiments, the cleaner head 100 comprises an elastomeric material 238 on which the porous material 168 is arranged. The resilient deformation of such an elastomeric material 238 may lessen the risk of damage to the porous material 168 should, for example, a relatively hard protrusion be present on the surface to be cleaned 218 which comes into contact with the porous material 168. Alternatively or additionally, the elastomeric material 238 may assist the porous material 168 to follow any contours of the surface to be cleaned 218.

The elastomeric material 238 can, for instance, be or comprise silicone rubber. Other elastomeric materials, such as a polydiene, e.g. polybutadiene, a thermoplastic elastomer, and so on, can also be contemplated for inclusion in, or defining of, the elastomeric material 238.

Alternatively or additionally, the elastomeric material can be less than 50 Shore A, preferably less than 20 Shore A, most preferably less than 10 Shore A.

In a non-limiting example, the elastomeric material is 4 Shore A silicone rubber.

In embodiments in which the cleaner head 100 comprises the support member 236, e.g. rigid support member 236, the elastomeric material 238 can be provided between the support member 236 and the porous material 168. An example of this is shown in FIG. 17.

In embodiments in which the cleaner head 100 comprises the above-described protruding element, the protruding element may comprise the elastomeric material 238, as will be described in more detail herein below.

Figure 17:
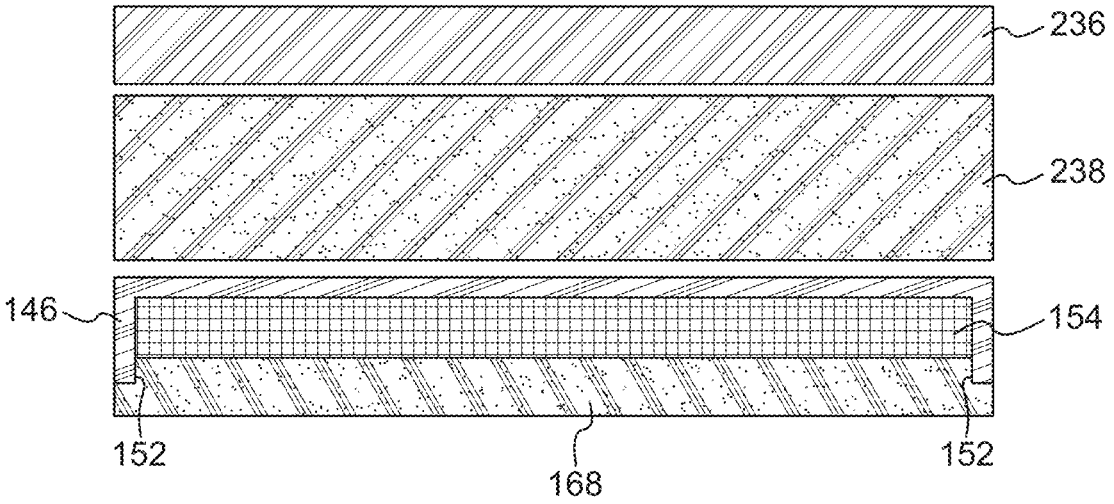
FIGS. 17 to 23 provide schematic cross-sectional views of a porous material mounted to a support member.

Returning to the non-limiting example depicted in FIG. 17, the impermeable portion 146 is in the form of a polymer, e.g. thermoplastic, film, with the seal 152 being provided between the polymer film and the porous material layer 114 included in the porous material 168. Moreover, the liquid transporting support structure 154 included in this particular example is in the form of a mesh or a stack of mesh layers.

Figure 18:
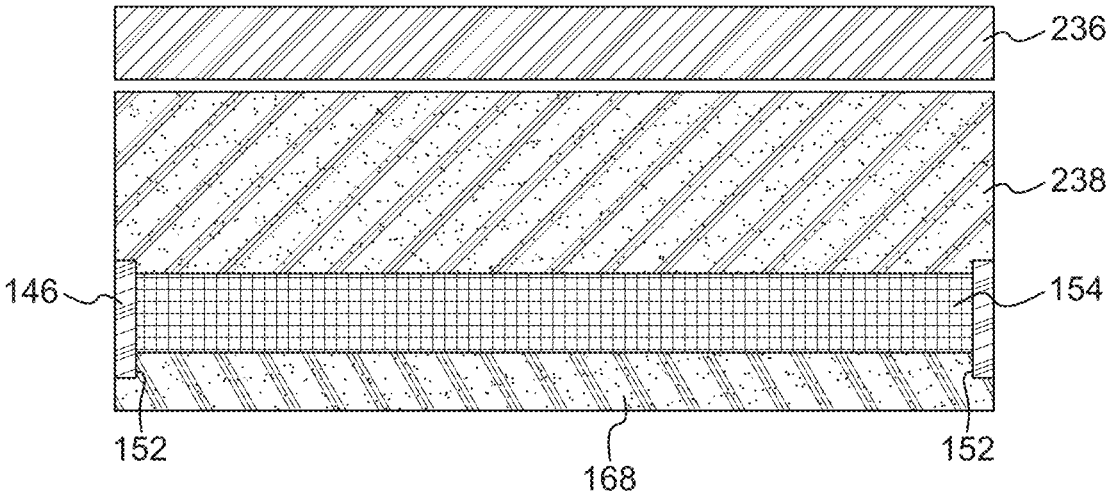

In some embodiments, such as the non-limiting example shown in FIG. 18, the impermeable portion 146 is defined by impermeable sealing portion(s), e.g. pieces of polymer film, extending from the elastomeric material 238 to the porous material layer 114 of the porous material 168. In this case, there may be no need for a polymer film to extend laterally over the internal surface of the porous material layer 114.

In some embodiments, the elastomeric material 238 comprises the impermeable portion 146 sealed onto the porous material layer 114 of the porous material 168. The above-described polymer film and pieces of polymer film are therefore obviated in this example, and can be omitted. In this manner, the number of components in the cleaner head 100 may be reduced, thereby facilitating manufacture.

Figure 19:
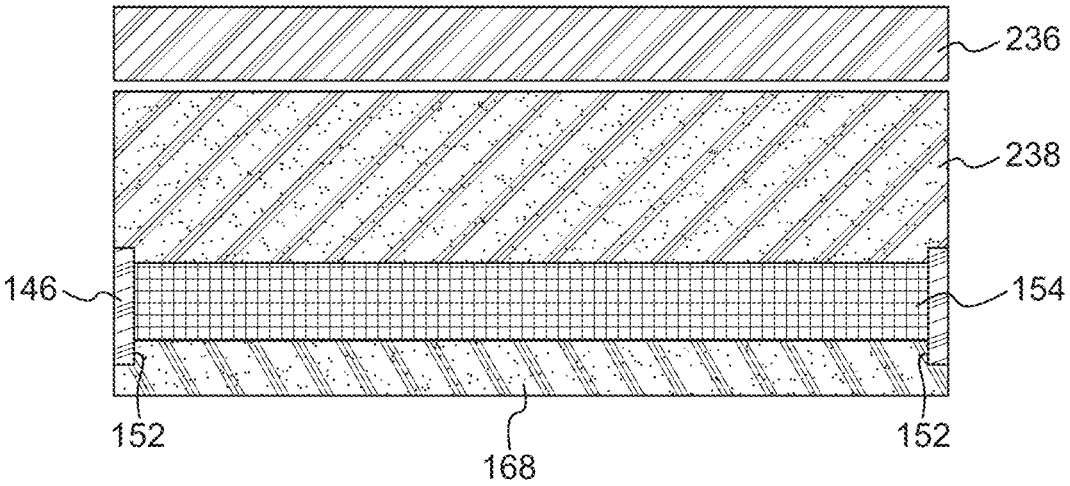

In some embodiments, such as that shown in FIG. 19, the liquid transporting support structure 154 is at least partly, or entirely, provided by a surface pattern on and/or in the surface of the elastomeric material 238 facing the porous material layer 114 of the porous material 168. Replacing the mesh(es) with the surface pattern on the surface of the elastomeric material 238 may assist in terms of reducing the number of components in the cleaner head 100. In other respects, the example shown in FIG. 19 corresponds to that depicted in FIG. 18.

Figure 20:
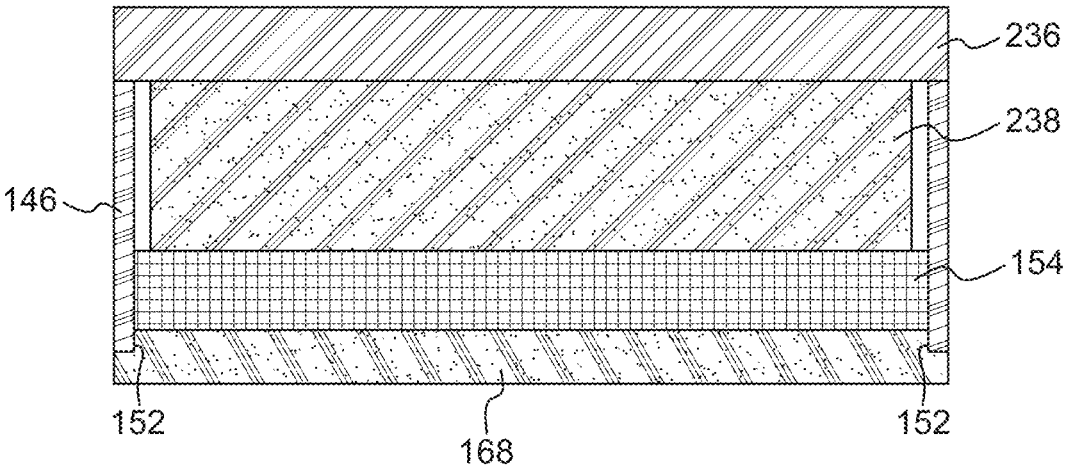

In some embodiments, such as that shown in FIG. 20, the support member 236 comprises the impermeable portion 146 sealed against the porous material layer 114 of the porous material 168. In other words, the seal present between the support member 236 and the porous material 168 is provided by protruding portions of the support member 236 which seal against the porous material 168. Hence, the above-described polymer film is not necessary in this example because the seal can be created using a direct connection between the porous material layer 114 and the support member 236. In other respects, the example shown in FIG. 20 corresponds to that depicted in FIG. 17.

Figure 21:
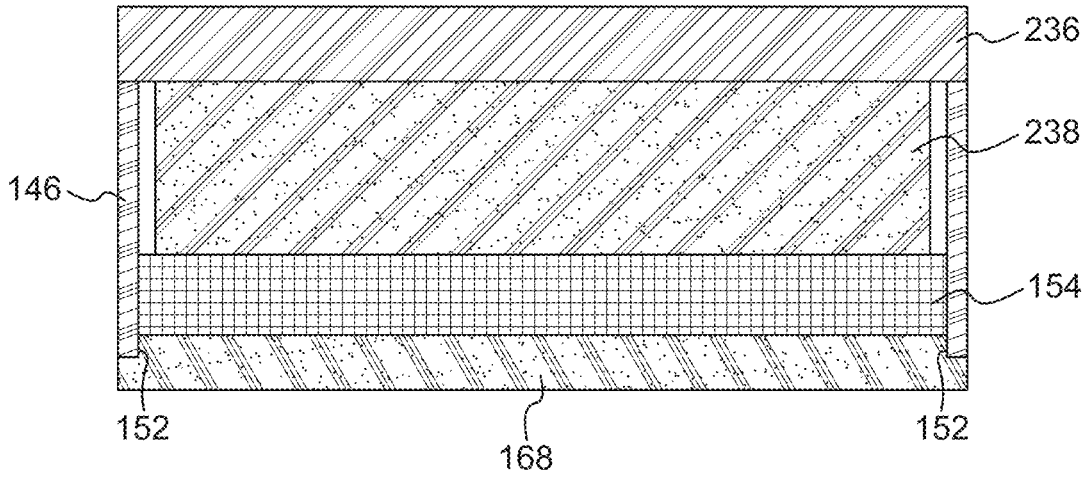

The non-limiting example shown in FIG. 21 corresponds to that shown in FIG. 20 other than the liquid transporting support structure 154 being at least partly, or entirely, provided by a surface pattern on and/or in the surface of the elastomeric material 238 facing the porous material layer 114 of the porous material 168.

Figure 22:
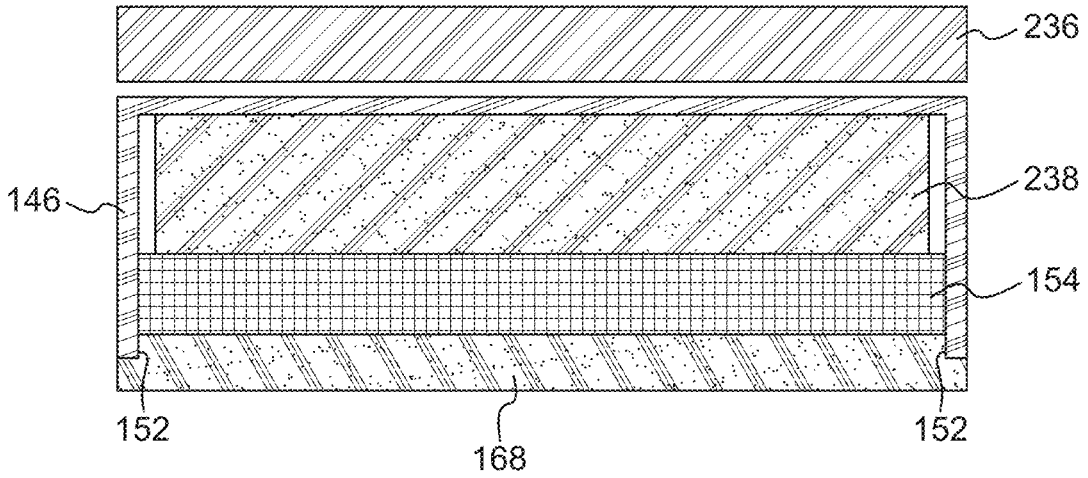

The non-limiting example shown in FIG. 22 corresponds to that shown in FIG. 18 other than the elastomeric material 238 being arranged within the cavity 150 provided between a polymer film as the impermeable portion 146 and the porous material layer 114 of the porous material 168.

Figure 23:
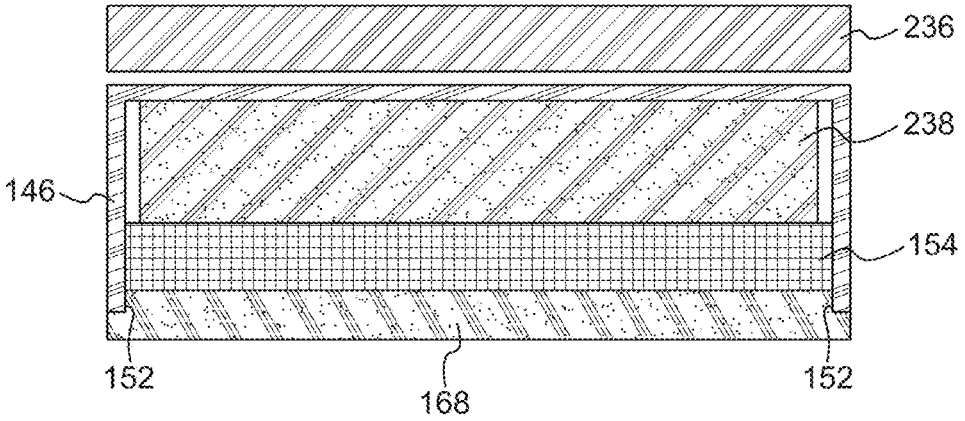

The non-limiting example shown in FIG. 23 corresponds to that shown in FIG. 22 other than the liquid transporting support structure 154 being at least partly, or entirely, provided by a surface pattern on and/or in the surface of the elastomeric material 238 facing the porous material layer 114 of the porous material 168.

At this point it is reiterated that the above-described liquid pick-up region PR of the porous material layer 114 (delimited by sealing attachment of the porous material layer 114 around the, e.g. each of the, at least one dirt inlet 142A, 142B) may be arranged relative to each of the at least one cleaning liquid outlet 104 such as to allow the cleaning liquid to bypass the liquid pick-up region PR to reach, or at least be directed towards, the surface to be cleaned 218. Such arrangement of the liquid pick-up region PR relative to each of the cleaning liquid outlet(s) 104 can be achieved in any suitable manner.

Figure 24:
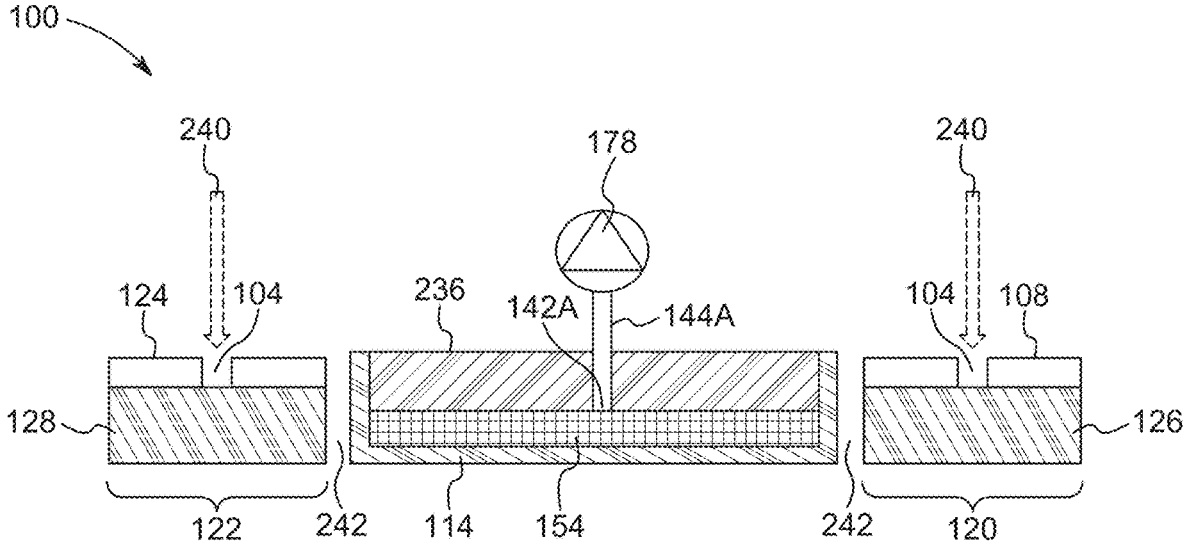
FIGS. 24 to 30 schematically depict various exemplary cleaner heads.

In some embodiments, such as that shown in FIG. 24, each of the cleaning liquid outlets 104 are arranged in one or more dispensing parts which are spatially separated from the porous material layer 114. By arranging the cleaning liquid outlet(s) 104 in such a separate dispensing part or parts, the cleaning liquid can be delivered towards the surface to be cleaned 218, in the direction of the arrows 240 in FIG. 24, without initially contacting the porous material layer 114.

In the non-limiting example shown in FIG. 24, the dispensing parts correspond to the above-described cleaning liquid distribution strips 108, 124.

The spatial separation is evident in FIG. 24 by the gaps 242, e.g. air gaps 242, provided between the porous material layer 114 and the cleaning liquid distribution strips 108, 124.

Figure 25:
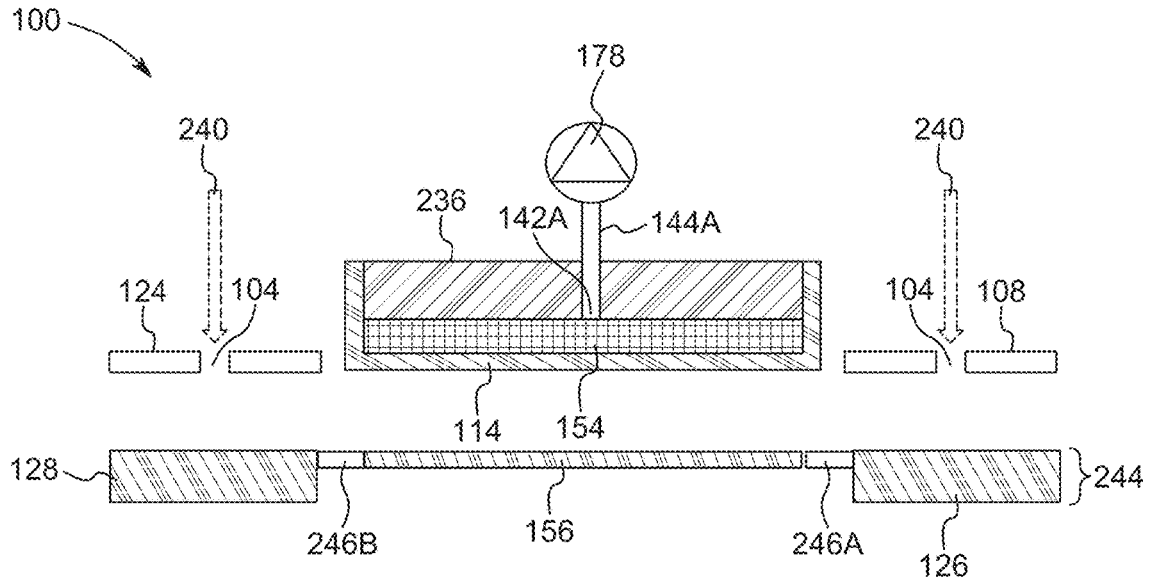

In some embodiments, such as that shown in FIG. 25, the porous material 168 comprises the above-described one or more further porous material layers 156, and the cleaner head 100 comprises a detachable element 244 comprising the one or more further porous material layers 156, with detachment of the detachable element 244 separating the one or more further porous material layers 156 from the porous material layer 114.

In some embodiments, the detachable element 244 comprises the above-described cleaning liquid applicator material 126, 128. In this manner, the one or more further porous material layers 156 can be straightforwardly replaced at the same time as replacing the cleaning liquid applicator material 126, 128. For example, the cleaning liquid applicator material 126, 128 can be attached, e.g. adhered, to the one or more further porous material layers 156 in the detachable element 244.

In some embodiments, such as in the non-limiting example shown in FIG. 25, the cleaning liquid applicator material 126, 128 comprises the above-described first and second applicator portions 126, 128, with a first attachment 246A connecting the one or more further porous material layers 156 to the first applicator portion 126, and a second attachment 246B connecting the one or more further porous material layers 156 to the second applicator portion 128. Another example of this is described herein below with reference to FIG. 33E.

In some embodiments the cleaner head 100 comprises a support for supporting the porous material layer 114, and the cleaner head 100 comprises a detachable (and/or attachable) member 248 comprising the porous material layer 114, with detachment of the detachable member 248 separating the porous material layer 114 from the support.

Such a detachable member 248 may comprise, in addition to the porous material layer 114, the above-described impermeable portion 146, e.g. comprising or in the form of a polymer film, with the at least one dirt inlet 142A being defined by an aperture or apertures in the impermeable portion 146.

Figure 26:
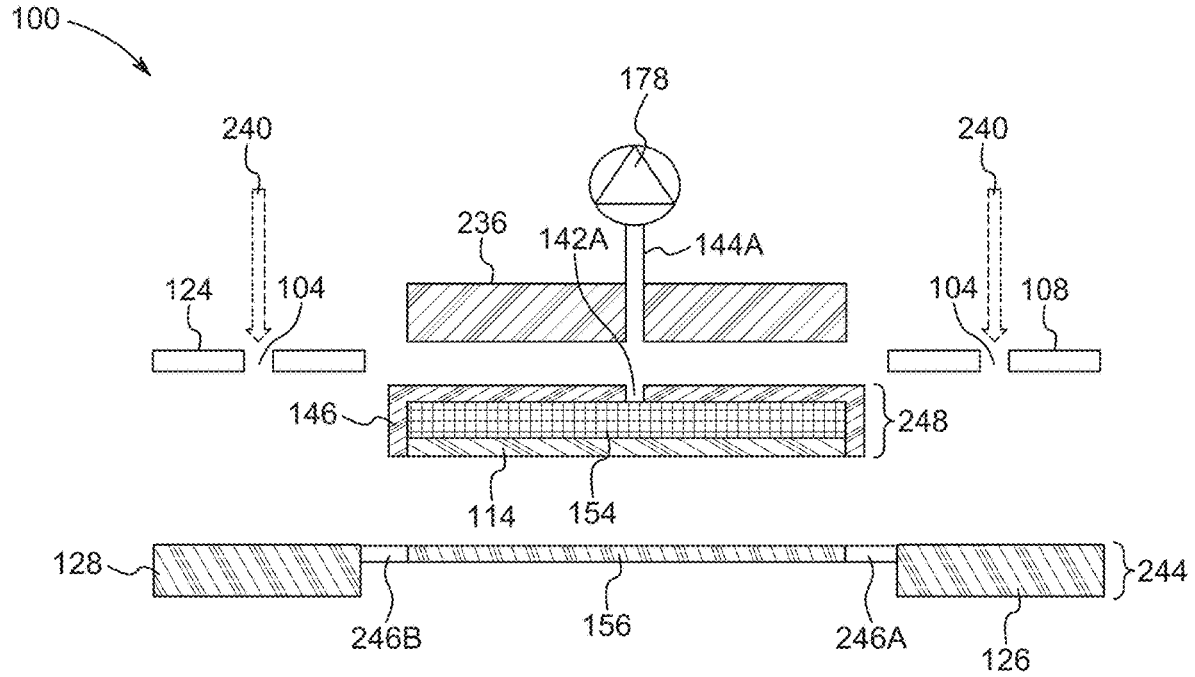

In some non-limiting examples, such as that shown in FIG. 26, the detachable (and/or attachable) member 248 further comprises the above-described liquid transporting support structure 154.

For example, the liquid transporting support structure 154 may be provided in the cavity 150 between the porous material layer 114 and the impermeable portion 146.

When the cleaner head 100 comprises both the detachable element 244 and the detachable member 248, the detachable element 244 may, for instance, be detachable independently of the detachable member 248, and the detachable member 248 may be detachable independently of the detachable element 244.

Figure 27:
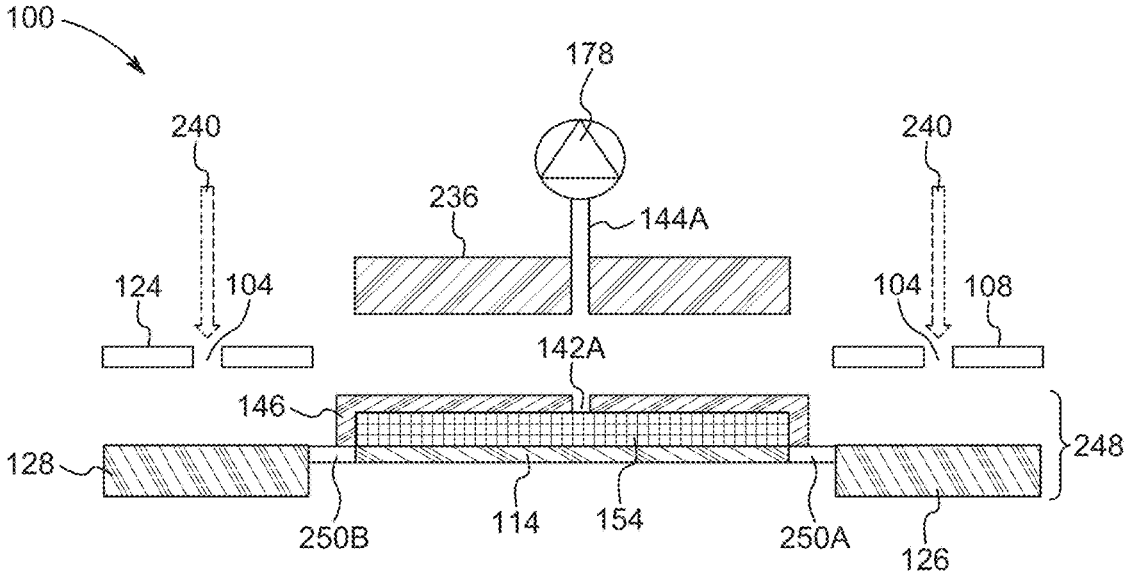

In some embodiments, such as that shown in FIG. 27, the detachable member 248 further comprises the cleaning liquid applicator material 126, 128. When, for example, the detachable member 248 comprises the impermeable portion 146, the cleaning liquid applicator material 126, 128 may be attached, e.g. adhered, to the impermeable portion 146.

In the non-limiting example shown in FIG. 27, the cleaning liquid applicator material 126, 128 comprises the above-described first and second applicator portions 126, 128, with a first connection 250A connecting a first side of the impermeable portion 146 to the first applicator portion 126, and a second connection 250B connecting a second side of the impermeable portion 146 to the second applicator portion 128.

Figure 28:
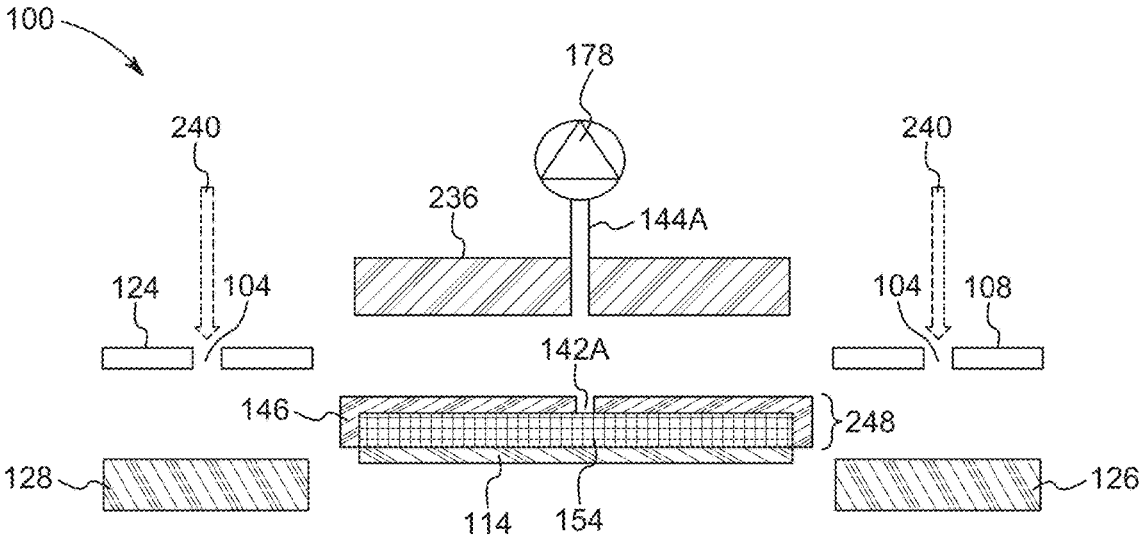

FIG. 28 schematically depicts an exemplary cleaner head 100 comprising the detachable member 248 not including the cleaning liquid applicator material 126, 128. However, the cleaning liquid applicator material 126, 128 is nonetheless detachable, with each of the first and second applicator portions 126, 128 in this example being detachable from the cleaning liquid outlets 104 independently of each other and independently of the detachable member 248.

More generally, the present disclosure provides the attachable (and/or detachable) member 248 per se. The attachable member 248 may be suitable for attaching to a wet cleaning apparatus having an underpressure generator 178. In at least some embodiments, the attachable member 248 comprises a porous material layer 114; and at least one dirt inlet 142A, 142B to which the underpressure generator 178 is fluidly connectable when the attachable member 248 is attached to the wet cleaning apparatus, with a liquid pick-up region PR of the porous material layer 114 being delimited by sealing attachment of the porous material layer 114 around the at least one dirt inlet 142A, 142B.

Such an attachable member 248 may enable replacement of the porous material layer 114 without requiring re-sealing of the porous material layer 114 to the dirt inlet(s) 142A, 142B.

In some embodiments, the attachable member 248 comprises an impermeable portion 146, and the at least one dirt inlet 142A, 142B is defined by an aperture or apertures provided in the impermeable portion 146 and/or between the impermeable portion 146 and the porous material layer 114. Such an attachable member 248 may enable replacement of the porous material layer 114 without requiring re-sealing of the impermeable portion 146 to the porous material layer 114.

In some embodiments, the at least one dirt inlet 142A, 142B is exposed to a cavity 150 between the porous material layer 114 and the impermeable portion 146, with a liquid transporting support structure 154 being arranged in the cavity 150, and providing one or more flow paths in the liquid pick-up region PR between the porous material layer 114 and the at least one dirt inlet 142A, 142B.

The wet cleaning apparatus, e.g. the cleaner head 100 included in the wet cleaning apparatus, may comprise at least one cleaning liquid outlet 104 through which cleaning liquid is deliverable, as previously described. When the at least one dirt inlet of the attachable member 248 is fluidly connected to the underpressure generator 178, the liquid pick-up region PR may be arranged relative to each of the at least one cleaning liquid outlet 104 such that the liquid pick-up region PR is bypassed by the cleaning liquid delivered towards the surface to be cleaned 218.

Figure 29:
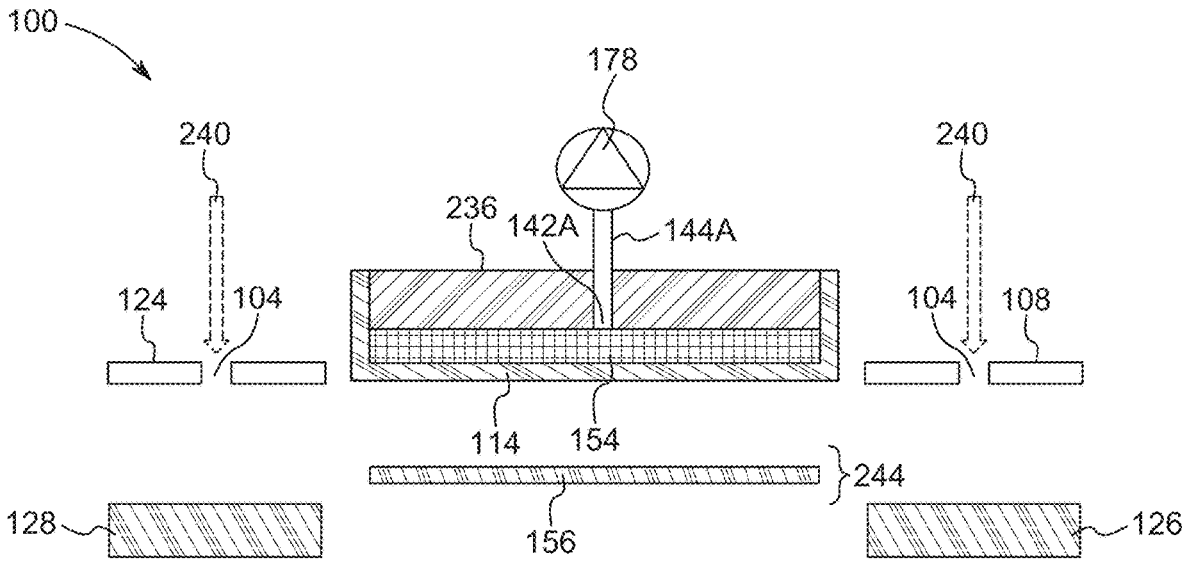

FIG. 29 schematically depicts an exemplary cleaner head 100 comprising the detachable element 244, which detachable element 244 consists in this example of the one or more further porous material layers 156. Moreover, in this non-limiting example, each of the first and second applicator portions 126, 128 in this example is detachable from the cleaning liquid outlets 104 independently of each other and independently of the detachable element 244.

Figure 30:
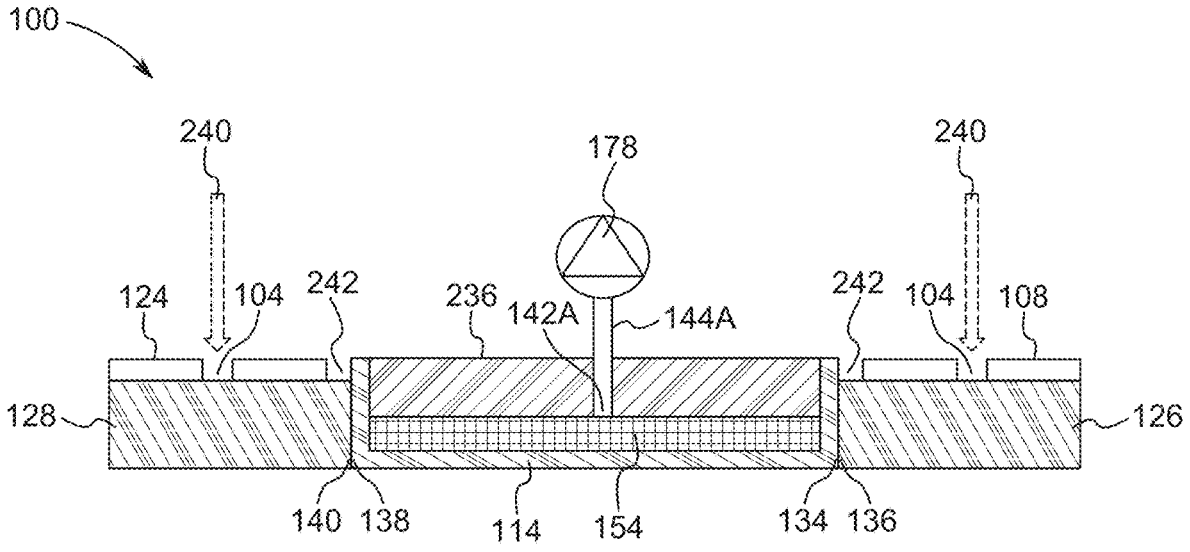

FIG. 30 shows an exemplary cleaner head 100 in which the porous material, in this case the porous material layer 114, contacts the cleaning liquid applicator fabric 126, 128. As previously explained, this configuration may assist to prevent an excess of cleaning liquid building up in the cleaning liquid applicator material 126, 128, and thus may assist to minimise excessive wetting of the surface to be cleaned 218, for instance by dripping of the cleaning liquid from the cleaning liquid applicator material 126, 128 onto the surface to be cleaned 218.

In this particular example, enhanced control over the wetness of the cleaning liquid applicator material 126, 128 may be achieved due to the edge portion 134 of the porous material layer 114 abutting an opposing edge portion 136 of the cleaning liquid applicator material 126, 128.

More specifically, in this non-limiting example the cleaning liquid applicator material 126, 128 comprises the first applicator portion 126 and the second applicator portion 128, such that the opposing edge portion 136 of the cleaning liquid applicator material is included in the first applicator portion 126, as shown. Moreover, in this example the further edge portion 138 of the porous material layer 114 abuts a further opposing edge portion 140 of the second applicator portion 128.

The liquid pick-up region PR of the porous material layer 114 (delimited by sealing attachment of the porous material layer 114 around the, e.g. each of the, at least one dirt inlet 142A, 142B) is nonetheless arranged relative to each of the cleaning liquid outlets 104 in the example shown in FIG. 30 such as to allow the cleaning liquid to bypass the liquid pick-up region PR. In this respect, the cleaning liquid outlets 104 in this example are arranged in dispensing parts, in this example in the form of cleaning liquid distribution strips 108, 124, which are spatially separated from the porous material layer 114. The latter is reflected by the gaps 242, e.g. air gaps 242, provided between the porous material layer 114 and the dispensing parts 108, 124.

It is reiterated that the porous material 168, including the porous material layer 114, may be distinguished from the cleaning liquid applicator material 126, 128 by the porous material 168 being more dense, e.g. due to the tighter weaving of the microfiber fabric, than the cleaning liquid applicator material 126, 128.

Figure 31:
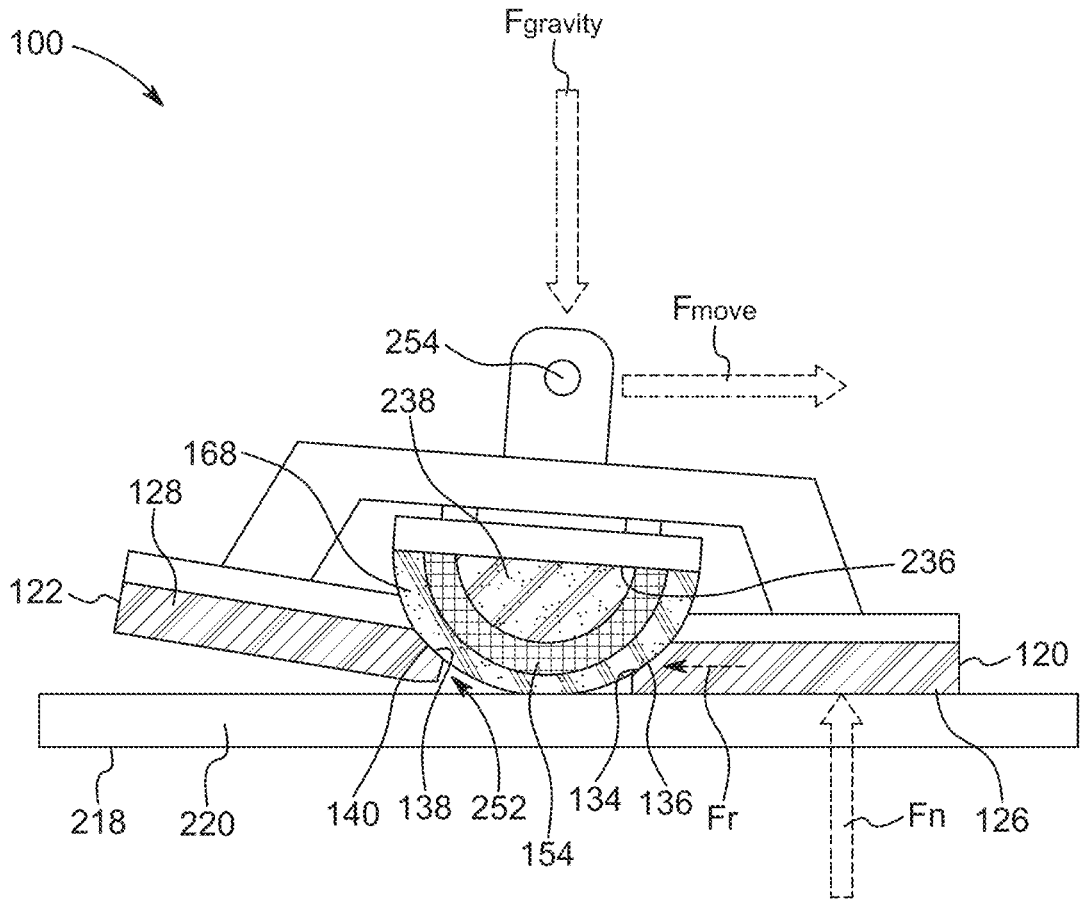
FIG. 31 schematically depicts an exemplary cleaner head which is rockable on a protruding element so as to bring a portion of the underside of the cleaner head into contact with a surface to be cleaned.

In some embodiments, such as that shown in FIG. 31, the cleaner head 100 comprises the portion 120 for facing the surface to be cleaned 218, with a protruding element 252 being mounted adjacent the portion 120. The protruding element 252 is thus an element mounted separately with respect to the portion 120. The protruding element 252 protrudes from the cleaner head 100 in the direction of the surface to be cleaned 218. In this manner, the cleaner head 100 can be rocked on the protruding element 252 in a first direction to cause the portion 120 to contact the surface to be cleaned, and rocked on the protruding element 252 in a second direction opposite to the first direction to cause the portion 120 to be separated from the surface to be cleaned 218, as previously explained.

In some embodiments, such as that shown in FIG. 31, the cleaner head 100 comprises the support member 236, e.g. a rigid support member 236, and the protruding element 252 is mounted via attachment to the support member 236.

It is noted that the cleaner head 100 can be attached or may be attachable to a suitable handle (not visible) to assist moving the cleaner head 100. To this end, the cleaner head 100 may comprise a coupling point 254 to which such a handle may be coupled, e.g. pivotably coupled.

Referring to FIG. 31, movement of the cleaner head 100 over the surface to be cleaned 218 by application of a force, $F_{move}$, may not be without resistance. The weight of the cleaner head 100, $F_{gravity}$, and/or the user pressing the cleaner head 100 towards the surface to be cleaned 218 may create a force, $F_n$, normal to the surface to be cleaned 218.

The cleaner head 100 may be wet, and therefore may operate in a viscous friction regime and a dry regime; the former resulting in a viscous friction force, $F_v$, and the latter resulting in coulombic friction, $F_c$, governed by the normal force, $F_n$, and the coefficient of friction, f. The resulting resistance force, $F_r$, is approximated in the following equation.

$$Fr = Fc + Fv = Fn * f + \mu * A * \frac{\partial u}{\partial y}$$

where the forces $F_r$, $F_v$, $F_c$ and $F_n$ are in Newtons; μ is the dynamic viscosity in Pa·s; A is the area of contact in $m^2$; u is the velocity in m/s; and y is the thickness of liquid layer in m.

The above equation shows that both a larger area of contact, A, and a liquid layer whose thickness, y, is tending to zero may increase the viscous friction term, thereby increasing the resulting resistance force $F_r$.

It is further noted that the relatively large contact area, A, that is needed for effective liquid pick-up on uneven surfaces to be cleaned 218, may result in a relatively high resistance force $F_r$, especially on relatively flat/smooth surfaces to be cleaned 218.

Hence, in at least some embodiments, the protruding element 252 comprises the porous material 168. Resistance to motion of the cleaner head 100 across the surface to be cleaned may therefore be lessened due to the limited area of contact A between the porous material 168 and the surface to be cleaned 218.

The porous material layer 114 of the porous material 168 may be included in the protruding element 252.

In some embodiments, the liquid pick-up region PR of the porous material layer 114 is included in the protruding element 252 and terminates between the protruding element 252 and the portion 120. In this manner, the area of the porous material layer 114 to which suction is applied is confined to the protruding element 252, thereby assisting to alleviate resistance to motion.

Alternatively or additionally, the at least one dirt inlet 142A, 142B may be defined in the protruding element 252. Thus, suction may be applied to the part of the cleaner head 100, in other words the protruding element 252, whose contact with the surface to be cleaned 218 is lessened, e.g. due to its rocking function.

In embodiments in which the cleaner head 100 comprises the portion 120 and a further portion 122 for facing the surface to be cleaned 218, the protruding element 252 may be mounted between the portion 120 and the further portion 122. In this way, the cleaner head 100 can be rocked forwards on the protruding element 252 to cause the portion 120 to contact the surface to be cleaned 218, as shown in FIG. 31, and backwards to cause the further portion 122 to contact the surface to be cleaned 218.

In such embodiments, the liquid pick-up region PR of the porous material layer 114 may extend between the portion 120 and the further portion 122, and terminate between the protruding element 252 and the portion 120, and between the protruding element 252 and the further portion 122.

In the non-limiting example shown in FIG. 31, the abutting opposing edge portions 134, 136 of the porous material 168 and the cleaning liquid applicator material 126, 128 are positioned between the protruding element 252 and the portion 120. In this manner, excess cleaning liquid caused to be squeezed from the cleaning liquid applicator material 126, 128 between the protruding element 252 and the cleaning liquid applicator material 126, 128, e.g. by rocking of the cleaner head 100, may be efficiently transported into the dirt inlet(s) 142A, 142B via the porous material 168.

In particular, the portion 120 shown in FIG. 31 comprises the first applicator portion 126, and the further portion 122 comprises the second applicator portion 128. Moreover, the abutting opposing edge portions 134, 136 of the porous material 168 and the first applicator portion 126 in this example are positioned between the protruding element 252 and the portion 120, and the abutting opposing further edge portions 138, 140 of the porous material 168 and the second applicator portion 128 are positioned between the protruding element 252 and the further portion 122. Thus, excess cleaning liquid caused to be squeezed from the cleaning liquid applicator material 126, 128 between the protruding element and the first applicator portion 126, and between the protruding element and the second applicator portion 128, e.g. by rocking of the cleaner head 100 forwards and backwards respectively, may be efficiently transported into the dirt inlet(s) 142A, 142B via the porous material 168.

In some embodiments, such as that shown in FIG. 31, the protruding element 252 has a curved surface arranged to contact the surface to be cleaned 218.

Such a curved, e.g. rounded, surface of the protruding element 252 may further assist to minimise the area of contact of the protruding element 252 with the surface to be cleaned 218, and thereby assist to minimise resistance to motion of the cleaner head 100 across the surface to be cleaned 218.

The curved surface of the protruding element 252 may, for example, curve between the portion 120 and further portion 122, as shown in FIG. 31.

In some embodiments, the protruding element 252 comprises the above-described elastomeric material 238 on which the porous material 168 is arranged. The elastomeric material 238 can, for instance, be or comprise silicone rubber and/or have a hardness less than 50 Shore A, preferably less than 20 Shore A, most preferably less than 10 Shore A.

Referring to FIG. 31, the elastomeric material 238 may be arranged between the support member 236, e.g. the rigid support member 236, and the porous material 168.

The resilient deformation of such an elastomeric material 238 may lessen the risk of damage to the porous material 168 should, for example, a relatively hard protrusion be present on the surface to be cleaned 218 which comes into contact with the porous material 168. Alternatively or additionally, the elastomeric material 238 may assist the porous material 168 to follow any contours of the surface to be cleaned 218.

Alternatively or additionally, the protruding element 252 may be resiliently mounted adjacent the portion 120. For example, the protruding element 252 may be spring-mounted to the support member 236. This may assist the porous material 168 to follow any contours of the surface to be cleaned 218, thereby facilitating liquid pick-up.

In embodiments in which the elastomeric material 238 is included in the protruding element 252, the curvature of a curved surface of the elastomeric material 238, e.g. arcing between the portion 120 and the further portion 122, may be followed by the porous material 168 to provide the curved surface of the protruding element 252.

Whilst not visible in FIG. 31, the protruding element 252 may further comprise the above-described impermeable portion 146 comprising or in the form of a polymer film sealed onto the porous material layer 114 and around the dirt inlets 142A, 142B. In such an example, the underpressure present behind the porous material 168 during use of the cleaner head 100 may not be present in the elastomeric material 238, but rather is contained within the sealed cavity 150 between the porous material layer 114 and the impermeable portion 146. This may assist to ensure that the elastomeric material 238 is substantially unaffected by the underpressure, particularly in examples in which the elastomeric material 238 is itself porous and may therefore otherwise be prone to compaction due to the underpressure.

In other non-limiting examples, the elastomeric material 238 is itself non-porous, such that the elastomeric material 238 can be included in the impermeable portion 146 sealed onto the porous material layer 114 of the porous material 168, e.g. as described above in relation to FIG. 18.

In the non-limiting example shown in FIG. 31, the above-described liquid transporting support structure 154 is also provided between the porous material 168, in particular the porous material layer 114, and the impermeable portion 146. The liquid transporting support structure 154 can be defined by or include, for example, one or more mesh layers and/or a surface pattern on and/or in the surface, e.g. curved surface, of the elastomeric material 238.

More generally, the protruding element 252 can comprise a liquid transporting support structure 154, e.g. arranged between the porous material layer 114 and the at least one dirt inlet 142A, 142B.

The porous material 168 may be arranged on the elastomeric material 238, e.g. on a curved surface of the elastomeric material 238, in any suitable manner.

Figure 32A:
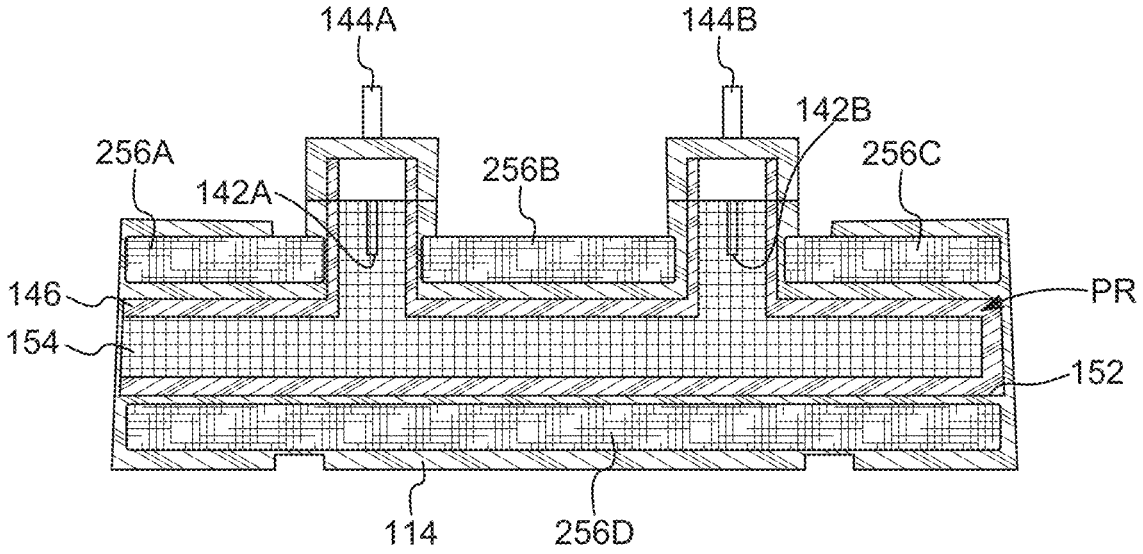
FIG. 32A schematically depicts an example of sealing attachment of the porous material layer around the dirt inlets.
Figure 32B:
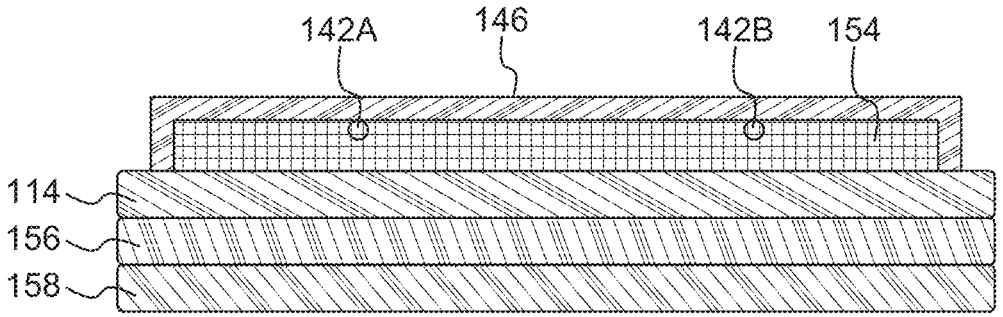
FIG. 32B provides a schematic cross-sectional view of the exemplary sealing attachment shown in FIG. 32A.

FIGS. 32A and 32B schematically depict an example of sealing attachment of the porous material layer 114 around the dirt inlets 142A, 142B to define the liquid pick-up region PR. Further evident in FIGS. 32A and 32B are the impermeable portion 146, in this case in the form of a polymer film, and the liquid transporting support structure 154, in this case in the form of a mesh or a plurality of stacked mesh layers. The porous material 168 in this example comprises, or is defined by, the porous material layer 114 and the further porous material layers 156, 158. Thus, a laminate comprises the further porous material layers 156, 158, the porous material layer 114, the liquid transporting support structure 154, and the impermeable portion 146, with the tubes 144A, 144B providing the dirt inlets 142A, 142B being partially trapped between the impermeable portion 146 and the porous material layer 114.

In the non-limiting example shown in FIGS. 32A and 32B, the impermeable portion 146, the porous material layer 114, and the further porous material layers 156, 158 extend beyond the liquid transporting support layer 154 in the direction of the tubes 144A, 144B. The seal 152, in this case a heat seal, also extends beyond the liquid transporting support layer 154 in the direction of the tubes 144A, 144B.

The seal 152, i.e. an airtight seal, is provided between the porous material layer 114 and the impermeable portion 146 by introducing clay in the area between the porous material layer 114 and the impermeable portion 146 through which the tubes 144A, 144B are led. In this example, a piece of tape is then wound around the porous material layer 114, impermeable portion 146, tubes 144A, 144B and the clay, to envelope the clay, to avoid it sticking to another object.

This laminate may be sufficiently pliable to be arranged on a curved surface of, for instance, the elastomeric material 238. Moreover, the laminate may, for instance, be provided with a suitable fastener or fasteners 256A-D, in this case in the form of Velcro® strips, for securing the laminate in the cleaner head 100.

Figure 33A:
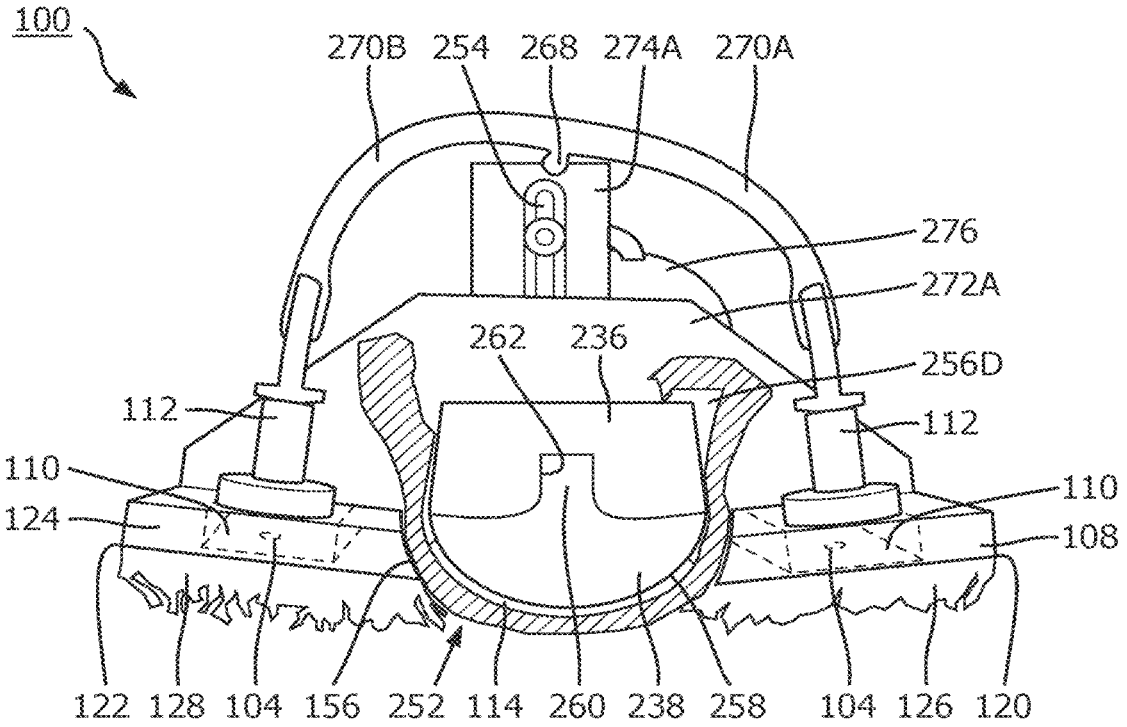
FIG. 33A provides a view of an end of a cleaner head according to an example.
Figure 33B:
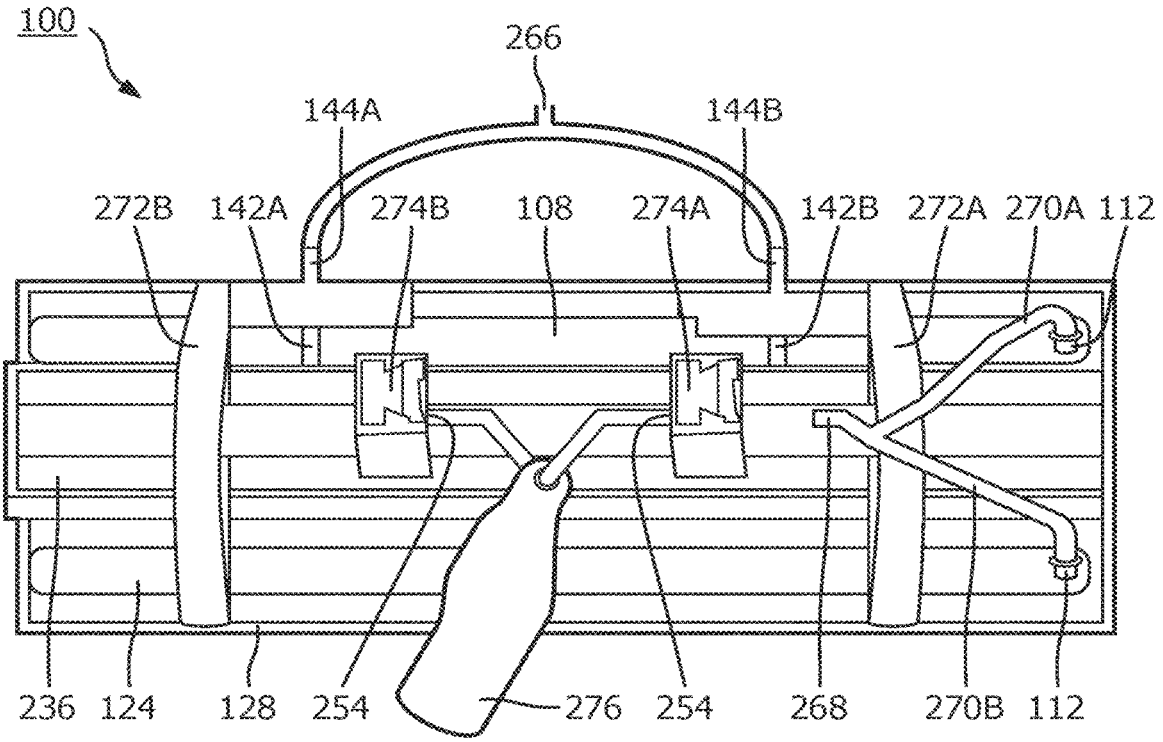
FIG. 33B provides a view of a top side of the cleaner head shown in FIG. 33A.

Turning to the non-limiting example shown in FIGS. 33A and 33B, a laminate similar to that described above in relation to FIGS. 32A and 32B, comprising the porous material layer 114 and a first further porous material layer 156 is arranged on the curved surface 258 of the elastomeric material 238, and secured to the support member 236 via the fastener(s) 256A-D, e.g. Velcro®. Thus, the protruding element 252 in this example comprises the elastomeric material 238 and the porous material layers 114, 156.

Due to the porous material layers 114, 156 following the curvature of the curved surface 258 of the elastomeric material 238 in this example, the protruding element 252 itself comprises a curved surface arranged to contact the surface to be cleaned 218.

In the non-limiting example shown in FIGS. 33A and 33B, the protruding element 252 is mounted adjacent the portion 120 (and in particular between the portion 120 and the further portion 122 in this example) by the elastomeric material 238 being attached to the support member 236 of the cleaner head 100. In this non-limiting example, this attachment is achieved at least partly by the elastomeric material 238 comprising a projection 260 which is received within and engages a slot 262 defined in the support member 236. The projection 260 may, for instance, be a push-fit in the slot 262.

FIG. 33A shows deformation of the cleaning liquid applicator material 126, 128 to bring at least part of the cleaning liquid applicator material 126, 128 into contact with the porous material. In this way, some of the cleaning liquid can be transferred from the cleaning liquid applicator material 126, 128 to the porous material in a particularly controlled manner.

In the non-limiting example shown in FIG. 33A, the cleaning liquid applicator material 126, 128 comprises tufts formed from fibers, and a backing layer (not visible) supporting the tufts. As shown, such tufts may be deformable to contact the porous material, e.g. upon contact with the surface to be cleaned and/or upon being wetted by liquid, e.g. water.

In some embodiments, a wet cleaning apparatus comprises the cleaner head 100, and an underpressure generator 178 (not visible in FIGS. 33A and 33B) fluidly connected to the at least one dirt inlet 142A, 142B. This fluid connection may be made via the tubes 144A, 144B, which, in this particular non-limiting example, extend to a single tube leading to the underpressure generator at a bifurcation point 266.

The underpressure generator 178 may, for example, be or comprise a pump, such as a positive displacement pump (technical benefits of the latter being described in more detail herein below). Any suitable pump can be used, provided that the pump is capable of withstanding the operating pressures selected for the wet cleaning apparatus, e.g. about 5000 Pa (see Table 1 above).

In some embodiments, the underpressure generator 178 is configured to supply suction by providing a flow in the range of 40 to 2000 $cm^3$/minute, more preferably 80 to 750 $cm^3$/minute, and most preferably 100 to 300 $cm^3$/minute.

Such a flow, i.e. flow rate, may capitalise on the underpressure-maintaining capability of the porous material 168, and may ensure sufficient liquid pick-up whilst limiting energy consumption.

The wet cleaning apparatus may also include a dirty liquid collection tank (not visible in FIGS. 33A and 33B). In such embodiments, the underpressure generator may be arranged to draw liquid from the at least one dirt inlet 142A, 142B to the dirty liquid collection tank.

In such embodiments, the dirty liquid collection tank can be arranged in any suitable manner relative to, e.g. upstream or downstream of, the underpressure generator 178.

In some embodiments, the wet cleaning apparatus comprising the cleaner head 100 comprises a cleaning liquid supply (not visible in FIGS. 33A and 33B) for supplying cleaning liquid to the cleaner head 100 for delivery towards the surface to be cleaned by the at least one cleaning liquid outlet(s) 104. Such a cleaning liquid supply may, for example, comprise a cleaning liquid reservoir and a delivery arrangement, e.g. a delivery arrangement comprising a pump, for transporting the cleaning liquid to and through the at least one cleaning liquid outlet 104.

The cleaning liquid supply and the at least one cleaning liquid outlet 104 may be configured to provide a continuous delivery of the cleaning liquid towards the surface to be cleaned 218.

The cleaning liquid supply and the underpressure generator 178 may, for instance, be configured such that the flow of the cleaning liquid delivered through the at least one cleaning liquid outlet 104 is lower than the flow provided to the at least one dirt inlet 142A, 142B by the underpressure generator 178. This may assist to ensure that the surface to be cleaned 218 does not become excessively wet with the cleaning liquid. For example, the flow of cleaning liquid may be in the range of 20 to 60 $cm^3$/minute, and the flow provided by the underpressure generator 178 may be in the range of 40 to 2000 $cm^3$/minute, more preferably 80 to 750 $cm^3$/minute, and most preferably 100 to 300 $cm^3$/minute.

If a positive displacement pump is employed as the underpressure generator 178, at 1 or 2 liter/minute flows, such a pump may become relatively bulky and noisy, hence lower flow rates may assist in keeping the wet cleaning apparatus relatively small, quiet and lightweight.

In principle, a flow rate of the underpressure generator 178 which is equal to the flow rate of the cleaning liquid provided by the cleaning liquid supply may suffice.

However, this may risk relatively significant disturbance to the system's equilibrium (requisite underpressure) if, for instance, a spill of water is encountered by the porous material 168 (e.g. freshly attached). For example, a 50 $cm^3$ puddle of water encountered by the wet cleaning apparatus having a cleaning liquid flow rate of 40 $cm^3$/minute and a flow rate provided by the underpressure generator 178 of 50 $cm^3$/minute may mean that it would take about 5 minutes to take in all the water (resulting in a 5 minute drop in underpressure, hence a 5 minute period in which the floor stays significantly more wet (because the puddle keeps on being spread). On the other hand, a 250 $cm^3$/minute flow rate provided by the underpressure generator 178 may reduce this to a 14 second period. The flow rate provided by the underpressure generator 178 being above the flow rate of the cleaning liquid provided by the cleaning liquid supply may permit the system to revert to equilibrium more quickly after such a disturbance.

In the non-limiting example shown in FIGS. 33A and 33B the cleaning liquid is delivered, e.g. from the above-mentioned cleaning liquid reservoir, via a tube 268 which bifurcates to supply the cleaning liquid to the cleaning liquid outlets 104 of the cleaning liquid distribution strip 108 via a first tube 270A, and to the cleaning liquid outlets 104 of the further cleaning liquid distribution strip 124 via a second tube 270B.

In embodiments in which the wet cleaning apparatus comprises the cleaner head 100, the underpressure generator, and the cleaning liquid supply, the underpressure generator may be configured to provide suction to the at least one dirt inlet 142A, 142B at the same time as, in other words simultaneously to, the cleaning liquid supply supplying the cleaning liquid to and through the at least one cleaning liquid outlet 104.

In the exemplary cleaner head 100 shown in FIGS. 33A and 33B, the cleaning liquid distribution strips 108, 124 are joined to each other and to the support member 236 by the joining members 272A, 272B.

In some embodiments, the wet cleaning apparatus includes a handle (not visible in FIGS. 33A and 33B) coupled or attachable to the cleaner head 100. Such a handle may facilitate movement of the cleaner head 100.

In the non-limiting example shown in FIGS. 33A and 33B, the coupling point 254 to which such a handle may be coupled comprises a vertically extending slot for adjusting the height at which the coupling is provided. In this example, such a coupling point 254 is provided in each of a pair of mounts 274A, 274B between which a handle engagement member 276 is pivotally mounted. The handle engagement member 276 may engage with, e.g. receive, the end of the handle.

In some embodiments, the handle may support or include at least part of the underpressure generator 178 fluidly connected to the at least one dirt inlet 142A, 142B and/or the dirty liquid collection tank. Alternatively or additionally, at least part of the cleaning liquid supply, e.g. the cleaning liquid reservoir and/or the delivery arrangement, may be supported by or included in the handle.

Figure 33C:
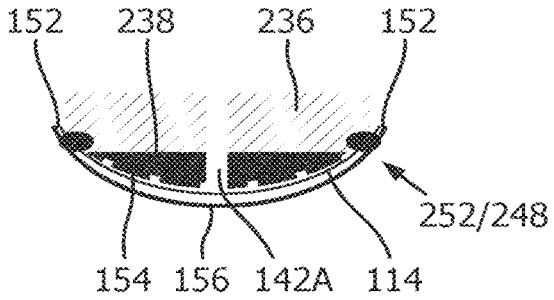
FIG. 33C provides a schematic cross-sectional view of a protruding element/detachable member according to an example.
Figure 33D:
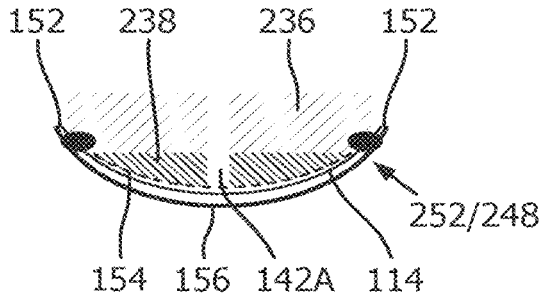
FIG. 33D provides a schematic cross-sectional view of a protruding element/detachable member according to another example.

In some embodiments, such as that shown in FIGS. 33C and 33D, the above-described attachable member 248 (in which the liquid pick-up region PR of the porous material layer 114 is delimited by sealing attachment of the porous material layer 114 around the at least one dirt inlet 142A, 142B) comprises (or defines) the protruding element 252.

In the non-limiting example shown in FIG. 33C, the protruding element 252 comprises the elastomeric material 238 on which the porous material layer 114 is arranged. In this particular example, the porous material layer 114 is sealingly attached to the support member 236 via the seals 152, e.g. heat seals.

In this manner, the porous material layer 114 is sealingly attached to the dirt inlet(s) 142A, which dirt inlet(s) 142A is or are, in this example, defined in, i.e. delimited by, the support member 236 and the elastomeric material 238. In this particular example, the dirt inlets 142A, 142B are in the form of channels extending through the support member 236 and the elastomeric material 238.

More generally, the support member 236 to which the porous material layer 114 is sealingly attached may be included in the attachable member 248. In such an example, the support member 236 can be attachable to a support included in the (remainder of the) cleaner head 100.

The attachable member 248 can be attached to the support in any suitable manner, such as by the attachable member 248, e.g. the support member 236, having a ridge member which push-fits into a slot defined in the support, or by the support having such a ridge member which push-fits into a slot defined in the attachable member 248, e.g. in the support member 236.

A further porous material layer 156 is also included in the protruding element 252 in the example shown in FIG. 33C. It is noted that the process of heat sealing, e.g. via ultrasonic welding, the porous material layer 114 to the plastic support member 236 also results in the further porous material layer 156 becoming adhered to the porous material layer 114.

The examples shown in FIGS. 33C and 33D differ from each other in that the liquid transporting support structure 154 shown in FIG. 33C is defined by a surface pattern arranged on and/or in the surface of the elastomeric material 238, whereas the liquid transporting support structure 154 shown in FIG. 33D is in the form of a mesh layer.

Figure 33E:
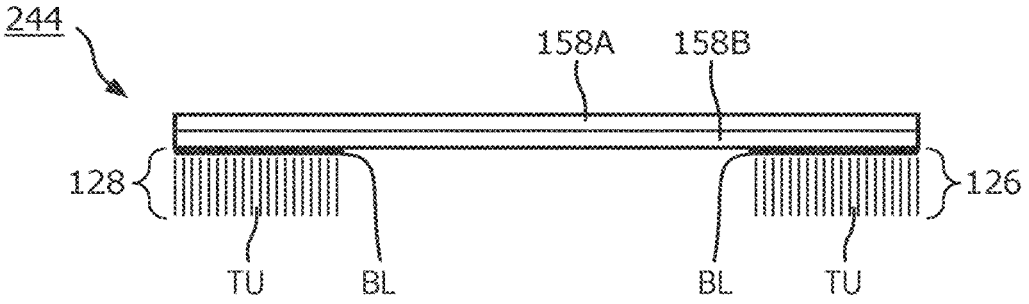
FIG. 33E provides a schematic cross-sectional view of an exemplary detachable element comprising further porous material layer(s) and a cleaning liquid applicator material.

FIG. 33E shows an exemplary detachable element 244 comprising further porous material layers 158A, 158B and the cleaning liquid applicator material 126, 128. This example has some similarity with the detachable element 244 shown in FIG. 26, other than in this case the cleaning liquid applicator material 126, 128 is mounted on the further porous material layers 158A, 158B.

It is noted that the further porous material layers 158A, 158B can be adhered to each other, e.g. via heat sealing, such as ultrasonic welding.

Further evident in FIG. 33E are the backing layer BL and tufts TU included in the cleaning liquid applicator material 126, 128. The backing layer BL supports the tufts TU, as previously described.

Figure 33F:
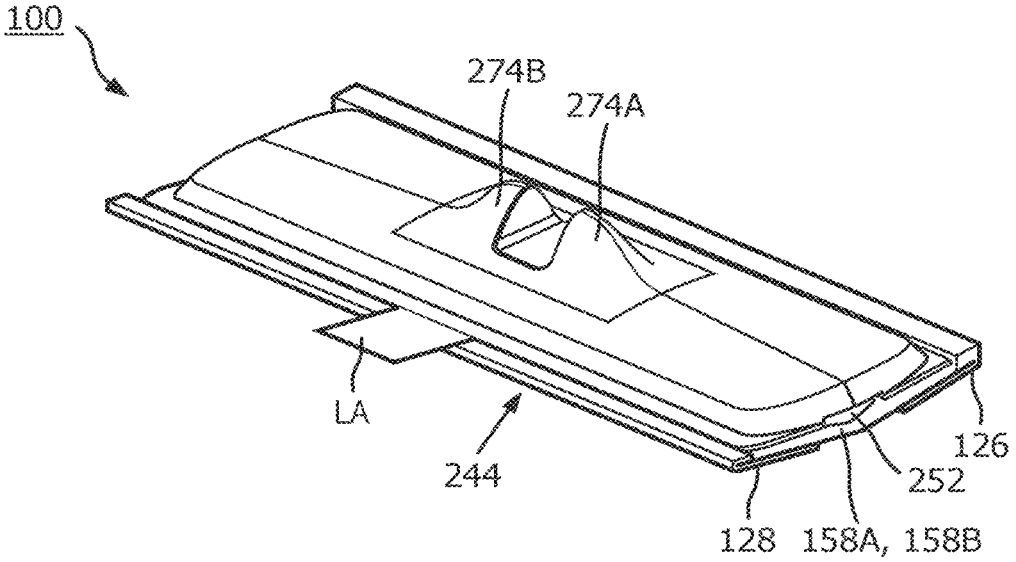
FIG. 33F provides a perspective view of a cleaner head comprising the protruding element/detachable member shown in FIG. 33C or 33D and the detachable element shown in FIG. 33E.

FIG. 33F provides a perspective view of a cleaner head 100 comprising the protruding element 252/attachable member 248 shown in FIG. 33C or 33D and the detachable element 244 shown in FIG. 33E. Thus, in this case the porous material 168 comprises the porous material layer 114 and the further porous material layer 156 included in the protruding element 252/attachable member 248, and the further porous material layer(s) 158A, 158B included in the detachable element 244.

The detachable element 244 can be detachably coupled to the remainder of the cleaner head 100 in any suitable manner, for example by the detachable element 244 comprising a set of shoes arranged along one lengthways side of the detachable element 244 and a Velcro® strip arranged on an opposing lengthways side. In such an example, the set of shoes each receive and engage a foot provided on one lengthways side of the remainder of the cleaner head 100, and the Velcro® strip can be joined to a complementary Velcro® strip arranged on an opposing lengthways side of the remainder of the cleaner head 100. This set of feet-set of shoes arrangement can assist to minimise unwanted movement of the detachable element 244 relative to the remainder of the cleaner head 100 in both widthways and lengthways directions.

Further evident in FIG. 33F is the label LA of the detachable element 244. This label may provide attachment/detachment and/or washing instructions for washing the detachable element 244 following its detachment from the remainder of the cleaner head 100.

More generally, a wet cleaning apparatus according to an aspect of the present disclosure comprises an underpressure generator arrangement, and a cleaner head 100 having at least one dirt inlet 142A, 142B, and a porous material 168 comprising a porous material layer 114 sealingly attached to the at least one dirt inlet 142A, 142B.

The cleaner head 100 may be, for example, according to any of the embodiments described herein.

The underpressure generator arrangement comprises an underpressure generator 178 having an underpressure generator outlet, with the underpressure generator 178 being activatable to provide a flow from the at least one dirt inlet 242A, 242B to and through the underpressure generator outlet, and deactivatable to cease the flow.

In at least some embodiments, the underpressure generator arrangement is configured to restrict the passage of fluid from the underpressure generator outlet towards the at least one dirt inlet 242A, 242B at least when the underpressure generator is deactivated.

The flow provided by the underpressure generator 178 may generate an underpressure in the at least one dirt inlet 142A, 142B. The porous material 168, in particular the wetted porous material 168, may assist to maintain the underpressure and liquid may be drawn through the porous material 168 and into the dirt inlet(s), as previously described.

Figure 34:
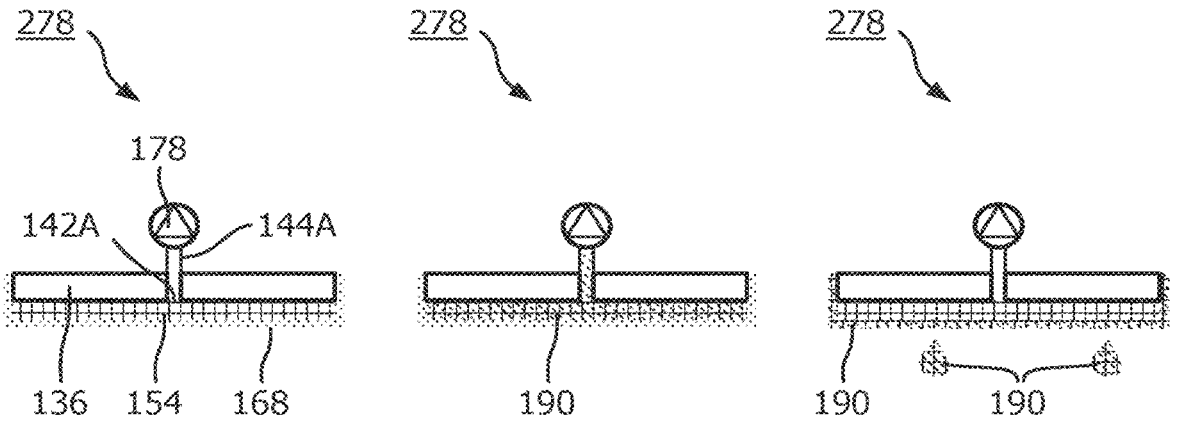
FIG. 34 schematically depicts an exemplary wet cleaning apparatus before (left hand pane), during (centre pane), and after (right hand pane) drawing liquid through the porous material.

FIG. 34 schematically depicts an exemplary wet cleaning apparatus 278 before (left hand pane), during (centre pane), and after (right hand pane) drawing liquid 190 through the porous material 168. The left hand pane of FIG. 34 can be regarded as depicting a fully dry system, e.g. at the beginning of a cleaning cycle. The centre pane of FIG. 34 shows the wet cleaning apparatus 278 in operation, during which liquid 190, e.g. water, in contact with the porous material 168 is transported therethrough in the direction of the dirt inlet(s) 142A. The surface to be cleaned 218 may therefore become dry or at least drier, but not all the liquid 190 may be transported away from the cleaner head 100, e.g. to a dirty liquid collection tank (not visible in FIG. 34) included in the wet cleaning apparatus 278. In this non-limiting example, some of the liquid 190 may remain in the flow path(s) of the liquid transporting support structure 154, as shown. During operation, this liquid 190 may be beneficial because it serves to keep the porous material 168 wet, even when no liquid 190 may be present on the surface to be cleaned 218. The residual liquid 190 in the pores 192 of the porous material 168 assists to maintain the underpressure, as previously described. While the underpressure is being maintained in the dirt inlet(s) 142A, the liquid 190 remains on the dirt inlet(s) side of the porous material 168, as shown in the centre pane of FIG. 34.

However, when the underpressure generator 178 is deactivated, for example by being switched off after use of the wet cleaning apparatus 278, loss of the underpressure may be contributed to by fluid, e.g. ambient air, ingress via the underpressure generator outlet. This may cause liquid 190 to be released, for example to drip, from the porous material 168, as shown in the right hand pane of FIG. 34.

After cleaning, e.g. mopping of the surface to be cleaned, it may be undesirable for the liquid 190 to be released through the porous material 168 upon deactivation of the underpressure generator 178, e.g. back onto the surface to be (or having been) cleaned 218 and/or during transport of the wet cleaning apparatus 278 to its storage location.

For this reason, the underpressure generator arrangement may be configured to restrict, for example block, the passage of fluid, for example ambient air, from the underpressure generator outlet towards the dirt inlet(s) at least when the underpressure generator 178 is deactivated, for example when the underpressure generator 178 is switched off. This may alleviate problematic liquid release from the porous material 168, for instance following cleaning of the surface to be cleaned 218 and/or during stowing of the wet cleaning apparatus in a storage area after use.

Figure 35:
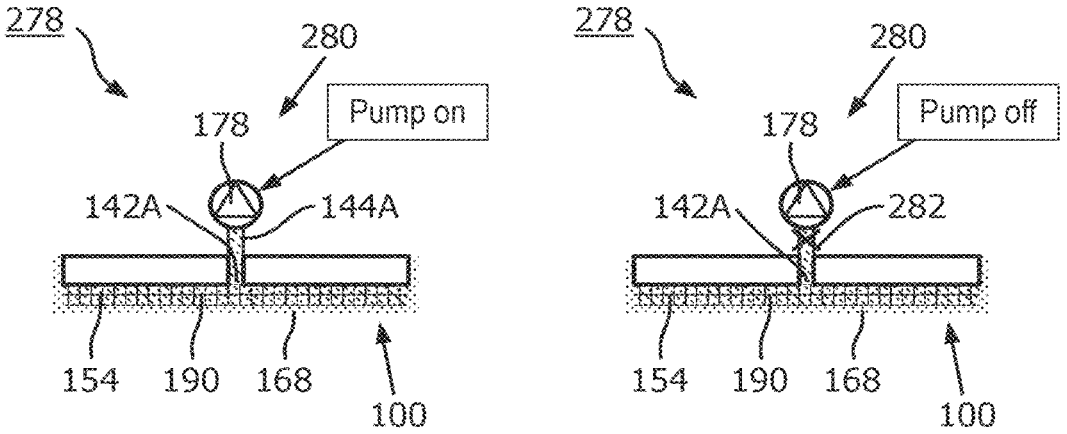
FIG. 35 schematically depicts an exemplary wet cleaning apparatus having an underpressure generator which is activated (left hand pane) and deactivated (right hand pane)

FIG. 35 schematically depicts an exemplary wet cleaning apparatus 278 comprising such an underpressure generator arrangement 280. In the left hand pane of FIG. 35, the underpressure generator 178, in this example a pump, is activated. This is denoted by "Pump on". In the right hand pane of FIG. 35, the underpressure generator 178 is deactivated, as denoted by "Pump off". In contrast to the liquid leakage described above in relation to FIG. 34, the passage of fluid from the underpressure generator outlet towards the dirt inlet(s) 142A is restricted, e.g. blocked, as denoted in FIG. 35 by the cross 282. In this way, the underpressure can be better maintained following deactivation of the underpressure generator 178, thereby alleviating problematic liquid release from the porous material 168.

Any suitable way of configuring the underpressure generator arrangement 280 to restrict the passage of fluid from the underpressure generator outlet towards the dirt inlet(s) 142A at least when the underpressure generator 178 is deactivated can be contemplated.

In some embodiments, the underpressure generator 178 itself is configured to restrict backflow of fluid, e.g. air, from the underpressure generator outlet in the direction of the dirt inlet(s) 142A when the underpressure generator 178 is deactivated.

Figure 36:
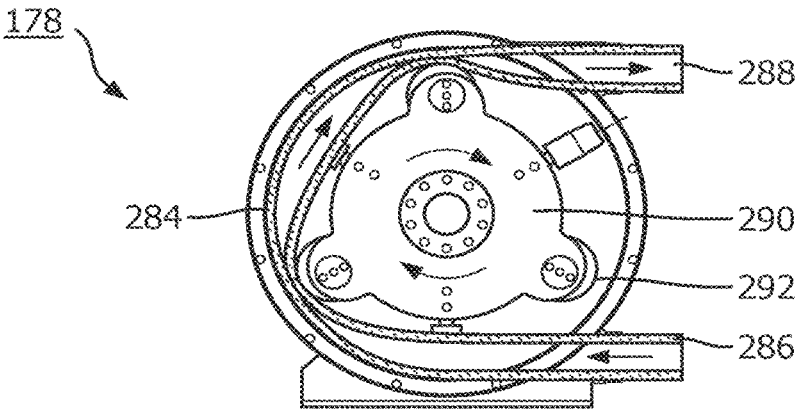
FIG. 36 schematically depicts an underpressure generator in the form of a peristaltic pump.

In some embodiments, such as that shown in FIG. 36, the underpressure generator 178 is or comprises a positive displacement pump. The design of such a positive displacement pump means that backflow of fluid, e.g. air, from the underpressure generator outlet, in other words pump outlet, in the direction of the dirt inlet(s) 142A is inherently restricted.

Examples of such a positive displacement pump include a peristaltic pump, a membrane pump, and a piston pump. Accordingly, the underpressure generator 178 may comprise, or consist of, one or more of a peristaltic pump, a membrane pump, and a piston pump.

Referring to FIG. 36, the depicted peristaltic pump may comprise a compressible hose 284 between the pump/underpressure generator inlet 286 and the pump/underpressure generator outlet 288 which is compressed in at least one position when the peristaltic pump is deactivated. Thus, backflow of fluid, e.g. air, from the pump outlet towards the dirt inlet(s) 142A may be restricted, e.g. blocked, when the peristaltic pump is deactivated. Selection of the peristaltic pump may thus minimise the loss of underpressure in the dirt inlet(s), and thereby minimise problematic liquid release to the outside of the cleaner head 100 via the porous material 168.

The peristaltic pump may, for instance, include a rotatable compressing shoe assembly 290 comprising at least one compressing shoe 292, with rotation of the compressing shoe assembly 290 and concomitant compressing of the compressible hose 284 by the at least one compressing shoe 292 providing the flow.

The above-mentioned membrane pump and piston pump use a similar type of construction in which the resting state of the pump, i.e. when the pump is deactivated, restricts backflow from the pump outlet 288 in the direction of the dirt inlet(s) 142A.

In some embodiments, e.g. as an alternative or in addition to the above-described positive displacement pump constituting the underpressure generator 178, the underpressure generator arrangement 280 comprises a valve assembly, e.g. represented by the cross 282 in FIG. 35, configured to restrict the passage of fluid from the underpressure generator outlet 288 towards the at least one dirt inlet 142A.

In the non-limiting example shown in FIG. 35, the valve assembly is configured to restrict said passage of fluid between the underpressure generator inlet 286 and the at least one dirt inlet 142A.

Alternatively or additionally, the passage of fluid may be restricted between the underpressure generator outlet 288 and the underpressure generator inlet 186, e.g. as described above in relation to the positive displacement pump being included in or defining the underpressure generator 178.

The valve assembly may have any suitable design. In some embodiments, the valve assembly is configured to, responsive to the underpressure generator 178 being deactivated, restrict said passage of air. This may be regarded as an "active" valve which is triggered to close the system (by restricting the passage of fluid from the underpressure generator outlet 288 towards the dirt inlet(s) 142A) by the underpressure generator 178 being deactivated.

In some embodiments, the valve assembly comprises a one-way valve configured to prevent fluid being transported in the direction of the at least one dirt inlet 142A. The one-way valve may be regarded as a "passive" valve. Such a one-way valve may be arranged to permit flow of fluid, e.g. air and/or liquid, away from the porous material 168, but prevent fluid, e.g. air and/or liquid, from returning towards the dirt inlet(s) 142A upon and after deactivation of the underpressure generator 178. Any suitable one-way valve design can be contemplated, such as a ball check valve.

In a non-limiting example, an additional porous material part, e.g. made of microfiber fabric, is arranged between the porous material layer 114 and the underpressure generator outlet 288. The additional porous material part can permit flow of fluid, e.g. air and/or liquid, away from the porous material layer 114, but restrict fluid, e.g. air and/or liquid, from returning towards the porous material layer 114 (at least) when the underpressure generator 178 is deactivated.

More generally, the underpressure generator 178 may be configured such that the flow, when the flow is being provided by the (activated) underpressure generator 178, is in the range of 40 to 2000 $cm^3$/minute, more preferably 80 to 750 $cm^3$/minute, and most preferably 100 to 300 $cm^3$/minute.

Such a flow, i.e. flow rate, may capitalise on the underpressure-maintaining capability of the porous material 168, and may ensure sufficient liquid pick-up whilst limiting energy consumption.

It is reiterated that the wet cleaning apparatus 278 may comprise a dirty liquid collection tank (not visible in FIGS. 35 and 36) for collecting the dirty liquid, with the underpressure generator arrangement 280 being arranged such that the flow to and through the underpressure generator outlet 288 draws the dirty liquid from the at least one dirt inlet 142A to the dirty liquid collection tank. In such embodiments, the above-described valve assembly can be arranged in any suitable manner relative to, e.g. upstream or downstream of, the dirty liquid collection tank.

In some embodiments, a sealed flow path is defined between the dirt inlet(s) 142A and the underpressure generator outlet 288.

This may assist to maintain the underpressure.

In alternative embodiments, fluid, e.g. air, ingress may be via one or more regions of the wet cleaning apparatus 278 other than the underpressure generator outlet 288 and pores 192 of the porous material 168.

However, in such alternative embodiments, the configuration of the underpressure generator arrangement 280 may nonetheless assist to maintain the underpressure by (at least) restricting the passage of fluid from the underpressure generator outlet 288 in the direction of the dirt inlet(s) 142A.

In some embodiments, the underpressure generator arrangement 280 comprises a valve assembly 282, e.g. the valve assembly 282 described above, positioned between the one or more regions and the dirt inlet(s) 142A thereby to restrict backflow from the one or more regions towards the dirt inlet(s) 142A. In such embodiments, the valve assembly 142A can, for instance, restrict the backflow from the one or more regions in addition to restricting the passage of fluid from the underpressure generator outlet 288 in the direction of the dirt inlet(s) 142A.

More generally, a wet cleaning apparatus according to another aspect of the present disclosure comprises an underpressure generator arrangement 280, and a cleaner head 100 having at least one dirt inlet 142A, 142B, and a porous material 168 covering the at least one dirt inlet 142A, 142B. In some embodiments, the porous material 168 comprises a porous material layer 114 sealingly attached to the at least one dirt inlet 142A, 142B. The cleaner head 100 may be, for example, according to any of the embodiments described herein. In this aspect, the underpressure generator arrangement 280 comprises an underpressure generator 178 configured to provide a flow inside the wet cleaning apparatus for drawing fluid into the at least one dirt inlet(s) through the porous material 168, with the underpressure generator arrangement 280 being configured to control the flow based on a pressure on the inside of the wet cleaning apparatus between the porous material 168 and the underpressure generator 178, e.g. in the at least one covered dirt inlet 142A, 142B.

By the underpressure generator arrangement 280 controlling the flow based on the pressure on the inside of the wet cleaning apparatus between the porous material 168 and the underpressure generator 178, fluid transport through the porous material 168 can be advantageously controlled. In some non-limiting examples, such control can minimise foam build-up in, and downstream of, the porous material 168.

In some embodiments, the underpressure generator arrangement 280 is configured to control the flow such that the pressure is maintained at or above a predetermined pressure threshold.

By controlling the flow such as to maintain the pressure at or above the predetermined threshold (in other words at or below an underpressure threshold), stable and efficient operation of the wet cleaning apparatus 278 may be facilitated. In particular, maintaining the pressure at or above the predetermined threshold may mean that the underpressure generator 178 can be operated more efficiently, for example by being intermittently deactivated/switched-off, thus taking advantage of the above-described capability of the porous material 168 to assist in maintaining the underpressure in the covered dirt inlet(s) 142A, 142B.

Control over the flow can also assist to control wetness of the surface to be cleaned, as previously described.

Figure 37A:
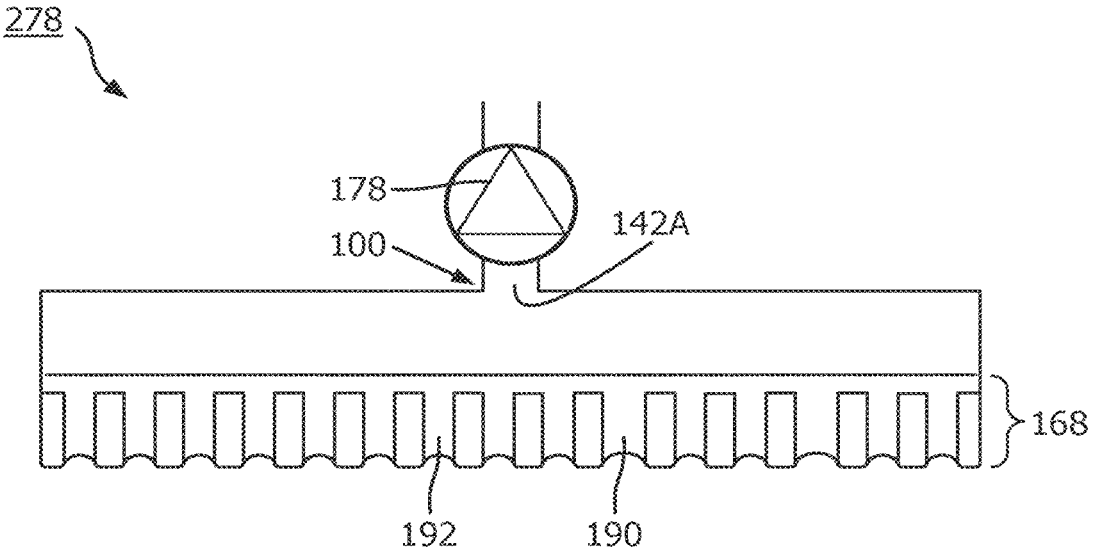
FIG. 37A schematically depicts the pores of the porous material layer of an exemplary wet cleaning apparatus.

FIG. 37A schematically depicts the pores 192, e.g. micropores 192, of the porous material layer 168 being filled with liquid 190, e.g. water. The thus retained liquid 190 can assist to maintain an underpressure in the dirt inlet(s) 142A, with or without a flow being applied by the underpressure generator 178, as previously described.

As also previously explained, each pore 192 of the porous material 168 may have a certain breaking pressure, at which the surface tension of the (residual) liquid 190 residing in the pore 192 can no longer withstand the internal underpressure, and gives way. When this happens, the pore 192 may no longer be effectively closed off by liquid contained therein, but may instead start transporting air into the dirt inlet(s) 142A.

A typical pump being used as the underpressure generator 178 may be, for example, a flow driven pump or positive displacement pump, such as a piston pump, and may move towards its maximum operating pressure, e.g. 20000 Pa, when the porous material 168 is blocked. The latter may be higher than the average breaking pressure of the porous material 168, e.g. about 5000 Pa, such that the porous material 168 may start, at a certain point, to permit air to pass therethough.

Figure 37B:
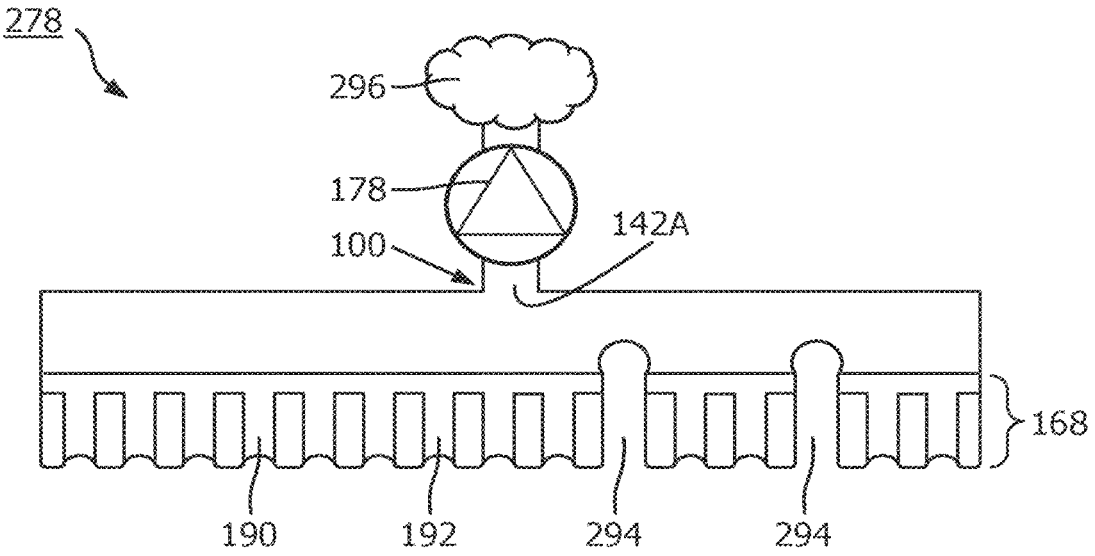
FIG. 37B schematically depicts foam build-up in the wet cleaning apparatus shown in FIG. 37A.

Operation with, for instance, pure water as the liquid 190 may pose few, if any, difficulties. An issue may, however, arise when a foaming detergent is included in the cleaning liquid 190. Referring to FIG. 37B, the broken pores 294 may start transporting air at the rate of the underpressure generator 178, e.g. pump, which can risk creating relatively large amounts of foam 296, which can, for instance, relatively quickly flood the dirty liquid collection tank (not visible in FIG. 37B).

In a specific non-limiting example, a pump of the above-mentioned cleaning liquid supply (not visible in FIG. 37B) delivers a flow of cleaning liquid of 40 $cm^3$/minute. With this, there may be only 40 $cm^3$ of cleaning liquid, e.g. water, available to pick up. The underpressure generator 178, e.g. pump, in this example delivers a flow of about 150 $cm^3$/min. This combination may generate at least (150 $cm^3$/minute-40 $cm^3$/minute=) 110 $cm^3$/minute of foam. When, for instance, a 400 $cm^3$ capacity dirty liquid collection tank is included in the wet cleaning apparatus 278, this can reach capacity in about 4 minutes (or 10 minutes with a 40 $cm^3$/minute pick-up rate).

This illustrates that rapid foam build-up can, if no remedial measures are taken, and particularly when aqueous detergent is included in the cleaning liquid, result in disruption to use of the wet cleaning apparatus 278. Such disruption can include frequent interruptions in cleaning to empty the dirty liquid collection tank.

Accordingly, the above-mentioned predetermined pressure threshold may, for example, be set to avoid the breaking pressure of at least some of the pores 192, e.g. the majority or all of the pores, of the porous material 168 being reached. This may assist to avoid foam-related operating issues when detergent is being used.

The pressure threshold may be set/predetermined according to the breaking pressure of the porous material 168 (as measured using the test arrangement 166 and test procedure described above). The predetermined pressure threshold may accordingly be set to limit the underpressure, in other words a pressure difference between the inside of the wet cleaning apparatus between the porous material and the underpressure generator and the exterior of the cleaner head 100, e.g. atmospheric pressure, to being (e.g. at most) a value in the range of 2000 Pa to 13500 Pa, preferably 2000 Pa to 12500 Pa, more preferably 5000 Pa to 9000 Pa, most preferably 7000 Pa to 9000 Pa.

Investigations have shown that the higher the underpressure, the drier the surface to be cleaned may become, as previously explained (see Table 1 above). This leads to the conclusion that the wet cleaning apparatus 278 is desirably operated at the breaking pressure of the porous material 168.

The above-described investigations have shown that operation at 5000 Pa underpressure may provide favourable surface drying results. Hence a working window may be defined in which foaming can be prevented. Table 3 provides a specific non-limiting example of operating parameters of an exemplary wet cleaning apparatus 278.

TABLE 3

| | |
|---|---|
| Cleaning liquid supply pump flow | 40 $cm^3$/minute |
| Flow delivered by underpressure generator 178, e.g. pump | 150 $cm^3$/minute |
| Breaking pressure of porous material 168 | 6500 Pa |
| Operating pressure | 5000 Pa |

The above parameters may reflect that the porous material 168 can exhibit favourable surface drying capability at 5000 Pa, and may only start "breaking" at 6500 Pa.

Hence, foaming can be minimised or prevented by regulating the pressure, in other words selecting the above-mentioned pressure threshold, such that the underpressure behind the porous material 168 does not reach the breaking pressure of the porous material 168.

Figure 37C:
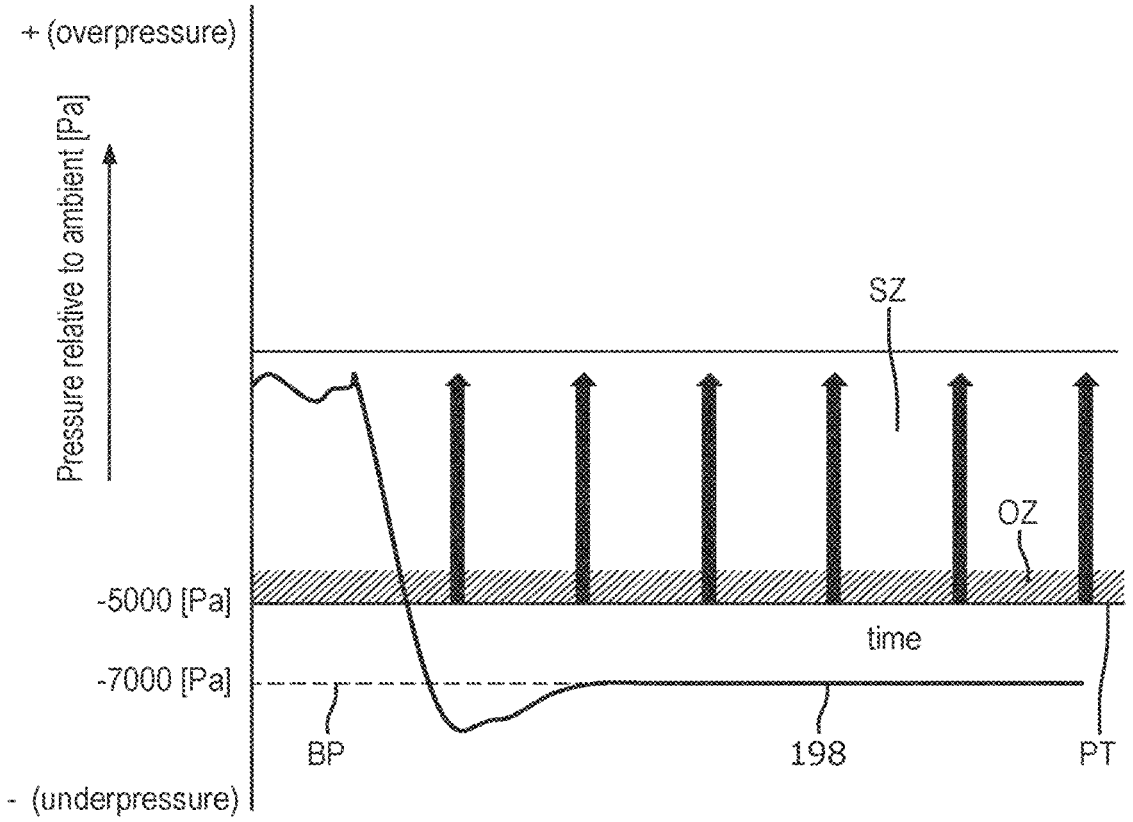
FIG. 37C graphically illustrates an operating window of the wet cleaning apparatus, in particular at start-up of the wet cleaning apparatus.

FIG. 37C graphically illustrates an operating window of the wet cleaning apparatus, in particular at start-up of the wet cleaning apparatus. FIG. 37C shows the pressure relative to atmospheric pressure vs time.

The breaking pressure BP of the porous material 168 can be regarded as being negative (with reference to atmospheric pressure). The pressure inside the wet cleaning apparatus between the porous material 168 and the underpressure generator 178 may accordingly be maintained above this negative pressure BP. On the other hand, should the breaking pressure of the porous material be an absolute pressure (with reference to vacuum, 0 Pa), then still the pressure inside the wet cleaning apparatus between the porous material 168 and the underpressure generator 178 may be maintained above such an absolute pressure, in particular via the flow being controlled such as to maintain the pressure at or above the predetermined threshold PT.

FIG. 37C also shows a "safe zone" SZ at or above the predetermined threshold PT at which the wet cleaning apparatus can be operated without approaching the breaking pressure BP of the porous material 168. Moreover, FIG. 37C shows an optimal operation zone OZ at which the requirement to avoid reaching the breaking pressure BP of the porous material 168 is combined with achieving sufficient liquid pick-up from the surface to be cleaned.

More generally, controlling the flow based on the pressure in the at least one covered dirt inlet 142A can be achieved in any suitable manner. In some embodiments, such as that shown in FIG. 38, the underpressure generator arrangement 280 comprises a sensor 180 arranged to sense a measure of the pressure on the inside of the wet cleaning apparatus between the porous material 168 and the underpressure generator 178, and a controller 298 configured to control the underpressure generator 178 to provide the flow based on the sensed measure of the pressure.

Figure 38:
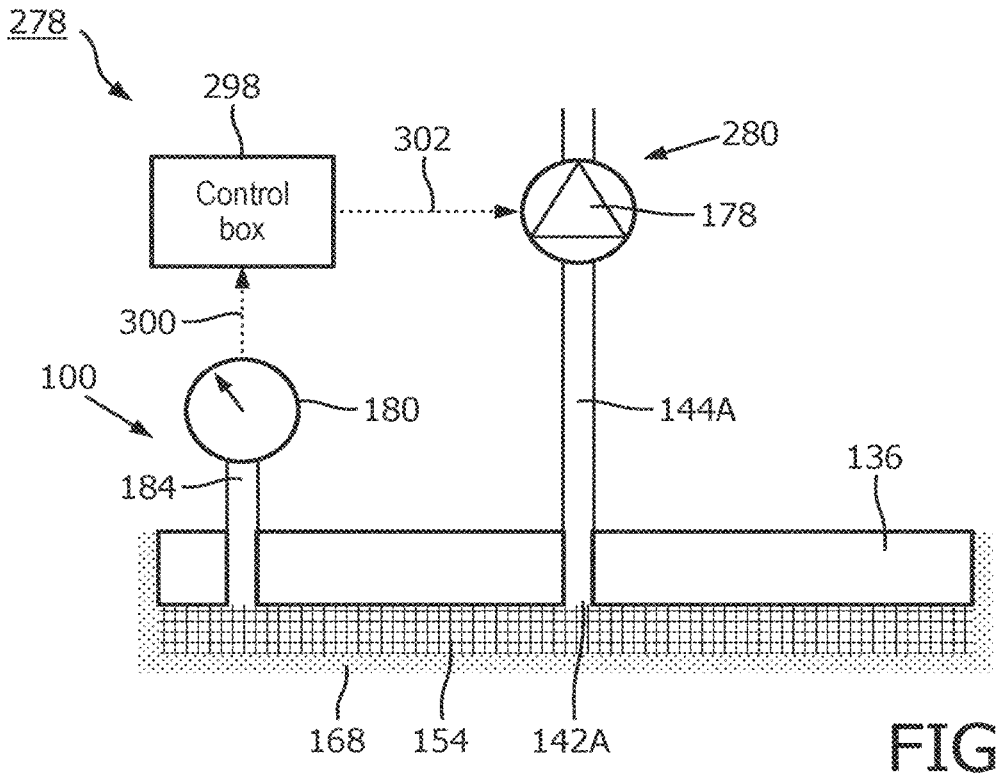
FIG. 38 schematically depicts an exemplary wet cleaning apparatus comprising an underpressure generator arrangement having an underpressure generator, a pressure sensor, and a controller.

The controller 298, e.g. microcontroller, may receive a sensor signal from the sensor 180, as represented in FIG. 38 by the arrow 300, and, based on the sensor signal, send a control signal 302 to the underpressure generator 178.

The control signal 302 may, for instance, trigger the underpressure generator 178 to activate to provide the flow or deactivate to cease the flow. Alternatively or additionally, the control signal 302 may, depending on the sensor signal 300, increase or decrease the flow. Deactivation or decreasing of the flow provided by the underpressure generator 178 in this manner may assist to reduce power consumption of the wet cleaning apparatus 278. This may assist to preserve battery power in examples in which the wet cleaning apparatus is battery powered/powerable, and thereby increase runtime.

Control over the flow can also assist to control wetness of the surface to be cleaned, as previously described.

In some embodiments, the controller 298 is configured to control the flow provided by the underpressure generator 178 such that the pressure on the inside of the wet cleaning apparatus between the porous material 168 and the underpressure generator 178 is maintained at or above the above-mentioned predetermined pressure threshold. In a non-limiting example, the underpressure generator 178 may control the underpressure generator 178 to deactivate to cease, or decrease, the flow should the sensed measure of the pressure indicate that the pressure is below the predetermined pressure threshold.

In a non-limiting example, the controller 298, e.g. comprising or in the form of a proportional integral controller, is configured to compare the sensed measure of the pressure to a desired operating pressure (e.g. set with reference to the breaking pressure of the porous material 168, as previously described), and control the underpressure generator 178 based on the comparison.

In some embodiments, the sensor 180 is arranged to sense the measure of the pressure in at least one of: a cavity 150 between the porous material 168 and the at least one dirt inlet 142A, and a tube 144A (or tubes 144A, 144B) connecting the at least one dirt inlet 142A with the underpressure generator 178.

Sensing the measure of the pressure in the cavity 150 may be particularly advantageous since the flow can be tuned more directly to the properties of the porous material 168 during use.

Arranging the sensor 180 such that the measure of the pressure is sensed in the tube(s) 144A, 144B may provide a relatively straightforward way of incorporating the sensor 180 in the wet cleaning apparatus.

In embodiments in which the underpressure generator 178 is arranged downstream of the dirty liquid collection tank, the sensor 180 can also be positioned in the dirty liquid collection tank. In such a scenario, the height of the dirty liquid collection tank, e.g. arranged on or in the handle, may create noise ($dP=H*\cos(\alpha)*\rho*g$, with H being the height of the dirty liquid collection tank in a vertical position, $\alpha$ being the angle of the handle with respect to the vertical). However, this noise can be compensated by including an angle sensor, e.g. accelerometer, in the sensor 180.

More generally, the sensor 180 can be any suitable type of sensor provided that the sensor is capable of sensing the measure of the pressure on the inside of the wet cleaning apparatus between the porous material 168 and the underpressure generator 178. For example, the sensor comprises a pressure sensor, e.g. a microelectromechanical system (MEMS) pressure sensor.

Figure 39:
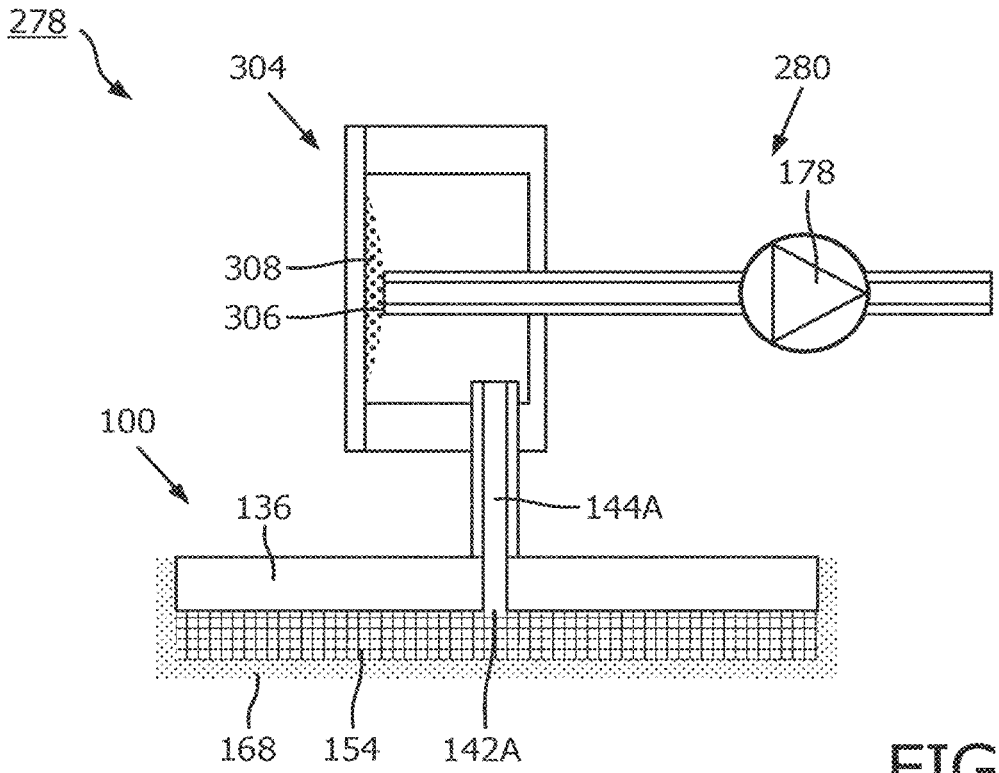
FIG. 39 schematically depicts an exemplary wet cleaning apparatus having an underpressure generator arrangement having an underpressure generator and a mechanical regulator.

In some embodiments, such as that shown in FIG. 39, the underpressure generator arrangement 280 comprises a mechanical regulator 304 configured to control the flow based on the pressure on the inside of the wet cleaning apparatus between the porous material 168 and the underpressure generator 178.

The mechanical regulator 304 may, for example, comprise a valve 306, 308 arranged to control fluid communication between the underpressure generator 178 and the at least one dirt inlet 142A according to the pressure in the at least one covered dirt inlet 142A.

In the non-limiting example shown in FIG. 39, the valve 306, 308 comprises a valve seat 306, and a valve member 308 configured to adopt an initial position in which the valve member 308 is separated from the valve seat 306 such as to permit fluid communication between the underpressure generator 178 and the at least one dirt inlet 142A, and a closed position in which the valve member 308 is against the valve seat 306 to restrict fluid communication between the underpressure generator 178 and the at least one dirt inlet 142A.

In some embodiments, the valve 306, 308 is configured such that the valve member 308 is caused by the pressure in the at least one covered dirt inlet 142A to be moved against the valve seat 306 when the pressure is below the above-mentioned predetermined pressure threshold.

The valve member 308 may, for example, be in the form of a flexible rubber membrane which adopts a flat profile in the initial position, and is accordingly spatially removed from the valve seat 306, when there is no underpressure in the covered dirt inlet(s) 142A. After the underpressure generator 178, e.g. pump, is activated, an underpressure may be generated in the covered dirt inlet(s) 142A and the mechanical regulator 304. The underpressure may act on the exposed surface of the rubber membrane in the mechanical regulator 304, which may therefore start to deflect inwards in the direction of the valve seat 306.

In this non-limiting example, the threshold pressure can be set/predetermined by the distance between the flexible rubber membrane and the valve seat 306. The larger the distance, the higher the underpressure (or equivalently the lower the pressure) in the covered dirt inlet(s) 142A needed to deform the rubber membrane to contact the valve seat 306.

Once the underpressure reaches the level which causes the rubber membrane to contact the valve seat, the fluid communication between the underpressure generator 178 and the porous material 168 may be removed, thereby preventing the underpressure from reaching higher levels than set by the mechanical regulator 304. The underpressure generator 178 may remain operating at the same rate, towards its maximum operating underpressure. When the underpressure in the covered dirt inlet(s) 142A lowers, the flexible membrane may move back towards the above-mentioned flat state, thereby opening the valve 306, 308 and allowing the underpressure generator 178 to restore the desired underpressure level.

In another non-limiting example, the mechanical regulator 304 comprises a switch whose actuation controls the underpressure generator 178, and a deflectable member, e.g. a membrane, configured to actuate the switch in response to the pressure.

Such a mechanical regulator, in this case an electromechanical regulator, can be configured such that the actuation of the switch, e.g. to deactivate the underpressure generator 178, by the membrane takes place when, for instance, the pressure is at or above the predetermined pressure threshold.

This switch-membrane arrangement may provide a simple and inexpensive way of controlling the flow based on the pressure without the requirement for an additional controller, e.g. microcontroller.

Figure 40:
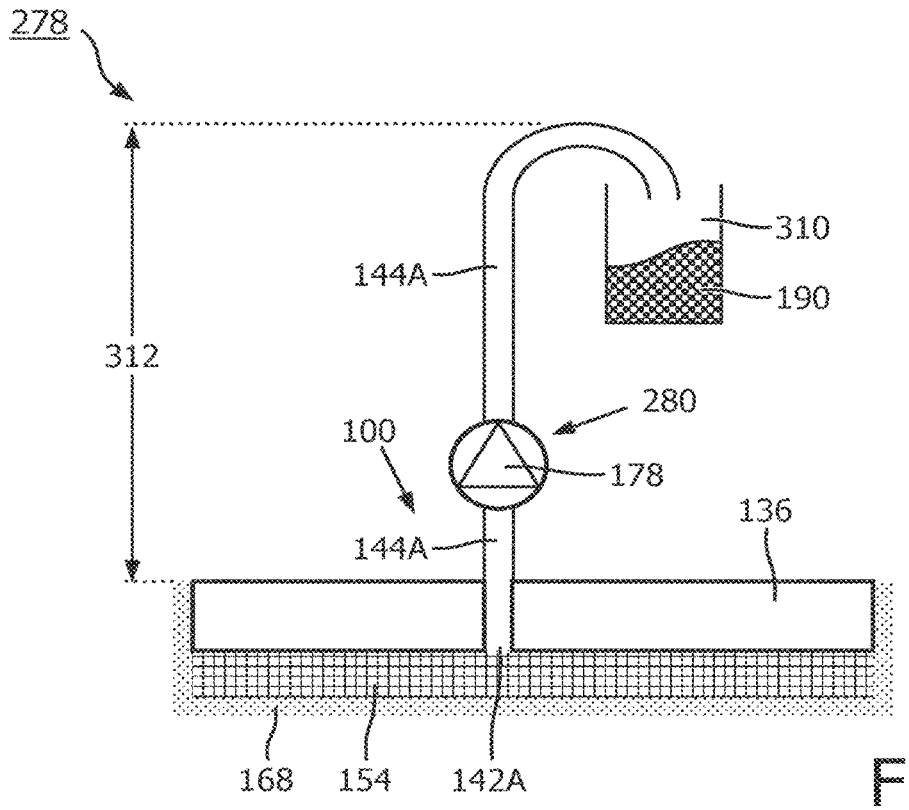
FIG. 40 schematically depicts an exemplary wet cleaning apparatus whose underpressure generator comprises a pressure-limited liquid pump.
Figure 41:
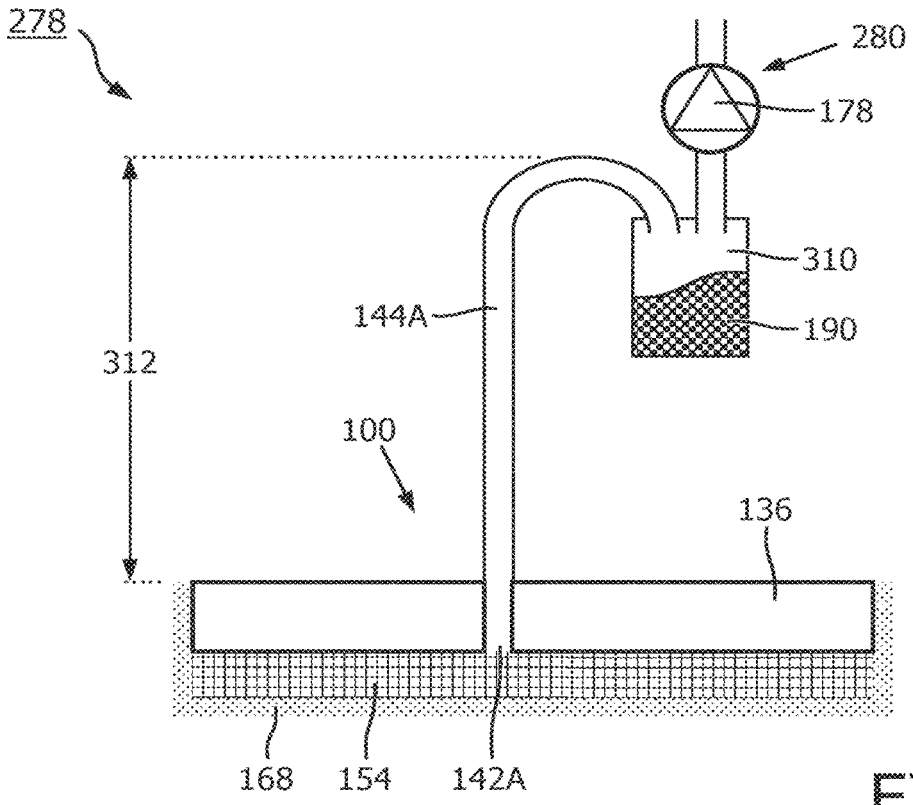
FIG. 41 schematically depicts an exemplary wet cleaning apparatus whose underpressure generator comprises a pressure-limited air pump.

In some embodiments, such as those shown in FIGS. 40 and 41, the underpressure generator 178 itself comprises a pump configured to, responsive to the pressure in the at least one covered dirt inlet 142A, control the flow.

Such a pump can be regarded as a pressure-limited pump. A pressure limited pump is capable of generating a certain pressure difference over the tube to which it is connected. In principle, this pump pressure can be tuned to the pressure needed for the porous material 168 covering the dirt inlet(s) 142A.

The pressure-limited pump can comprise or be, for example, a centrifugal pump. The pump, e.g. centrifugal pump, may be or comprise a liquid pump. Such a liquid pump may, for instance, be arranged between the dirt inlet(s) 142A and a dirty liquid collection tank 310. In the non-limiting example shown in FIG. 40, the underpressure generator 178, e.g. centrifugal and/or liquid pump, is arranged in the cleaner head 100.

Alternatively, the pump, e.g. centrifugal pump, may be or comprise an air pump. Such an air pump may, for instance, be arranged downstream of a dirty liquid collection tank 310.

It is noted that the dirty liquid collection tank 310 may be arranged at a certain height 312, e.g. 0.5 m, on the handle. An additional water head may thus be required:

$$P=h*\rho*g=0.5*1000*9.81\sim5000\text{ Pa}$$

When the position of the handle is taken into account, including the position in which the handle is lying flat on a horizontal surface to be cleaned 218, e.g. the surface of a floor, (in which the water head becomes zero) the pressure variation on the porous material 168 may be equal to its operating pressure. The latter may be addressed by attaching the tube 144A at a fixed height relative to the floor, regardless of the position of the handle, e.g. by attaching (a part of) the dirty liquid collection tank 310 directly to the porous material 168.

FIG. 41 schematically depicts a wet cleaning apparatus 278 in which the pressure is regulated using an underpressure generator 178 pressure limited air pump, e.g. a centrifugal air pump. This may provide start-up benefits relative to the example shown in FIG. 40, since the pump may always be operating using air, thereby ensuring that the pump is capable of generating the required underpressure at start-up (with the porous material 168 fully dry).

In some embodiments, the underpressure generator 178, irrespective of its design, is configured such that the flow, when the flow is being provided, is in the range of 40 to 2000 $cm^3$/minute, more preferably 80 to 750 $cm^3$/minute, and most preferably 100 to 300 $cm^3$/minute.

Such a flow, i.e. flow rate, may capitalise on the underpressure-maintaining capability of the porous material, and may ensure sufficient liquid pick-up whilst limiting energy consumption, as previously described.

More generally, the wet cleaning apparatus 278 may be or comprise, for example, a wet mopping device, a window cleaner, a sweeper, or a wet vacuum cleaner, such as canister-type, stick type, or upright type wet vacuum cleaner.

In a particular non-limiting example, the wet cleaning apparatus 278 is a battery-powered (or battery-powerable)

wet cleaning apparatus, such as a battery-powered (or battery-powerable) wet mopping device, in which the underpressure generator 178, e.g. pump, is powered (or powerable) by a battery electrically connected (or connectable) thereto. Particular mention is made of this example due to the above-described power consumption-reducing effect which can be provided by the porous material 168 covering the dirt inlet(s) 142A, 142B to which the suction of the underpressure generator 178 is provided.

Figure 42:
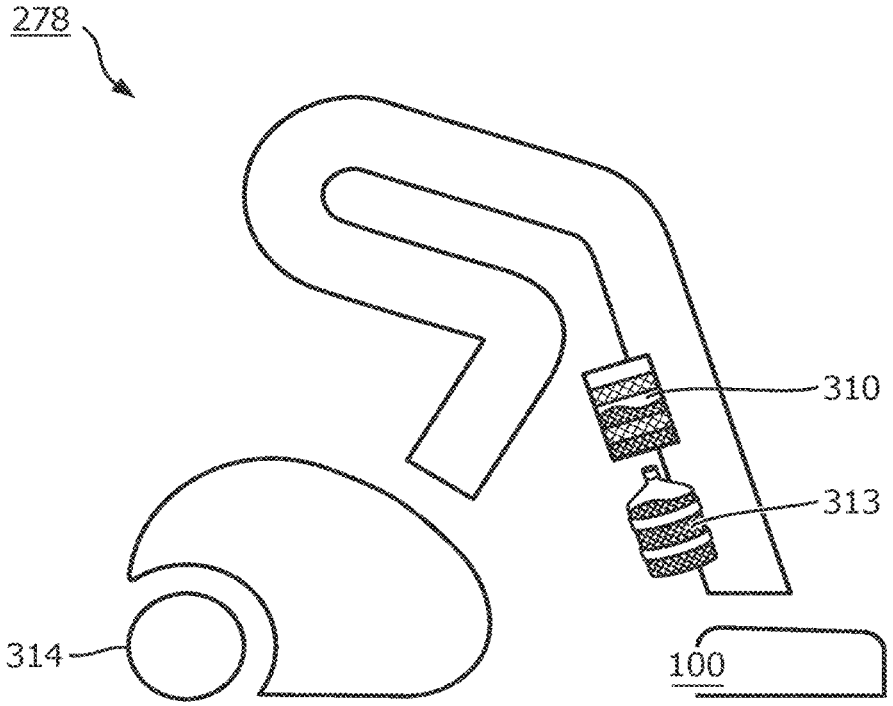
FIG. 42 schematically depicts an exemplary wet cleaning apparatus in the form of a wet vacuum cleaner.

FIG. 42 schematically depicts an exemplary wet cleaning apparatus 278 in the form of a wet vacuum cleaner. In this non-limiting example, the wet cleaning apparatus 278 comprises the above-described dirty liquid collection tank 310, and the cleaning liquid reservoir 313. The cleaner head 100 included in the wet vacuum cleaner can be moved over the surface to be cleaned 218, in this example assisted by the wheels 314 included in the wet vacuum cleaner.

The wet cleaning apparatus 278 may in some examples be or comprise a robotic wet vacuum cleaner or a robotic wet mopping device configured to autonomously move the cleaner head 100 on the surface to be cleaned, such as the surface of a floor.

Figure 43:
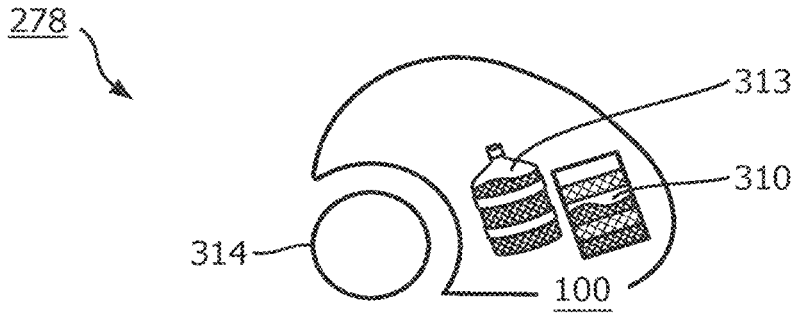
FIG. 43 schematically depicts an exemplary wet cleaning apparatus in the form of a robotic wet vacuum cleaner.

FIG. 43 schematically depicts an exemplary wet cleaning apparatus 278 in the form of a robotic wet vacuum cleaner. The robotic wet vacuum cleaner may move autonomously on the surface to be cleaned 218, e.g. via automated control over the wheels 314.

The cleaning liquid stored in the cleaning liquid reservoir 313 can be delivered to the surface to be cleaned, and liquid can be picked up via the covered dirt inlet(s) 142A of the cleaner head 100 and collected in the dirty liquid collection tank 310, during autonomous movement of the robotic wet vacuum cleaner. The underpressure generator 278/underpressure generator arrangement 280 and/or cleaning liquid supply may also be under automated control.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A wet cleaning apparatus comprising:

a cleaner head having at least one dirt inlet, and a porous material covering the at least one dirt inlet; and an underpressure generator arrangement comprising:

an underpressure generator configured to provide a flow inside the wet cleaning apparatus to draw fluid into the at least one dirt inlet through the porous material;

a sensor arranged to sense a measure of the pressure on the inside of the wet cleaning apparatus between the porous material and the underpressure generator, wherein the sensor is positioned in a cavity behind the porous material; and a controller configured to control the underpressure generator to provide the flow based on the measure of pressure on the inside of the wet cleaning apparatus between the porous material and the underpressure generator.

2. The wet cleaning apparatus of claim 1, wherein the controller is configured to control the flow such that the pressure is maintained at or above a predetermined pressure threshold, wherein the predetermined pressure threshold is set to limit a pressure difference between the inside of the wet cleaning apparatus and the exterior of the cleaner head to being a value in the range of 2000 Pa to 13500 Pa.

3. The wet cleaning apparatus of claim 1, wherein the sensor is arranged to sense the measure of the pressure in at least one of: the cavity between the porous material and the at least one dirt inlet; and a tube connecting the at least one dirt inlet with the underpressure generator.

4. The wet cleaning apparatus of claim 1, wherein the underpressure generator arrangement further comprises a mechanical regulator configured to control the flow based on the pressure.

5. The wet cleaning apparatus of claim 4, wherein the mechanical regulator comprises a valve arranged to control fluid communication between the underpressure generator and the at least one dirt inlet.

6. The wet cleaning apparatus of claim 5, wherein the valve comprises a valve seat, and a valve member configured to adopt an initial position in which the valve member is separated from the valve seat such as to permit the fluid communication between the underpressure generator and the at least one dirt inlet, and a closed position in which the valve member is against the valve seat to restrict the fluid communication between the underpressure generator and the at least one dirt inlet.

7. The wet cleaning apparatus of claim 6, wherein the valve is configured such that the valve member is caused by the pressure in the at least one dirt inlet to be moved against the valve seat when the pressure is below a predetermined pressure threshold.

8. The wet cleaning apparatus of claim 7, wherein the underpressure generator comprises a pump wherein the pump comprises a centrifugal pump.

9. The wet cleaning apparatus of claim 8, wherein the pump comprises a centrifugal pump, wherein the centrifugal pump is arranged in the cleaner head or in a handle coupled to the cleaner head.

10. The wet cleaning apparatus of claim 1, further comprising a dirty liquid collection tank to collect liquid, the underpressure generator arrangement being arranged such that the flow draws the liquid from the at least one dirt inlet to the dirty liquid collection tank.

11. The wet cleaning apparatus of claim 10, wherein the underpressure generator comprises a pump, and wherein the pump comprises a centrifugal pump arranged downstream of the dirty liquid collection tank.

12. The wet cleaning apparatus of claim 1, wherein the porous material comprises a porous material layer sealingly attached to the at least one dirt inlet.

13. The wet cleaning apparatus of claim 1, wherein the cleaner head comprises at least one cleaning liquid outlet through which cleaning liquid is deliverable, and wherein the wet cleaning apparatus further comprises a cleaning liquid supply comprising a cleaning liquid reservoir to contain the cleaning liquid, the cleaning liquid reservoir being fluidly communicable or in fluid communication with the at least one cleaning liquid outlet.

14. The wet cleaning apparatus of claim 1, wherein the wet cleaning apparatus is a wet mopping device and/or wherein the underpressure generator is configured such that the flow, when the flow is being provided, is in the range of 15 to 2000 $cm^3$/minute.

15. The wet cleaning apparatus of claim 1, wherein the underpressure generator is configured to provide a flow rate through the porous material which is less than or equal to 2000 $cm^3$/minute.

* * * * *